US005480886A

United States Patent [19]

Yamazaki et al.

[11] Patent Number: 5,480,886

[45] Date of Patent: Jan. 2, 1996

[54] SILVER HALIDE PHOTOGRAPHIC MATERIAL

[75] Inventors: Kazuki Yamazaki; Nobuaki Inoue; Seiichi Yamamoto; Toshihide Ezoe; Minoru Sakai; Tadashi Ikeda; Masaki Okazaki; Toshiki Fujiwara, all of Kanagawa, Japan

[73] Assignee: Fuji Photo Film Co., Ltd., Kanagawa, Japan

[21] Appl. No.: 334,362

[22] Filed: Nov. 3, 1994

Related U.S. Application Data

[63] Continuation of Ser. No. 161,580, Dec. 6, 1993, abandoned.

[30] Foreign Application Priority Data

| | | | |
|---|---|---|---|
| Dec. 7, 1992 | [JP] | Japan | 4-351136 |
| Dec. 11, 1992 | [JP] | Japan | 4-352393 |
| Dec. 17, 1992 | [JP] | Japan | 4-354748 |
| Dec. 22, 1992 | [JP] | Japan | 4-356502 |
| Feb. 23, 1993 | [JP] | Japan | 5-33722 |
| Mar. 10, 1993 | [JP] | Japan | 5-75084 |
| Apr. 1, 1993 | [JP] | Japan | 5-96449 |

[51] Int. Cl.[6] ..... G03C 1/06

[52] U.S. Cl. ..... 430/264; 430/604; 430/583; 430/598; 430/576; 430/561; 430/435

[58] Field of Search ..... 430/264, 604, 430/583, 598, 576, 561, 435

[56] References Cited

U.S. PATENT DOCUMENTS

| | | | |
|---|---|---|---|
| 4,675,279 | 6/1987 | Shuto et al. | 430/567 |
| 4,681,836 | 7/1987 | Inoue | 430/434 |
| 4,828,962 | 5/1989 | Grzeskowiak et al. | 430/604 |
| 4,933,272 | 6/1990 | McDugle et al. | 430/604 |
| 5,075,198 | 12/1991 | Katoh | 430/264 |
| 5,221,593 | 6/1993 | Onodera et al. | 430/264 |
| 5,229,263 | 7/1993 | Yoshida et al. | 430/604 |
| 5,256,519 | 10/1993 | Adin | 430/264 |
| 5,279,933 | 1/1994 | Gingello et al. | 430/264 |
| 5,288,590 | 2/1994 | Kuwabara et al. | 430/264 |

FOREIGN PATENT DOCUMENTS

| | | | |
|---|---|---|---|
| 0514675 | 11/1992 | European Pat. Off. | 430/604 |

*Primary Examiner*—Thomas R. Neville

*Attorney, Agent, or Firm*—Sughrue, Mion, Zinn, Macpeak & Seas

[57] ABSTRACT

Disclosed is a silver halide photographic material and forming an image using the same, containing a hydrazine derivative in the emulsion layer(s) or in other hydrophilic colloid layer(s). At least one silver halide emulsion comprises silver halide grains containing (a) from $1\times10^{-8}$ to $1\times10^{-6}$ mol, per mol of silver, of an iridium compound, and (b) from $1\times10^{-8}$ to $1\times10^{-6}$ mol, per mol of silver, of a rhodium compound or from $1\times10^{-9}$ to $1\times10^{-5}$ mol, per mol of silver, of a rhenium compound, ruthenium compound or osmium compound, and having a silver chloride content of 50 mol % or more, the emulsion having been color-sensitized with a sensitizing dye of the following general formulae (1), (2) or (3):

(1)

(2)

(3)

The material may be processed with a stable developer to give a hard image having few "black peppers".

4 Claims, No Drawings

SILVER HALIDE PHOTOGRAPHIC MATERIAL

This is a Continuation of application Ser. No. 08/161,580 filed Dec. 6, 1993 now abandoned.

FIELD OF THE INVENTION

The present invention relates to a silver halide photographic material and, more precisely, to a super-hard silver halide photographic material for photoengraving.

BACKGROUND OF THE INVENTION

For the purpose of improving the reproducibility of continuous gradation dot images or that of line images in the field of graphic arts, image forming systems yielding super-hard photographic characteristics (especially having $\gamma$ of 10 or more) are needed.

In particular, image forming systems using processing solutions having good storage stability and yielding super-hard photographic characteristics are desired. As one example, systems have been proposed for forming a super-hard negative image having $\gamma$ of more than 10 by processing a surface-latent-image-forming silver halide photographic material containing a particular acylhydrazine compound with a developer containing a sulfite preservative in an amount of 0.15 mol/liter or more and having pH of from 11.0 to 12.3; examples of such systems are found in U.S. Pat. Nos. 4,166,742, 4,168,977, 4,221,857, 4,224,401, 4,243,739, 4,272,606 and 4,311,781. The new image forming system is characterized in that even photographic materials comprising silver iodobromide emulsions or silver chloroiodobromide emulsions may be processed by the system, while only those comprising silver chlorobromide emulsions with high silver chloride contents can be processed by conventional, super-hard image-forming systems. In addition, since the developer to be used in the new system may contain a large amount of a sulfite preservative, the storage stability of the developer used therein is relatively good, and this is another advantage of the new system, while conventional lith developers can contain only an extremely small amount of a sulfite preservative.

However, the developer having pH of 11 or more, as used in the new system, is easily oxidized with air and is unstable, so that it cannot be stored or used for a long period of time.

Various devices have heretofore been tried for developing silver halide photographic materials containing hydrazine compounds with developers having lower pH values so as to form hard images.

In JP-A-1-179939 and JP-A-1-179940 (the term "JP-A" as used herein means an "unexamined published Japanese patent application"), there is described a method of processing a photographic material containing a nucleating development accelerator having an adsorbing group of adsorbing silver halide emulsion grains and a nucleating agent having an adsorbing group of the same kind, with a developer having a pH of not higher than 11.0.

In U.S. Pat. Nos. 4,998,604, 4,994,365 and 4,975,354, there are disclosed hydrazine compounds having ethylene oxide repeating units and hydrazine compounds having pyridinium groups. From the examples thereof, however, the contrast of the images formed by the inventions of the U.S. patents is not sufficient. Therefore, it is difficult to obtain hard images having the necessary Dmax from the photographic materials of the above patented inventions, when the materials are processed under practical processing conditions.

The variation of the photographic properties of nucleating hard photographic materials containing hydrazine derivatives is great, depending upon the change of pH of the developers to be used for processing them. The pH of developers greatly fluctuates due to the aerial oxidation thereof as well the elevation of the thickness thereof by vaporization of water or the lowering of the same by absorption of carbon dioxide in air. Therefore, various devices have been tried for reducing the dependence of photographic properties on the pH of developers.

Examples of using chemically-sensitized silver chlorobromides in photographic systems using hydrazines have been disclosed in, for example, JP-A-53-20921, JP-A-60-83028, JP-A-60-140399, JP-A-63-46437, JP-A-63-103230, JP-A-3-294844, JP-A-3-294845 and JP-A-4-174424 and Japanese Patent Application No. 3-188230. On the other hand, examples of combinations of hydrazines and silver halide emulsions containing heavy metal complexes of, for example, rhodium, iridium or the like have been disclosed in, for example, JP-A-60-83028, JP-A-61-47942, JP-A-61-47943, JP-A-61-29837, JP-A-62-201233, JP-A-62-235947 and JP-A-63-103232.

Various examples of photographic systems containing hydrazines and anion-charged cyanine dyes, such as, for example, alkali salts of 5,5'-dichloro-9-ethyl-3,3'-bis( 3-sulfopropyl)oxacarbocyanine have been disclosed, for example, in JP-A-61-29837, JP-A-62-235947, JP-A-62-280733, JP-A-62-280734, JP-A-2-40, JP-A-2-124560, JP-A-2-262653 and JP-A-3-63641.

SUMMARY OF THE INVENTION

The first object of the present invention is to provide a silver halide photographic material which may be processed with a stable developer to yield extremely hard photographic properties having gamma of more than 10.

The second object of the present invention is to provide a silver halide photographic material which may be processed with a developer having pH of not higher than 11 to yield hard photographic properties. Even though the material is processed with the developer in large amounts, there is little fluctuation of the photographic properties of the material.

The third object of the present invention is to provide a silver halide photographic material having few "black peppers" (small black spots formed in the non-image area) even when it is processed with a developer in a state of advanced aerial oxidation.

The above-mentioned objects have been attained by a silver halide photographic material having at least one silver halide emulsion layer on a support and containing a hydrazine derivative in the emulsion layer or in another hydrophilic colloid layer(s), in which the silver halide emulsion comprises silver halide grains containing:

(a) from $1\times10^{-8}$ to $1\times10^{-6}$ mol, per mol of silver, of an iridium compound, and (b) from $1\times10^{-8}$ to $1\times10^{-6}$ mol, per mol of silver, of a rhodium compound or from $1\times10^{-9}$ to $1\times10^{-5}$ mol, per mol of silver, of a rhenium compound, ruthenium compound or osmium compound, and having a silver chloride content of 50 mol % or more, which has been color-sensitized with a sensitizing dye of the following general formula (1), (2) or (3):

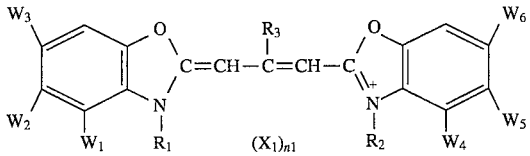

(1)

where $W_1$ and $W_4$ each represents a hydrogen atom;

$W_3$ and $W_6$ each represents a hydrogen atom, a methyl group or a methoxy group;

$W_2$ represents an optionally branched alkyl group having 1 to 6 carbon atoms as a whole, an alkoxy group having 1 to 5 carbon atoms as a whole, a bromine atom, an iodine atom, or an aryl group having 1 to 9 carbon atoms as a whole; or $W_2$ may be bonded to $W_1$ or $W_3$ to form a benzene ring; or $W_2$ may also be a chlorine atom when $W_3$ is a methyl group or a methoxy group;

$W_5$ represents an optionally branched alkyl group having 1 to 6 carbon atoms as a whole, an alkoxy group having 1 to 5 carbon atoms as a whole, a halogen atom, a hydroxyl group, an aryl group having 1 to 9 carbon atoms as a whole, an aryloxy group having 1 to 9 carbon atoms as a whole, an arylthio group having 1 to 8 carbon atoms as a whole, an alkylthio group having 1 to 4 carbon atoms as a whole, or an acylamino group having 1 to 4 carbon atoms as a whole, and $W_5$ may be bonded to $W_4$ or $W_6$ to form a benzene ring;

$R_1$ and $R_2$ may be the same or different and each represents an optionally substituted alkyl or alkenyl group having 1 to 10 carbon atoms as a whole, and at least one of $R_1$ and $R_2$ has a sulfo group or a carboxyl group;

$R_3$ represents an optionally substituted alkyl group;

$X_1$ represents a pair ion necessary for neutralizing the charge of the molecule;

$n_1$ represents 0 or 1, and it is 0 when the molecule is an internal salt.

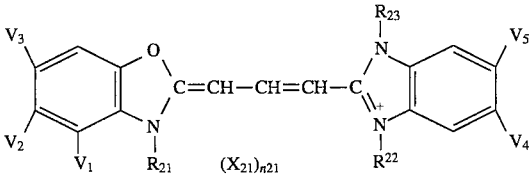

(2)

where $V_1$ represents a hydrogen atom;

$V_2$ represents a hydrogen atom, a halogen atom, a hydroxyl group, an optionally branched alkyl group, a lower alkoxy group, an aryl group having 1 to 9 carbon atoms as a whole, an aryloxy group having 1 to 9 carbon atoms as a whole, an arylthio group having 1 to 8 carbon atoms as a whole, a lower alkylthio group, or an acylamino group having 1 to 4 carbon atoms as a whole, and $V_2$ may be bonded to $V_1$ or $V_3$ to form a benzene ring;

$V_3$ represents a hydrogen atom, a methyl group or a methoxy group;

$V_4$ represents an electron-withdrawing group;

$V_5$ represents a hydrogen atom, a fluorine atom, a chlorine atom or a bromine atom;

$R_{21}$, $R_{22}$ and $R_{23}$ may be the same or different and each represents an optionally substituted alkyl or alkenyl group having 10 or less carbon atoms as a whole, and at least one of $R_{21}$, $R_{22}$ and $R_{23}$ is a group having a sulfo group or a carboxyl group;

$X_{21}$ represents a counter ion necessary for neutralizing the charge of the molecule;

$n_{21}$ represents 0 or 1, and it is 0 when the molecule is an internal salt.

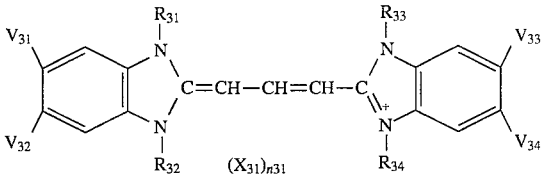

(3)

where $V_{31}$ and $V_{33}$ each represents a hydrogen atom or an electron-withdrawing group;

$V_{32}$ and $V_{34}$ each represents an electron-withdrawing group;

$R_{31}$, $R_{32}$, $R_{33}$ and $R_{34}$ may be the same or different and each represents an optionally substituted alkyl or alkenyl group having 10 or less carbon atoms as a whole, and at least one of $R_{31}$, $R_{32}$, $R_{33}$ and $R_{34}$ is a group having a sulfo group or a carboxyl group;

$X_{31}$ represents a counter ion necessary for neutralizing the charge of the molecule;

$n_{31}$ represents 0 or 1, and it is 0 when the molecule is an internal salt.

DETAILED DESCRIPTION OF THE INVENTION

The silver halide in at least one silver halide emulsion layer constituting the silver halide photographic material of the present invention is a silver chlorobromide or silver iodochlorobromide having a silver chloride content of 50 mol % or more. The silver iodide content in the silver halide is 3 mol % or less, more preferably 0.5 mol % or less. The shapes of the silver halide grains are not specifically defined and the grains may be any of cubic, tetradecahedral, octahedral, amorphous or tabular ones. Preferably, the grains are cubic. The mean grain size of the silver halide grains is preferably from 0.1 μm to 0.7 μm, more preferably from 0.2 μm to 0.5 μm. The grains are desired to have a narrow grain size distribution which is based on the fluctuation coefficient to be represented by {(standard deviation of grain size)/(mean grain size)}×100. Preferably, the fluctuation coefficient of the grains is 15% or less, more preferably 10% or less.

The silver halide grains each may have a uniform composition in the core and the surface layer, or may have different compositions in the core and layer.

The photographic emulsions to be used in the present invention may be prepared by known methods, for example, by the methods described in P. Glafkides, *Chimie et Physique Photographique* (published by Paul Montel, 1967), G. F. Duffin, *Photographic Emulsion Chemistry* (published by The Focal Press, 1966) and V. L. Zelikman et al, *Making and Coating Photographic Emulsions* (published by The Focal Press, 1964).

For reacting a soluble silver salt and soluble halides for making the silver halide grains of the present invention, a single jet method, a double jet method or a combination of such methods may be employed.

A so-called reversed mixing method of forming silver halide grains in the presence of excess silver ions may also be employed. As one system of the double jet type, there may also be employed a so-called controlled double jet method, where the pAg in the liquid phase of forming silver halide grains therein is kept constant. It is preferred to form the silver halide grains in the presence of a so-called silver halide solvent, such as, ammonia, thioethers or tetra-substituted thioureas. Especially preferred as the silver halide solvent are tetra-substituted thiourea compounds, which are described in, for example, JP-A-53-82408 and JP-A-55-77737. Of these, tetramethyl-thiouea and 1,3-dimethyl-2-imidazolidinethione are preferred.

By the controlled double jet method using the silver halide solvent, it is easy to form silver halide grains of regular crystals having a narrow grain size distribution. Therefore, the method is useful for forming silver halide emulsions for use in the present invention.

For making silver halide grains of uniform size, a method is used which varies the speed of addition of silver nitrate and alkali halides in accordance with the speed of the growth of the grains being formed, such as the method described in British Patent 1,535,016 and JP-B-48- 36890 and JP-B-52-16364 (the term "JP-B" as referred to herein means an "examined Japanese patent publication"), and a method of varying the concentrations of the aqueous solutions to be reacted, such as that described in U.S. Pat. No. 4,242,445 and JP-A-55-158124, are preferably employed whereby the grains are grown rapidly within the range which does not overstep the critical saturations.

The silver halide photographic material of the present invention contains an iridium compound so as to have high sensitivity and high contrast.

Various iridium compounds may be employed in the present invention. For instance, there may be mentioned hexachloro-iridium, hexaammine-iridium, trioxalato-iridium, hexacyano-iridium, etc. These iridium compounds are used as solutions in water or in suitable solvents. For stabilizing the iridium compound solutions, an aqueous hydrogen halide solution (e.g., hydrochloric acid, hydrobromic acid, hydrofluoric acid) or an alkali halide (e.g., KCl, NaCl, KBr, NaBr) may be added thereto, as is well known for the purpose. In place of using the water-soluble iridium compounds, different iridium-doped silver halide grains may be added to the system for forming the silver halide emulsion of the present invention, whereupon the iridium is liberated from the grains into the system.

The total amount of the iridium compound to be incorporated into the silver halide emulsion of the present invention is suitably from $1\times10^{-8}$ to $5\times10^{-6}$, and preferably from $5\times10^{-8}$ to $1\times10^{-6}$ mol, per mol of the silver halide to be finally formed.

The addition of the compound to the emulsion may be conducted at any stage during the formation of the silver halide grains and before the coating of the emulsion. It is especially preferred that the compound is added during the formation of the emulsion whereby it is incorporated into the silver halide grains which are formed.

The silver halide grains of the present invention additionally contain a rhodium compound, a rhenium compound, a ruthenium compound, or an osmium compound The rhodium compound to be used in the present invention is preferably a water-soluble rhodium compound. For instance, usable are rhodium(III) halides, as well as rhodium complexes having halogen, amine, oxalato or the like ligands, such as hexachloro-rhodium(III) complex, hexabromo-rhodium(III) complex, hexaammine-rhodium(III) complex, trioxalato-rhodium(III) complex, etc. These rhodium compounds are used as solutions in water or in suitable solvents. For stabilizing the rhodium compound solutions, an aqueous hydrogen halide solution (e.g., hydrochloric acid, hydrobromic acid, hydrofluoric acid) or an alkali halide (e.g., KCl, NaCl, KBr, NaBr) may be added thereto, as is well known for the purpose. In place of using the water-soluble rhodium compounds, different rhodium-doped silver halide grains may be added to the system of forming the silver halide emulsion of the present invention, whereupon the rhodium is liberated from the grains into the system.

The total amount of the rhodium compound to be incorporated into the silver halide emulsion of the present invention is suitably from $1\times10^{-8}$ to $5\times10^{-6}$, and preferably from $5\times10^{-8}$ to $1\times10^{-6}$ mol, per mol of the silver halide to be finally formed.

The addition of the rhodium compound to the emulsion may be conducted at any stage during the formation of the silver halide grains and before the coating of the emulsion. It is especially preferred that the compound is added during the formation of the emulsion whereby it is incorporated into the silver halide grains which are formed.

The content of at least one metal selected from the group consisting of rhenium, ruthenium and osmium in the silver halide emulsion of the present invention is suitably from $1\times10^{-9}$ to $1\times10^{-5}$ mol, and preferably from $1\times10^{-8}$ to $1\times10^{-6}$ mol, per mol of silver. Two or more of these metals may be in the emulsion. The metal may be uniformly distributed in the silver halide grains, or alternatively, it may be non-uniformly distributed in them, for example, in the manner as described in JP-A-6329603, JP-A-2-306236, JP-A-3-167545 and JP-A-4-76534, and Japanese Patent Application Nos. 4-68305 and 4-258187.

Rhenium, ruthenium and osmium are added to the silver halide grains as their water-soluble complexes such as those described in JP-A-63-2042, JP-A-1-285941, JP-A-2-20852 and JP-A-2-20855. Especially preferred are hexa-coordinate complexes of the following formula:

$$[ML6]-n$$

where M represents Ru, Re or Os; L represents a crosslinking ligand; and n is 0, 1, 2, 3 or 4.

In the complexes, the counter ion is not important and may be an ammonium or alkali metal ion.

As preferred ligands, there may be mentioned are halide ligands, cyanide ligands, cyanate ligands, nitrosyl ligands, thionitrosyl ligands, etc. The following are specific, non-limiting examples of complexes which may be used in the present invention:

| | | |
|---|---|---|
| $[ReCl_6]^{-3}$, | $[ReBr_6]^{-3}$, | $[ReCl_5(NO)]^{-2}$, |
| $[Re(NS)Br_5]^{-2}$, | $[Re(NO)(CN)_5]^{-2}$, | $[Re(O)_2(CN)_4]^{-3}$, |
| $[RuCl_6]^{-3}$, | $[RuCl_4(H_2O)_2]^{-1}$, | $[RuCl_5(NO)]^{-2}$, |
| $[RuBr_5(NS)]^{-2}$, | $[Ru(CN)_6]^{-4}$, | $[Ru(CO)_3Cl_3]^{-2}$, |
| $[Ru(CO)Cl_5]^{-2}$, | $[Re(CO)Br_5]^{-2}$, | $[OsCl_6]^{-3}$, |
| $[OsCl_5(NO)]^{-2}$, | $[Os(NO)(CN)_5]^{-2}$, | $[Os(NS)Br_5]^{-2}$, |
| $[Os(CN)_6]^{-4}$, | $[OS(O)_2(CN)_4]^{-3}$. | |

The addition of these compounds may be conducted at any stage during the formation of the silver halide grains or before the coating of the emulsion. It is especially preferred to add these compounds during the formation of the grains whereby they are incorporated into the grains.

For adding the compounds during the formation of the silver halide grains, so as to incorporate them into the grains being formed, a powder of the metal complex or an aqueous solution of the complex as dissolved in water along with NaCl or KCl is added to the solution of a water-soluble silver salt, or to the solutions of water-soluble halides prior to the reaction of the solutions for forming the silver halide grains; or the former is added as a third component when the silver salt solution and the halide solutions are mixed together by a triple jet method; or an aqueous solution of the necessary amount of the metal complex is added to the reactor in which the silver halide grains are being formed. In particular, it is especially preferred to add a powder of the complex or an aqueous solution thereof, dissolved in water, along with NaCl or KCl, to the solutions of water-soluble halides to be reacted to form the silver halide grains.

For adding the compounds to the surfaces of the silver halide grains, the necessary amount of an aqueous solution of the metal complex may be added to the reactor immediately after the formation of the grains therein, or during or after their physical ripening, or during their chemical ripening.

The silver halide grains of the present invention may be doped with any other heavy metal salts. In particular, doping them with an Fe salt, such as, $[Fe(CN)_6]$ is advantageous.

The present invention may also use, along with the above-mentioned metals, other metals belonging to Group VIII of the Periodic Table, such as, cobalt, nickel, palladium, platinum, etc.

The silver halide emulsion of the present invention is preferably chemical-sensitized. For the chemical sensitization of the emulsion, there may be employed known sulfur sensitization methods, selenium sensitization methods, tellurium sensitization methods, and noble metal sensitization methods. The methods may be employed singly or in combination. In the latter case, for instance, it is preferred to use a combination of sulfur sensitization and gold sensitization methods, a combination of sulfur sensitization, selenium sensitization and gold sensitization methods, and a combination of sulfur sensitization, tellurium sensitization and gold sensitization methods.

The sulfur sensitization of the emulsion of the present invention may be conducted, in general, by adding a sulfur sensitizing agent to the emulsion, followed by stirring the emulsion at a high temperature of 40° C. or higher for a determined period of time. As the sulfur sensitizing agent, any known sulfur compound may be used. For instance, sulfur compounds to be contained in gelatin, as well as other various sulfur compounds such as thiosulfates, thioureas, thiazoles, rhodanines, etc. may be used. Of these, the preferred compounds are thiosulfates and thioureas. The amount of the sulfur sensitizing agent to be added varies, depending upon various conditions, such as, for example, the pH and temperature conditions for the chemical ripening and the size of the silver halide grains being ripened. In general, however, it is from $10^{-7}$ to $10^{-2}$ mol, and more preferably from $10^{-5}$ to $10^{-3}$ mol, per mol of silver halide.

The selenium sensitizing agent for use in the present invention may be any known selenium compound. In general, for instance, for conducting the selenium sensitization, unstabilized and/or non-unstabilized selenium compounds are added to the emulsion, which is then stirred at a high temperature of 40° C. or higher for a determined period of time. As the unstabilized selenium compounds, for example, those described in JP-B-44-15748 JP-B-43-13489, JP-B-4-109240, and JP-B-4-324855 and in Japanese Patent Application No. 2-13097 can be used. In particular, the compounds of general formulae (VIII) and (IX) described in JP-A-4-324855 are preferred.

The tellurium sensitizing agent for use in the present invention is a compound capable of forming a silver telluride, which is presumed to provide sensitizing nuclei on the surfaces of the silver halide grains or inside of them. The speed of forming the silver telluride in the silver halide emulsion being sensitized may be tested by the method described in Japanese Patent Application No. 4-146739.

As examples of the tellurium sensitizing agent for use in the present invention, there may be mentioned compounds as described in U.S. Pat. Nos. 1,623,499, 3,320,069, 3,772,031; British Patents. 235,211, 1,121,496, 1,295,462, 1,396,696; Canadian Patent 800,958; JP-A-4-204640, JP-A-4-271341 and JP-A-4-333043; Japanese Patent Application No. 4-129787; *J. Chem. Soc. Chem. Commun.*, 635 (1980); ibid., 1102 (1978); ibid., 645 (1979); *J. Chem. Soc. Perkin, Trans.*, 1, 2191 (1980); S patai, *The Chemistry of Organic Selenium and Tellurium Compounds*, Vol. 11 (1986); ibid., Vol. 2 (1987), etc. In particular, the compounds of general formula (II), (III) and (IV) described in Japanese Patent Application No. 4-146739 are preferred.

The amounts of the selenium and tellurium sensitizing agents to be used in the present invention vary, depending upon the silver halide grains to be sensitized therewith and the chemical ripening conditions. In general, the amounts used are approximately from $10^{-8}$ to $10^{-2}$ mol, and preferably, approximately from $10^{-7}$ to $10^{-3}$ mol, per mol of silver halide. The conditions for the chemical sensitization of the silver halide grains of the present invention are not specifically defined. Preferably, the pH is from 5 to 8; the pAg is from 6 to 11, preferably from 7 to 10; and the temperature is from 40° to 95° C., preferably from 45° to 85° C.

As the noble metal sensitizing agent for use in the present invention, there may be mentioned, for example, gold, platinum, palladium, iridium and like compounds. Especially preferred is gold sensitization. As examples of the gold sensitizing agent to be used, there may be mentioned chloroauric acid, potassium aurate, potassium aureothiocyanate, gold sulfide, etc. The agent may be added in an amount of approximately from $10^{-7}$ to $10^{-2}$ mol per mol of silver halide.

The silver halide emulsion of the present invention may be formed in the presence of a cadmium salt, a sulfite, a lead salt, a thallium salt or the like during the formation of the silver halide grains or during the physical ripening of them.

Reduction sensitization may be employed in the present invention. As the usable reduction-sensitizing agent, there may be mentioned, for example, stannous salts, amines, formamidinesulfinic acids, silane compounds, etc.

The silver halide emulsion of the present invention may contain a thiosulfonic acid compound in accordance with the method described in EP-293,917.

The photographic material of the present invention may comprise one silver halide emulsion or two or more different silver halide emulsions having different mean grain sizes, different halogen compositions and/or different crystal habits, and/or having been chemically-sensitized by different conditions.

The sensitizing dyes to be used for sensitizing the silver halide emulsion of the present invention are preferably those of the following general formulas (1), (2) and (3):

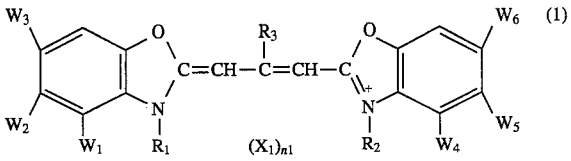

(1)

In formula (1), $W_1$ and $W_4$ each represents a hydrogen atom;

$W_3$ and $W_5$ each represents a hydrogen atom, a methyl group or a methoxy group;

$W_2$ represents an optionally branched alkyl group having 1 to 6 carbon atoms as a whole (e.g., methyl, ethyl, butyl, isobutyl, hexyl, methoxyethyl), an alkoxy group having 5 or less carbon atoms as a whole (e.g., methoxy, ethoxy, pentyloxy, ethoxymethoxy, hydroxyethoxy), a bromine atom, an iodine atom, or an aryl group having 6 to 9 carbon atoms as a whole (e.g., phenyl, tolyl, anisyl, chlorophenyl, carboxyphenyl), or $W_2$ may be bonded to $W_1$ or $W_3$ to form a benzene ring, and $W_2$ may also be a chlorine atom when $W_3$ is a methyl group or a methoxy group; and $W_5$ represents an optionally branched alkyl group having 1 to 6 carbon atoms (e.g., methyl, ethyl, butyl, isobutyl, hexyl, methoxyethyl), an alkoxy group having 1 to 5 carbon atoms (e.g., methoxy, ethoxy, pentyloxy, ethoxymethoxy, hydroxyethoxy), a hydroxyl group, a halogen atom, an aryl group having 6 to 9 carbon atoms as a whole (e.g., phenyl, tolyl, anisyl, chlorophenyl, carboxyphenyl), an aryloxy group having 6 to 9 carbon atoms as a whole (e.g., tolyloxy, anisyloxy, phenoxy, chlorophenoxy), an arylthio group having 6 to 8 carbon atoms as a whole (e.g., tolylthio, chlorophenylthio, phenylthio), an alkylthio group having 1 to 4 carbon atoms as a whole (e.g., methylthio, ethylthio, hydroxyethylthio), an acylamino group having 1 to 4 carbon atoms (e.g., acetylamino, propionylamino, methanesulfonylamino), or $W_5$ may be bonded to $W_4$ or $W_6$ to form a benzene ring.

In formula (1), $R_1$ and $R_2$ may be the same or different and each represents an optionally substituted alkyl or alkenyl group having 1 to 10 carbon atoms, and at least one of $R_1$ and $R_2$ is a group having a sulfo group or a carboxyl group. As preferred examples of the substituents for the alkyl and alkenyl groups, mentioned are a sulfo group, a carboxyl group, a halogen atom, a hydroxyl group, an alkoxy group having 1 to 6 carbon atoms, an optionally substituted aryl group having 6 to 8 carbon atoms (e.g., phenyl, tolyl, sulfophenyl, carboxyphenyl), a heterocyclic group (e.g., furyl, thienyl), an optionally substituted aryloxy group having 6 to 8 carbon atoms (e.g., chlorophenoxy, phenoxy, sulfophenoxy, hydroxyphenoxy), an acyl group having 1 to 8 carbon atoms (e.g., benzenesulfonyl, methanesulfonyl, acetyl, propionyl), an alkoxycarbonyl group having 1 to 6 carbon atoms (e.g., ethoxycarbonyl, butoxycarbonyl), a cyano group, an alkylthio group having 1 to 6 carbon atoms (e.g., methylthio, ethylthio), an optionally substituted arylthio group having 6 to 8 carbon atoms (e.g., phenylthio, tolylthio), an optionally substituted carbamoyl group having 1 to 8 carbon atoms (e.g., carbamoyl, N-ethylcarbamoyl), and an acylamino group having 1 to 8 carbon atoms (e.g., acetylamino, methanesulfonylamino). The alkyl or alkenyl group of $R_1$ and $R_2$ may be substituted by one or more substituents.

As specific examples of the groups $R_1$ and $R_2$, there may be mentioned a methyl group, an ethyl group, a propyl group, an allyl group, a pentyl group, a hexyl group, a methoxyethyl group, an ethoxyethyl group, a phenethyl group, a tolylethyl group, a sulfophenethyl group, a 2,2,2-trifluoroethyl group, a 2,2,3,3-tetrafluoropropyl group, a carbamoylethyl group, a hydroxyethyl group, a 2-(2-hydroxyethoxy)ethyl group, a carboxymethyl group, a carboxyethyl group, an ethoxycarbonylmethyl group, a sulfoethyl group, a 2-chloro-3-sulfopropyl group, a 3-sulfopropyl group, a 2-hydroxy-3-sulfopropyl group, a 3-sulfobutyl group, a 4-sulfobutyl group, a 2-(2,3-dihydroxypropyloxy-)ethyl group and a 2-[2-(3-sulfopropyloxy)ethoxy]ethyl group.

In formula (1), $R_3$ represents an optionally substituted lower alkyl group (e.g., methyl, ethyl, propyl, methoxyethyl, benzyl, phenethyl); $X_1$ represents a counter ion necessary for neutralizing the charge of the molecule; $n_1$ represents 0 or 1, and it is 0 when the molecule is an internal salt.

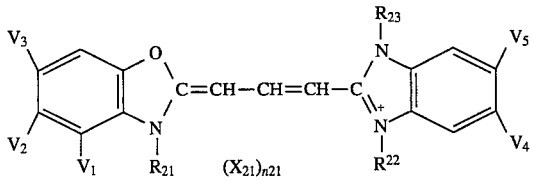

(2)

In formula (2), $V_1$ represents a hydrogen atom; $V_2$ represents a hydrogen atom, an optionally branched lower alkyl group (preferably having 1 to 6 carbon atoms as a whole, such as methyl, ethyl, butyl, isobutyl, hexyl, methoxyethyl), a lower alkoxy group (preferably having 1 to 5 carbon atoms as a whole, such as methoxy, ethoxy, pentyloxy, ethoxymethoxy, hydroxyethoxy), a hydroxyl group, a halogen atom, an-aryl group having 6 to 9 carbon atoms as a whole (e.g., phenyl, tolyl, anisyl, chlorophenyl, carboxyphenyl), an aryloxy group having 6 to 9 carbon atoms as a whole (e.g., tolyloxy, anisyloxy, phenoxy, chlorophenoxy), an aryl group having 6 to 8 carbon atoms as a whole (e.g., tolylthio, chlorophenylthio, phenylthio), an alkylthio group having 1 to 4 carbon atoms as a whole (e.g., methylthio, ethylthio, hydroxyethylthio), or an acylamino group having 1 to 4 carbon atoms as a whole (e.g., acetylamino, propionylamino, methanesulfonylamino), and $V_2$ may be bonded to $V_1$ or $V_3$ to form a benzene ring; and $V_3$ represents a hydrogen atom, a methyl group or a methoxy group.

In formula (2), $V_4$ represents an electron-withdrawing group. As preferred examples of the electron-withdrawing group, there may be mentioned a halogen atom, a lower perfluoroalkyl group (preferably having 1 to 5 carbon atoms as a whole, such as trifluoromethyl, 2,2,2-trifluoroethyl, 2,2,3,3-tetrafluoropropyl), an acyl group (preferably having 1 to 8 carbon atoms as a whole, such as acetyl, propionyl, benzoyl, mesityl, benzenesulfonyl), an alkylsulfamoyl group (preferably having 1 to 5 carbon atoms as a whole, such as methylsulfamoyl, ethylsulfamoyl), a carboxyl group, an alkylcarbonyl group (preferably having 1 to 5 carbon atoms as a whole, such as methoxycarbonyl, ethoxycarbonyl, butoxycarbonyl), and a cyano group. $V_5$ represents a hydrogen atom or a chlorine atom.

In formula (2), $R_{21}$, $R_{22}$ and $R_{23}$ may be the same or different and may have the same meanings as $R_1$ and $R_2$ in formula (1), and at least one of $R_{21}$, $R_{22}$ and $R_{23}$ is a group having a sulfo group or a carboxyl group.

$X_{21}$ represents a counter ion necessary for neutralizing the charge of the molecule; $n_{21}$ represents 0 or 1, and it is 0 when the molecule is an internal salt.

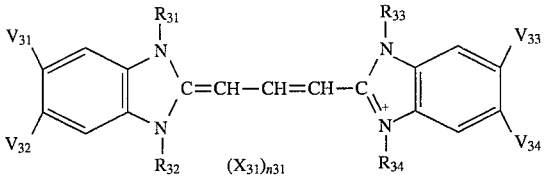

(3)

In formula (3), $V_{31}$ and $V_{33}$ each represents hydrogen atom or an electron-withdrawing group; and $V_{32}$ and $V_{34}$ each represents an electron-withdrawing group. As preferred examples of the electron-withdrawing group, there may be mentioned a halogen atom, a lower perfluoroalkyl group (preferably having 1 to 5 carbon atoms as a whole, such as trifluoromethyl, 2,2,2-trifluoroethyl, 2,2,3,3-tetrafluoropropyl), an acyl group (preferably having 1 to 8 carbon atoms as a whole, such as acetyl, propionyl, benzoyl), a sulfamoyl group, an alkylsulfamoyl group (preferably having 1 to 5 carbon atoms as a whole, such as methylsulfamoyl, ethylsulfamoyl), a carboxyl group, an alkylcarbonyl group (preferably having 1 to 5 carbon atoms as a whole, such as methoxycarbonyl, ethoxycarbonyl, butoxycarbonyl), an alkylsulfonyl group (preferably having 5 or less carbon atoms as a whole, such as methylsulfonyl, ethylsulfonyl, propylsulfonyl, butylsulfonyl) , an arylsulfonyl group (preferably an optionally substituted benzenesulfonyl group, such as benzenesulfonyl , chlorobenzenesulfonyl, methylbenzenesulfonyl), and a cyano group.

In formula (3), $R_{31}$, $R_{32}$, $R_{33}$ and $R_{34}$ may be the same or different and each represents an optionally substituted alkyl or alkenyl group having 1 to 20 carbon atoms as a whole. At least one of these $R_{31}$, $R_{32}$, $R_{33}$ and $R_{34}$ is preferably a substituted alkyl group. Examples of the substituents for the alkyl group are a carboxyl group, a sulfo group, a cyano group, a halogen atom (e.g., fluorine, chlorine, bromine), a hydroxyl group, an alkoxy group having 1 to 5 carbon atoms (e.g., 2-methoxyethyl, 2-ethoxyethyl, 3-methoxypropyl, 3-ethoxypropyl), an alkoxycarbonyl group having 1 to 8 carbon atoms (e.g., methoxycarbonyl, ethoxycarbonyl, phenoxycarbonyl, benzyloxycarbonyl), a monocyclic aryloxy group having 6 to 10 carbon atoms (e.g., phenoxy, p-tolyloxy), an acyloxy group having 1 to 3 carbon atoms (e.g., acetyl, propionyl, benzoyl, mesyl), a carbamoyl group (e.g., carbamoyl, N,N-dimethylcarbamoyl, morpholinocarbonyl, piperidinocarbonyl), a sulfamoyl group (e.g., sulfamoyl, N,N-dimethylsulfamoyl, morpholinosulfonyl, piperidinosulfonyl), an aryl group having 6 to 10 carbon atoms (e.g., phenyl, 4-chlorophenyl, 4-methylphenyl, α-naphthyl), and an alkyl group substituted by $—CONHSO_2—R_5$ or $—SO_2NHCO—R_6$ and having 1 to 18 carbon atoms. $R_5$ and $R_6$ each represents an optionally substituted alkyl group having 1 to 20 carbon atoms, and is, preferably, an alkyl group having 1 to 8, more preferably 1 to 4, carbon atoms.

In formula (3), $X_1$ represents a counter ion necessary for neutralizing the charge of the molecule; $n_1$ represents 0 or 1, and it is 0 when the molecule is an internal salt.

Specific, non-limiting, examples of compounds of formulae (1) to (3) are mentioned below, as follows:

Examples of Sensitizing Dyes of Formula (1):

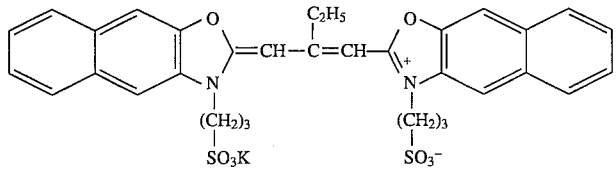

(1-A)

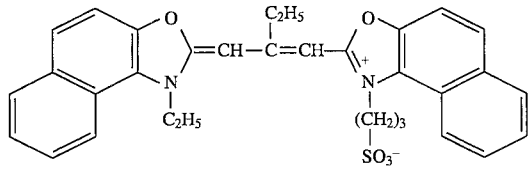

(1-B)

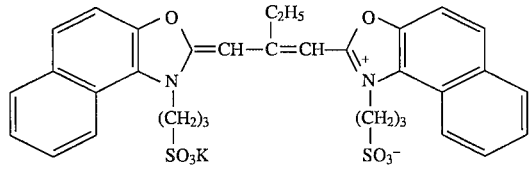

(1-C)

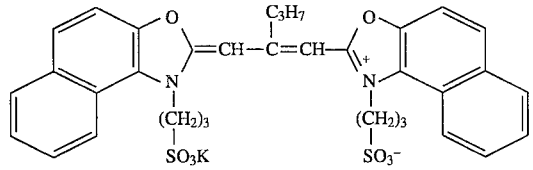

(1-D)

-continued
(1-E)
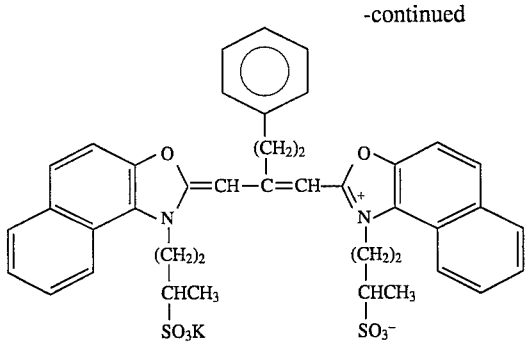
(1-F)
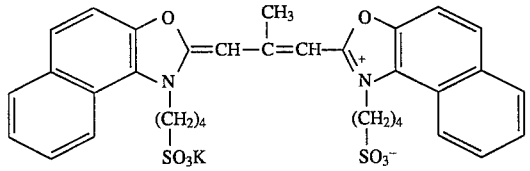
(1-G)
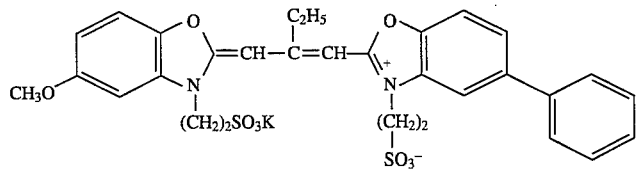
(1-H)
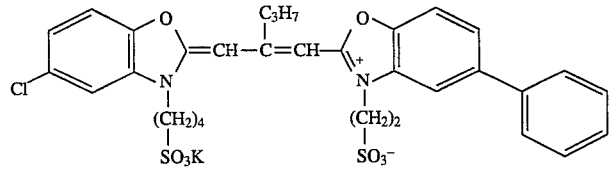
(1-H)
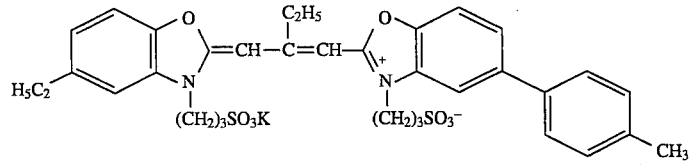
(1-J)
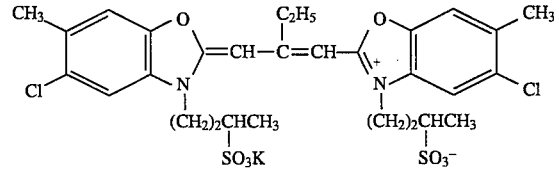
(1-K)
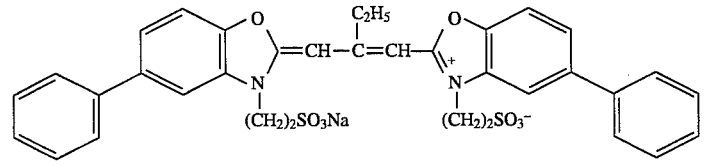
(1-L)
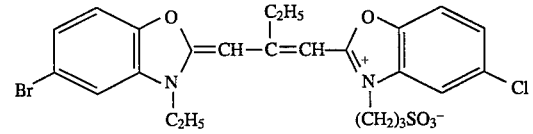

-continued
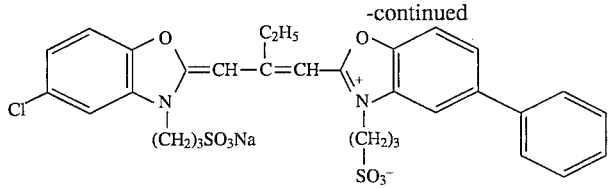
(1-M)
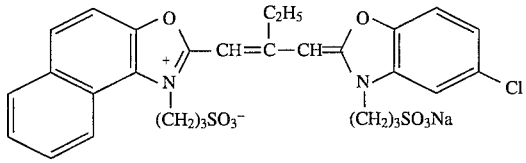
(1-N)
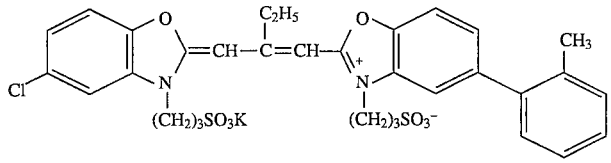
(1-O)
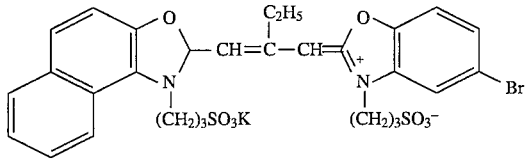
(1-P)
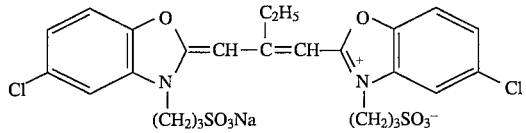
(1-Q)
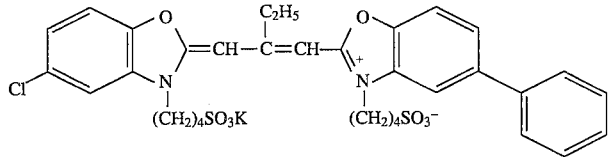
(1-R)
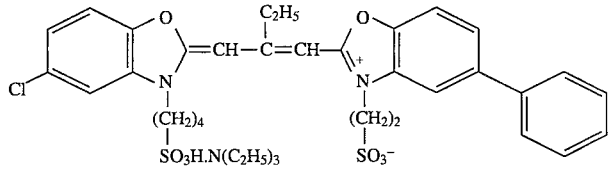
(1-S)
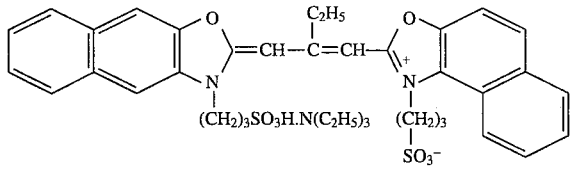
(1-T)
Examples of Sensitizing Dyes of Formula (2):
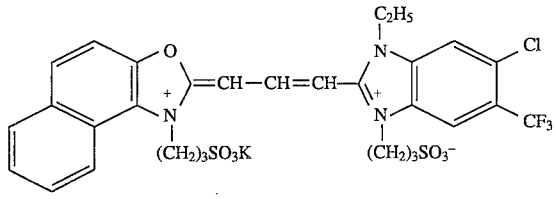
(2-A)

-continued
(2-B)
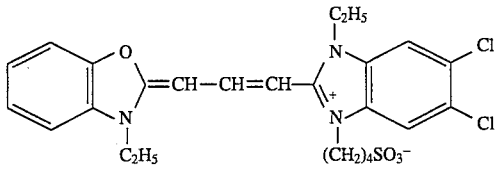
(2-C)
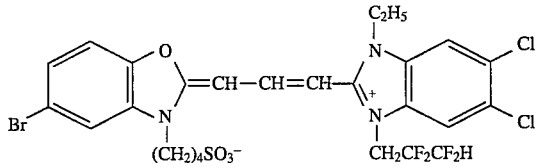
(2-O)
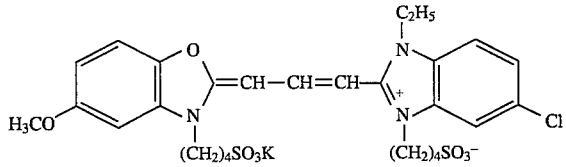
(2-E)
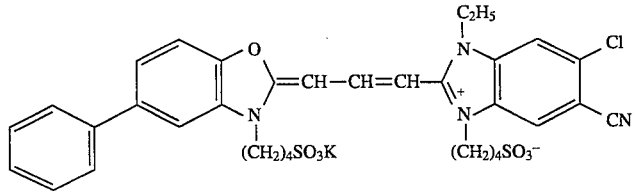
(2-F)
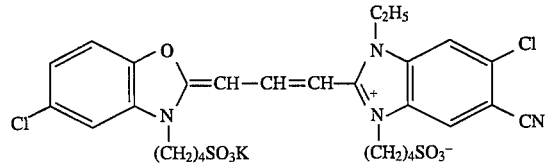
(2-G)
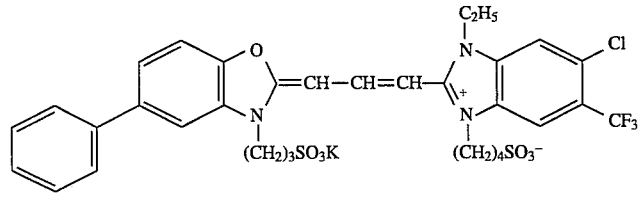
(2-H)
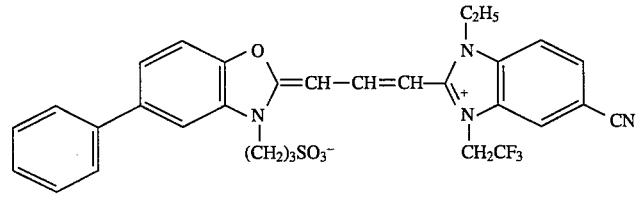
(2-I)
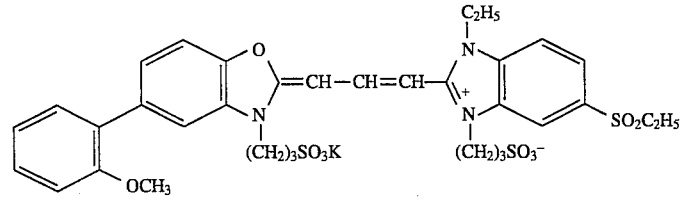

-continued
(2-J)
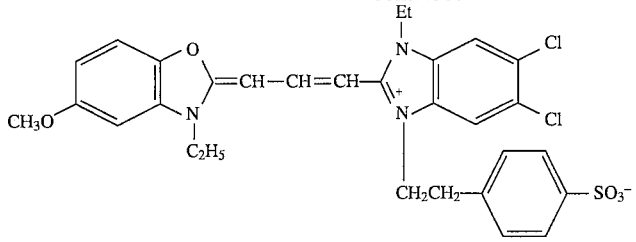
(2-K)
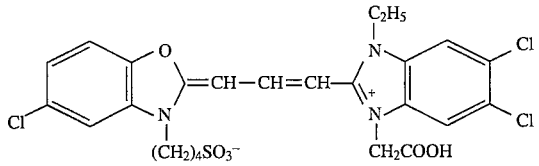
(2-L)
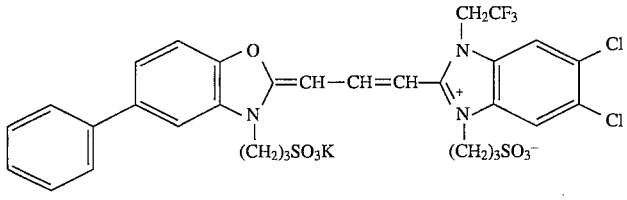
(2-M)
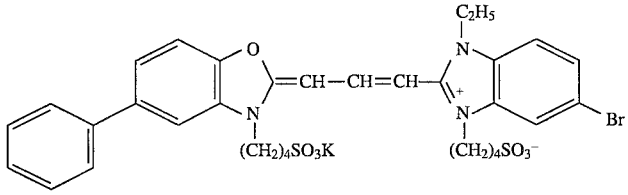
(2-N)
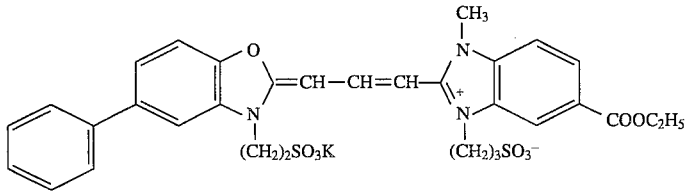
(2-O)
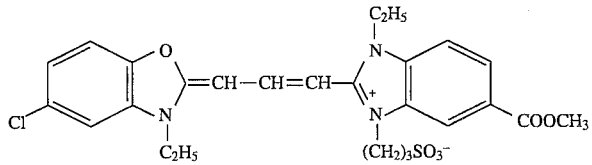
(2-P)
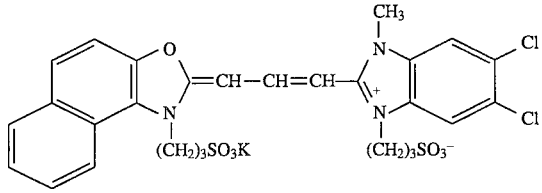
Examples of Sensitizing Dyes of Formula (3):

(3-1)
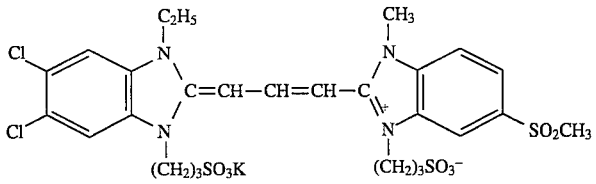
(3-2)
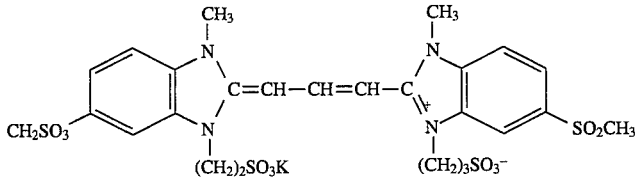
(3-3)
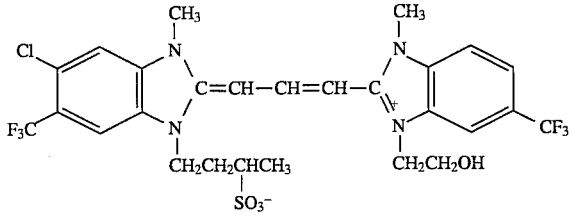
(3-4)
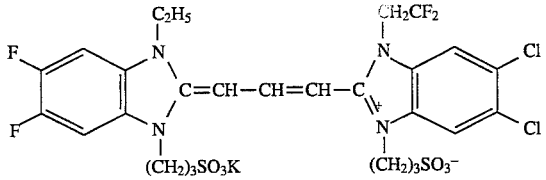
(3-5)
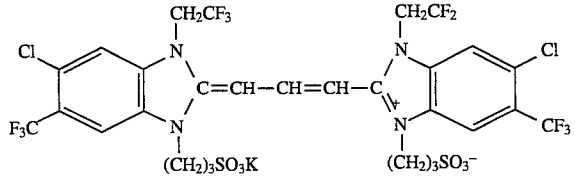
(3-6)
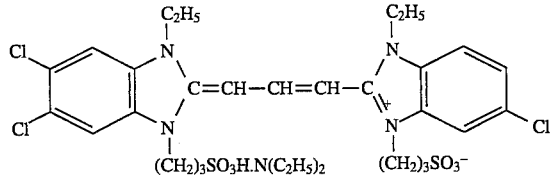
(3-7)
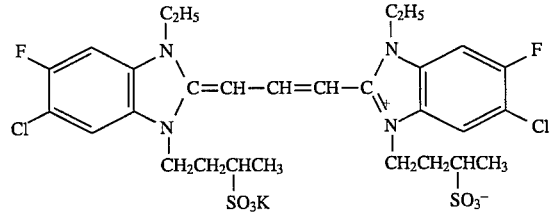
(3-8)
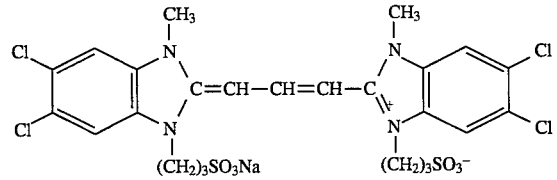

-continued
(3-9)
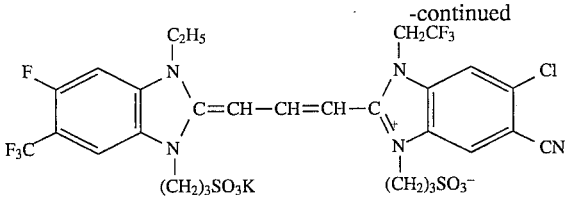
(3-10)
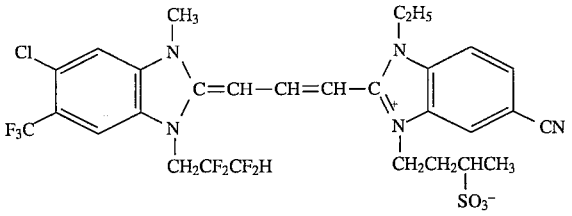
(3-11)
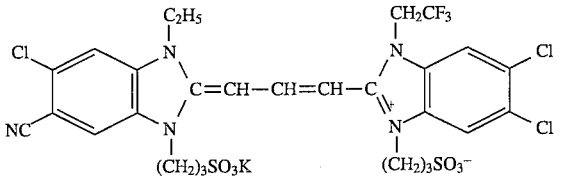
(3-12)
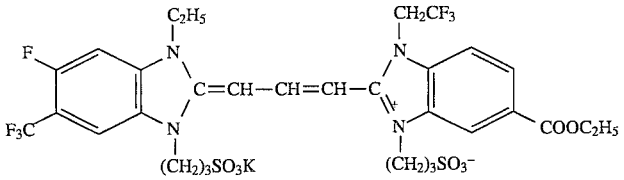
(3-13)
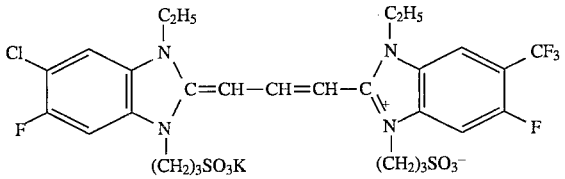
(3-14)
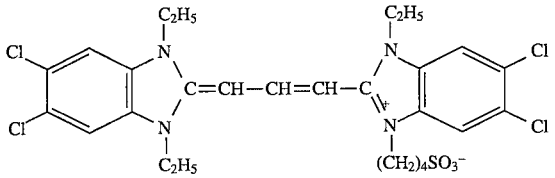
(3-15)
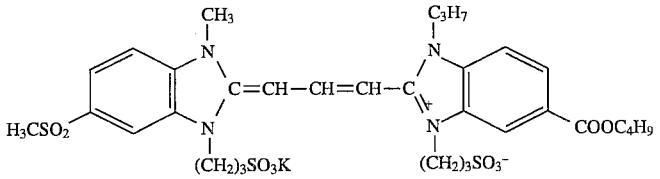
(3-16)
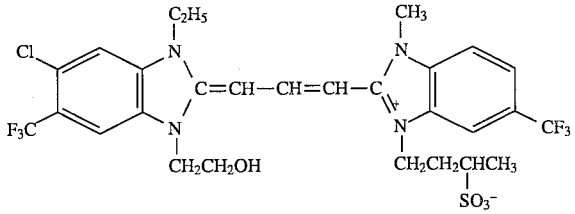

-continued
(3-17)
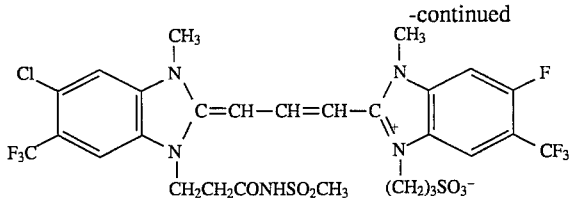
(3-18)
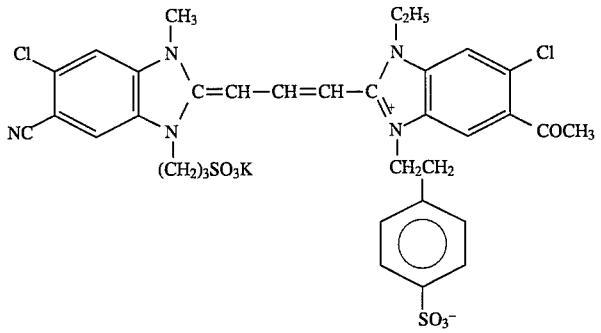
(3-19)
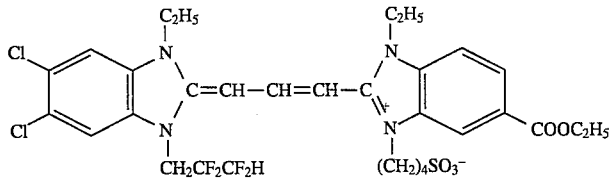
(3-20)
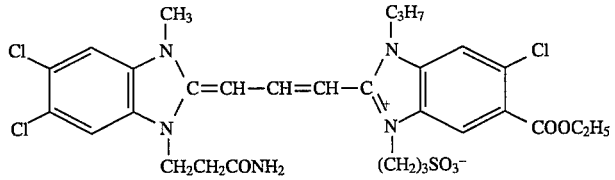
(3-21)
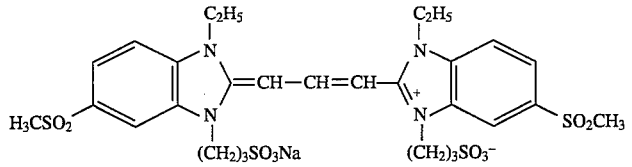
(3-22)
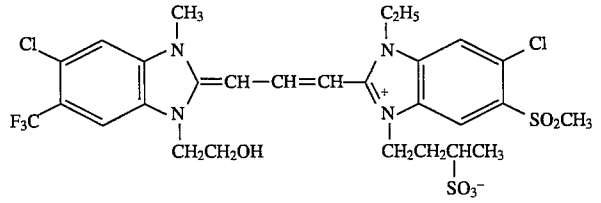
(3-23)
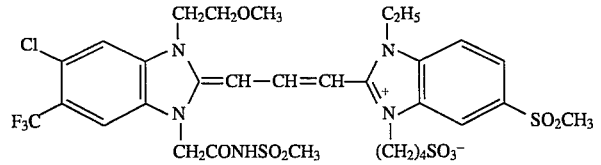
(3-24)
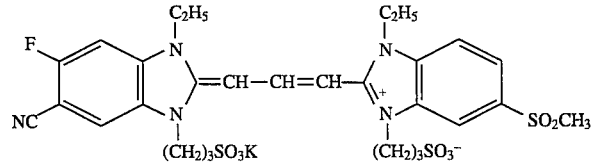

-continued
(3-25)
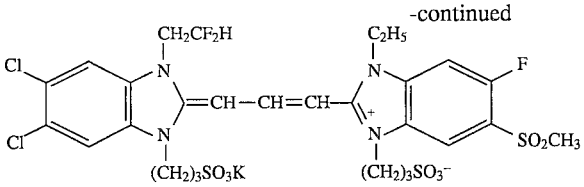
(3-26)
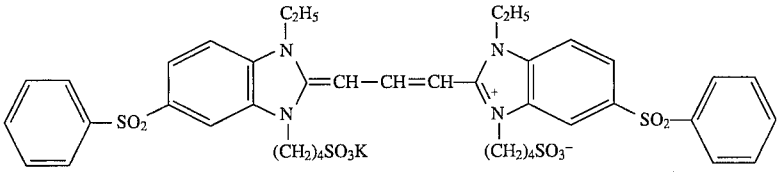
(3-27)
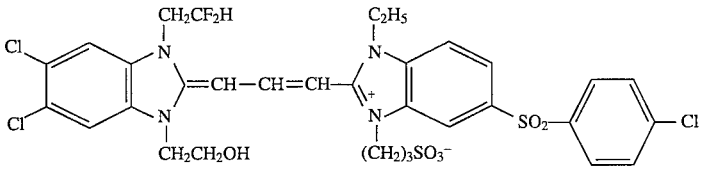
(3-28)
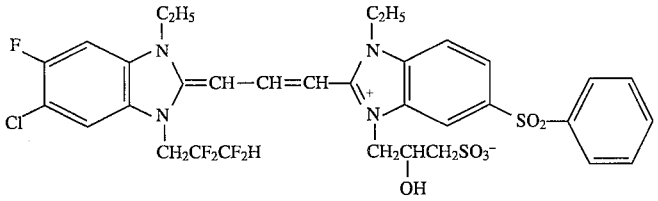
(3-29)
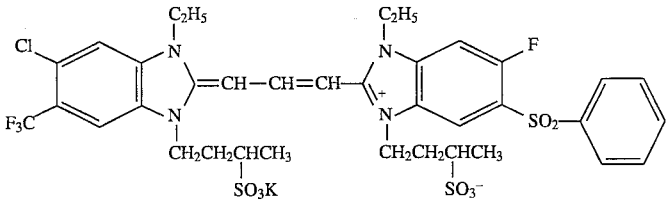
(3-30)
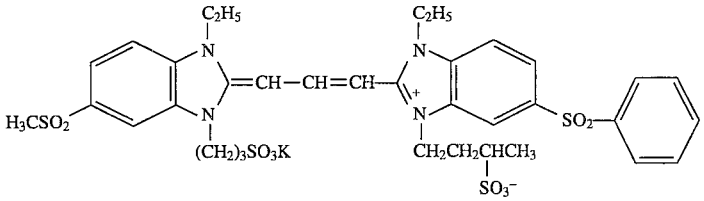
(3-31)
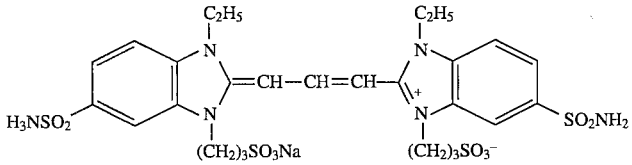
(3-32)
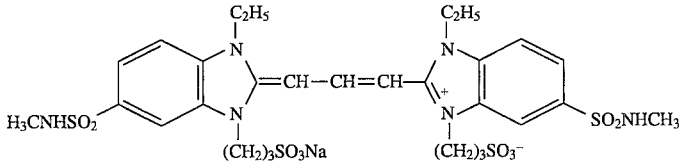
(3-33)
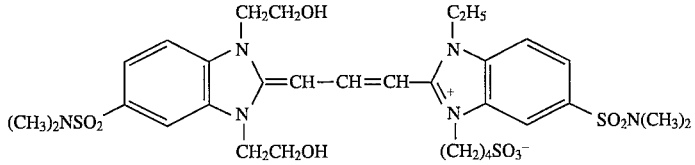

-continued
(3-34)
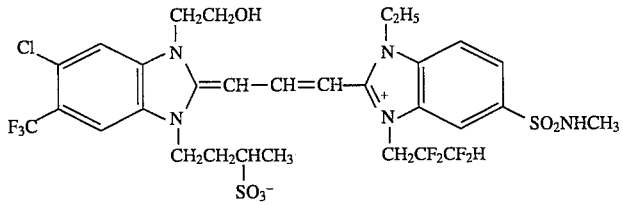
(3-35)
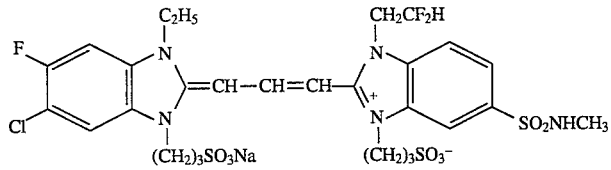
(3-36)
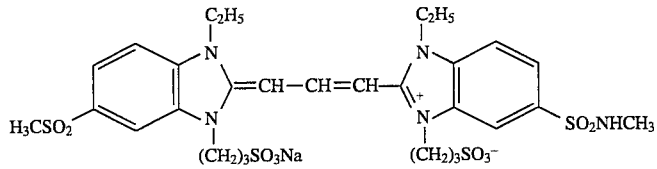
(3-37)
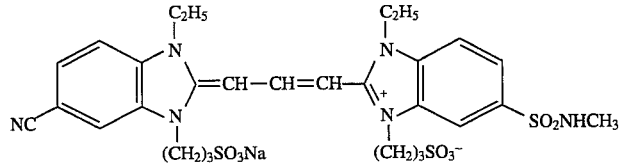
(3-38)
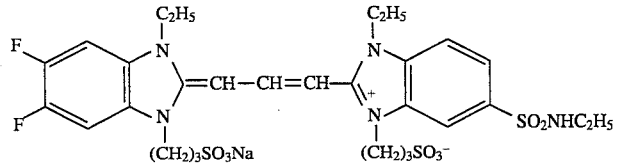
(3-39)
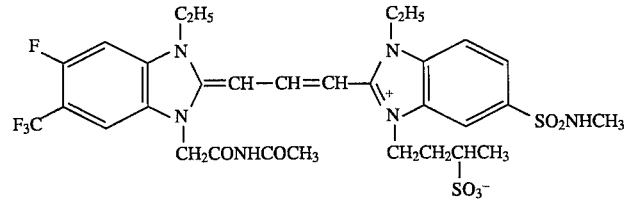
Following Tables show the exemplified compounds 3-41 to 3-81, in which $R_{31}$, $R_{32}$, $R_{33}$, $R_{34}$, $V_{31}$, $V_{32}$, $V_{33}$ and $V_{34}$ are shown in Formula (3) as follows:
(3)
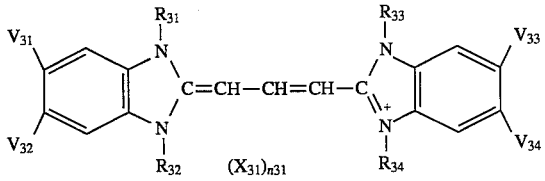
TABLE
| No. | $R_{31}$ | $R_{32}$ | $R_{33}$ | $R_{34}$ | $V_{31}$ | $V_{32}$ | $V_{33}$ | $V_{34}$ |
|---|---|---|---|---|---|---|---|---|
| 3-41 | $CH_2CONHSO_2CH_3$ | $CH_2CONHSO_2CH_3$ | $CH_3$ | $(CH_2)_3SO_3^-$ | Cl | Cl | Cl | Cl |
| 3-42 | $CH_2CONHSO_2CH_3$ | $(CH_2)_3SO_3^-$ | $CH_3$ | $CH_2CONHSO_2CH_3$ | Cl | Cl | Cl | Cl |

TABLE-continued

| No. | $R_{31}$ | $R_{32}$ | $R_{33}$ | $R_{34}$ | $V_{31}$ | $V_{32}$ | $V_{33}$ | $V_{34}$ |
|---|---|---|---|---|---|---|---|---|
| 3-43 | $C_2H_4SO_2NHCOCH_3$ | $CH_2CONHSO_2CH_3$ | $CH_3$ | $(CH_2)_4SO_3^-$ | Cl | Cl | Cl | Cl |
| 3-44 | $C_2H_4SO_2NHCOC_2H_5$ | $(CH_2)_4SO_3^-$ | $C_2H_5$ | $CH_2SO_2NHCOC_2H_5$ | Cl | Cl | Cl | Cl |
| 3-45 | $CH_2CONHSO_2CH_3$ | $CH_2CONHSO_2CH_3$ | $C_2H_5$ | $(CH_2)_2SO_3^-$ | Cl | $CF_3$ | Cl | $CF_3$ |
| 3-46 | $CH_2CONHSO_2C_2H_5$ | $(CH_2)_3SO_3^-$ | $C_2H_5$ | $CH_2CONHSO_2CH_3$ | Cl | $CF_3$ | Cl | $CF_3$ |
| 3-47 | $CH_2SO_2NHCOCH_3$ | $CH_2CONHSO_2CH_3$ | $CH_3$ | $(CH_2)_4SO_3^-$ | Cl | $CF_3$ | Cl | $CF_3$ |
| 3-48 | $CH_2SO_2NHCOCH_3$ | $CH_2SO_2NHCOCH_3$ | $C_2H_5$ | $(CH_2)_2SO_3^-$ | Cl | $CF_3$ | Cl | $CF_3$ |
| 3-49 | $CH_2SO_2NHCOCH_3$ | $(CH_2)_2CH(CH_3)SO_3^-$ | $C_3H_7$ | $C_2H_4SO_2NHCOCH_3$ | $OCH_3$ | $CF_3$ | $SCH_3$ | Cl |
| 3-50 | $CH_2CONHSO_2CH_3$ | $CH_2CONHSO_2CH_3$ | $CH_3$ | $(CH_2)_2SO_3^-$ | H | $CF_3$ | Cl | Cl |
| 3-51 | $CH_2CONHSO_2CH_3$ | $(CH_2)_4SO_3^-$ | $C_2H_5$ | $CH_2CONHSO_2CH_3$ | H | Cl | Cl | $CF_3$ |
| 3-52 | $C_2H_4SO_2NHCOC_2H_5$ | $(CH_2)_2CH(CH_3)SO_3^-$ | $C_3H_7$ | $C_2H_4CONHSO_2CH_3$ | Cl | $CF_3$ | H | $CF_3$ |
| 3-53 | $C_2H_4SO_2NHCOC_2H_5$ | $CH_2SO_2NHCOC_2H_5$ | $C_2H_5$ | $(CH_2)_4SO_3^-$ | H | CN | Cl | $CF_3$ |
| 3-54 | $CH_3$ | $(CH_2)_2CH(CH_3)SO_3^-$ | $C_2H_5$ | $CH_2CH_2OH$ | H | $CF_3$ | Cl | $CF_3$ |
| 3-55 | $CH_3$ | $(CH_2)_4SO_3K$ | $C_2H_5$ | $(CH_2)_4SO_3^-$ | H | $CF_3$ | Cl | $CF_3$ |
| 3-56 | $CH_2CH_2OH$ | $CH_2CH_2OH$ | $CH_3$ | $(CH_2)_4SO_3^-$ | Cl | $CF_3$ | H | $CF_3$ |
| 3-57 | $CH_2CH_2CN$ | $(CH_2)_4SO_3^-$ | $C_2H_5$ | $(CH_2)_4SO_3Na$ | Cl | $CF_3$ | H | $CF_3$ |
| 3-58 | $(CH_2)_2O(CH_2)_2OH$ | $(CH_2)_3SO_3^-$ | $CH_3$ | $CH_2CH_2OH$ | Cl | $CF_3$ | H | $CF_3$ |
| 3-59 | $CH_2CH_2CN$ | $(CH_2)_2CH(CH_3)OH_3^-$ | $CH_2CH_2CN$ | $(CH_2)_2CH(CH_3)SO_3K$ | Cl | $CF_3$ | Cl | $CF_3$ |
| 3-60 | $CH_3$ | $CH_2CH_2NHSO_2CH_3$ | $CH_2CH_2CN$ | $(CH_2)_3SO_3^-$ | Cl | $CF_3$ | H | $CF_3$ |
| 3-61 | $CH_2COOCH_3$ | $(CH_2)_4SO_3^-$ | $CH_3$ | $(CH_2)_4SO_3K$ | Cl | $CF_3$ | H | $CF_3$ |
| 3-62 | $(CH_2)_3OCH_3$ | $(CH_2)_4SO_3^-$ | $(CH_2)_3OCH_3$ | $(CH_2)_4SO_3K$ | Cl | Cl | Cl | Cl |
| 3-63 | $(CH_2)_3OCH_3$ | $(CH_2)_4SO_3^-$ | $C_2H_5$ | $(CH_2)_4SO_3K$ | Cl | $CF_3$ | Cl | $CF_3$ |
| 3-64 | $(CH_2)_3OCH_3$ | $(CH_2)_4SO_3^-$ | $C_2H_5$ | $(CH_2)_4SO_3K$ | Cl | $CF_3$ | Cl | $CF_3$ |
| 3-65 | $(CH_2)_2OC_2H_5$ | $(CH_2)_4SO_3^-$ | $C_2H_5$ | $(CH_2)_4SO_3K$ | Cl | $CF_3$ | Cl | $CF_3$ |
| 3-66 | $(CH_2)_2OC_2H_5$ | $(CH_2)_4SO_3^-$ | $(CH_2)_2OC_2H_5$ | $(CH_2)_4SO_3K$ | Cl | $CF_3$ | Cl | $CF_3$ |
| 3-67 | $(CH_2)_2OCH_3$ | $(CH_2)_4SO_3^-$ | $(CH_2)_2OCH_3$ | $(CH_2)_4SO_3K$ | Cl | $CF_3$ | Cl | $CF_3$ |
| 3-68 | $(CH_2)_2O(CH_2)_2OH$ | $(CH_2)_3SO_3^-$ | $CH_3$ | $(CH_2)_4SO_3K$ | Cl | $CF_3$ | H | $CF_3$ |
| 3-69 | $(CH_2)_2O(CH_2)_2OH$ | $(CH_2)_3SO_3^-$ | $(CH_2)_2O(CH_2)_2OH$ | $(CH_2)_4SO_3K$ | Cl | $CF_3$ | H | $CF_3$ |
| 3-70 | $CH_2CF_3$ | $(CH_2)_3SO_3K$ | $CH_2CF_3$ | $(CH_2)_3SO_3^-$ | Cl | $CF_3$ | Cl | $CF_3$ |
| 3-71 | $CH_2CH_3$ | $(CH_2)_4SO_3K$ | $CH_2CH_3$ | $(CH_2)_4SO_3^-$ | Cl | $CF_3$ | Cl | $CF_3$ |
| 3-72 | $CH_3$ | $(CH_2)_3SO_3^-$ | $CH_3$ | $(CH_2)_3SO_3Na$ | Cl | Cl | Cl | Cl |
| 3-73 | $CH_2CH_3$ | $(CH_2)_4SO_3^-$ | $CH_2CH_3$ | $CH_2CH_3$ | Cl | Cl | Cl | Cl |
| 3-74 | $CH_2CONHSO_2CH_3$ | $(CH_2)_2SO_3^-$ | $C_2H_5$ | $C_2H_4CONHSO_2CH_3$ | $CH_3$ | CN | $CH_3$ | CN |
| 3-75 | $CH_2SO_2NHCOCH_3$ | $CH_2CONHSO_2CH_3$ | $CH_3$ | $(CH_2)_3SO_3^-$ | $SCH_3$ | CN | $SCH_3$ | CN |
| 3-76 | $C_2H_4CONHSO_2CH_3$ | $CH_2CONHSO_2CH_3$ | $C_2H_5$ | $(CH_2)_2CH(CH_3)SO_3^-$ | $OCH_3$ | CN | $SCH_3$ | CN |
| 3-77 | $CH_2SO_2NHCOCH_3$ | $(CH_2)_2CH(CH_3)SO_3^-$ | $C_3H_7$ | $C_2H_4SO_2NHCOCH_3$ | $OCH_3$ | $CF_3$ | $SCH_3$ | Cl |
| 3-78 | $CH_2CONHSO_2CH_3$ | $CH_2CONHSO_2CH_3$ | $CH_3$ | $(CH_2)_2SO_3^-$ | H | $CF_3$ | Cl | Cl |
| 3-79 | $CH_2CONHSO_2CH_3$ | $(CH_2)_4SO_3^-$ | $C_2H_5$ | $CH_2CONHSO_2CH_3$ | H | Cl | Cl | $CF_3$ |
| 3-80 | $C_2H_4SO_2NHCOC_2H_5$ | $(CH_2)_2CH(CH_3)SO_3^-$ | $C_3H_7$ | $C_2H_4CONHSO_2CH_3$ | Cl | $CF_3$ | H | $CF_3$ |
| 3-81 | $C_2H_4SO_2NHCOC_2H_5$ | $CH_2SO_2NHCOC_2H_5$ | $C_2H_5$ | $(CH_2)_4SO_3^-$ | H | CN | Cl | $CF_3$ |

The foregoing compounds may be produced by known methods, for example, by the methods described in F. M. Hamer, *Heterocyclic Compounds-Cyanine Dyes and Related Compounds* (published by John Wiley & Sons Co., New York, London, 1064); D. M. Stumer, *Heterocyclic Compounds —Special Topics in Heterocyclic Chemistry*, Chap. 18, Part 14, pp. 482–515 (published by John Wiley & Sons Co., New York, London, 1977); *Rodd's Chemistry of Carbon Compounds,* 2nd Ed., Vol. IV, Part B, Chap. 15, pp. 369–422 (published by Elsevier Science Publishing Co., Inc., New York, 1977); and ibid., 2nd Ed., Vol. IV, Part B, 1985, Chap. 15, pp. 267–296 (1985).

The color sensitizing dyes of formulae (1), (2) and (3) may be incorporated into the silver halide emulsions of the present invention by direct dispersion in the emulsion or, alternatively, it may be first dissolved in a single solvent or in a mixed solvent of water, methanol, ethanol, propanol, acetone, methyl cellosolve, 2,2,3,3-tetrafluoropropanol, 2,2,2-trifluoroethanol, 3-methoxy-1-propanol, 3-methoxy-1-butanol, 1-methoxy- 2-propanol, N,N-dimethylformamide, and the like, and the resulting solution may be added to the emulsion.

The incorporation may also be carried out by using the method of dissolving the dye in a volatile organic solvent, dispersing the resulting solution in water or a hydrophilic colloid, and adding the resulting dispersion to the emulsion, as described in U.S. Pat. No. 3,469,987; a method of dispersing the water-insoluble dye in a water-soluble solvent without dissolving it followed by adding the resulting dispersion to the emulsion, as described in JP-B-46-24185; a method of dissolving the dye in an acid, followed by adding the resulting solution to the emulsion, or forming the dye into an aqueous solution in the presence of an acid or base, followed by adding the solution to the emulsion, as described in JP-B-44-23389, JP-B-44-27555 and JP-B-57-22091; method for forming the dye into an aqueous solution or colloidal dispersion in the presence of a surfactant, followed by adding the resulting solution or dispersion to the emulsion, as described in U.S. Pat. Nos. 3,822,135 and 4,006,025; a method of directly dispersing the dye in a hydrophilic colloid, followed by adding the resulting dispersion to the emulsion, as described in JP-A-53-102733 and JP-A-58-105141; and a method of dissolving the dye along with a red-shifting compound, followed by adding the resulting solution to the emulsion, as described in JP-A-51-74624.

For dissolving the dye, ultrasonic waves may also be used.

The time when the sensitizing dye of the present invention is added to the silver halide emulsion of the present invention is not specifically defined. The dye may be added to the emulsion at any time during the preparation of the emulsion which has heretofore been admitted to be effective. For instance, the dye may be added to the emulsion during the stage of the formation of the silver halide grains and/or before or during the de-salting of them and/or after the de-salting and before the initiation of the chemical ripening of them, as described in, for example, U.S. Pat. Nos. 2,735,766, 3,628,960, 4,183,756 and 4,225,666, and JP-A-58-184142 and JP-A-60-196749; or just before or during the chemical ripening of the grains or after their chemical ripening and before the coating of the emulsion, as described, for example, in JP-A-58-113920. Anyhow, the dye should be added to the emulsion before the emulsion is coated. If desired, one and the same dye or a combination of multiple dyes having different structures may be divided into a plurality of parts and the parts may be separately added during the formation of the silver halide grains and during, or after, their chemical ripening, or before, during, and after chemical ripening. For separate addition, the kind(s) of the single or multiple dyes to be divided into a plurality of parts may be varied.

The sensitizing dyes to be used in the present invention are described in, for example, JP-B-48-38406, JP-B-43-3936, JP-B-48-28293, JP-B-48-25652, JP-B-4322884, JP-B-54-34609, JP-B-54-34610, JP-B-57-22368 and JP-B-57-10418 and JP-A-50-23220, and they may be produced on the basis of the disclosures of these patent specifications and also on the basis of the disclosures of French Patents 1,108,788 and 2,174,418. The dyes may be added to the emulsion of the present invention along with other blue-sensitive dyes and/or blue and red-sensitive dyes such as those described in JP-A-62-15439, JP-A-62-287250 and JP-A-53-71829 and U.S. Pat. No. 3,667,960, with no problem, for the purpose of broadening the sensitive wavelength range of the emulsion. If the silver halide photographic material of the present invention needs to have an elevated sensitivity only to a particular spectral wavelength range by adding the sensitizing dyes thereto, it is preferred that the dye, as added thereto, forms its-aggregate therein to satisfy the requirement. Of the sensitizing dyes of the above-mentioned formulae (1), (2) and (3), those of easily formed, so-called J-aggregates are especially preferred. The addition of water-soluble bromides or water-soluble additives (e.g., bispyridinium salt compounds, mercapto-containing heterocyclic sulfonated compounds, alkali metal salts), such as those described in JP-B-49-46932, JP-A-58-28738 and U.S. Pat. No. 3,776,738 to the photographic material along with the dyes is preferred, as they may reinforce the J-aggregates.

The amount of the color sensitizing dye of formulae (1), (2) and (3) to be added to the emulsion of the invention may vary, depending upon the shapes and sizes of the silver halide grains. In general, it may be from $4\times10^{-6}$ to $8\times10^{-3}$ mol per mol of silver halide. For instance, when the size of the silver halide grains in the emulsion is from 0.2 to 1.3 μm, the amount is preferably from $2\times10^{-7}$ to $3.5\times10^{-6}$ mol, and more preferably from $6.5\times10^{-7}$ to $2.0\times10^{-6}$ mol, per $m^2$ of the surfaces of the grains.

The hydrazine derivatives to be used in the present invention are preferably those of the following general formulae (4) to (6).

First, hydrazine derivatives of formula (4) will be explained as follows;

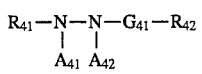

$$R_{41}-\underset{A_{41}}{N}-\underset{A_{42}}{N}-G_{41}-R_{42} \quad (4)$$

where $R_{41}$ represents an aliphatic group or an aromatic group, which has, as a part of the substituents, a partial structure of $-O-(CH_2CH_2O)_n-$, $-O-(CH_2CH(CH_3)O)_n-$ or $-O-(CH_2CH(OH)CH_2O)_n-$ (where n is an integer of 3 or more) or has, as a part of the substituents, a quaternary ammonium ion;

$G_{41}$ represents —CO—, —COCO—, —CS—, $-C(=NG_2R_2)-$, —SO—, $-SO_2-$ or $-P(O)(G_{42}R_{42})-$;

$G_{42}$ represents a chemical bond, —O—, —S— or $-N(R_{42})-$;

$R_2$ represents an aliphatic group, an aromatic group or a hydrogen atom, and plural $R_{42}$'s, if any, may be the same or different; and one of $A_{41}$ and $A_{42}$ is a hydrogen atom and the other is a hydrogen atom, an acyl group, or an alkyl or arylsulfonyl group.

Hydrazine derivatives of formula (4) will be explained in more detail as follows:

In formula (4), the aliphatic group of $R_{41}$ preferably has from 1 to 30 carbon atoms and is especially, preferably a linear, branched or cyclic alkyl group having from 1 to 20 carbon atoms. The alkyl group is substituted.

In formula (4), the aromatic group of $R_{41}$ is a monocyclic or bicyclic aryl or unsaturated heterocyclic group. The unsaturated heterocyclic group may be condensed with an aryl group to form a heteroaryl group.

For instance, the aromatic group may be derived from a benzene ring, a naphthalene ring, a pyridine ring, a quinoline ring or an isoquinoline ring. It is preferably derived from a benzene ring.

$R_{41}$ is especially, preferably an aryl group.

The aliphatic or aromatic group of $R_{41}$ is substituted. As typical substituents for the group, there may be mentioned, for example, an alkyl group, an aralkyl group, an alkenyl group, an alkynyl group, an alkoxy group, an aryl group, a substituted amino group, an ureido group, an urethane group, an aryloxy group, a sulfamoyl group, a carbamoyl group, an alkylthio group, an arylthio group, a sulfonyl group, a sulfinyl group, a hydroxyl group, a halogen atom, a cyano group, a sulfo group, an aryloxycarbonyl group, an acyl group, an alkoxycarbonyl group, an acyloxy group, a carbonamido group, a sulfonamido group, a carboxyl group, a phosphoric acid amide group, etc. Of them, preferred are a linear, branched or cyclic alkyl group (preferably having from 1 to 20 carbon atoms, an aralkyl group (preferably having from 7 to 30 carbon atoms), an alkoxy group (preferably having from 1 to 30 carbon atoms), a substituted amino group (preferably an amino group substituted by alkyl group(s) having from 1 to 30 carbon atoms), an acylamino group (preferably having from 2 to 40 carbon atoms), a sulfonamido group (preferably having from 1 to 40 carbon atoms), an ureido group (preferably having from 1 to 40 carbon atoms), and a phosphoric acid amide group (preferably having from 1 to 40 carbon atoms).

The aliphatic group and aromatic group of $R_{41}$ and the substituents of the groups may include $-O-(CH_2CH_2O)_n-$, $-O-(CH_2CH(CH_3)O)_n-$or $-O-(CH_2CH(OH)CH_2O)_n-$, or a quaternary ammonium ion; n is an integer of 3 or more, preferably an integer of from 3 to 15.

$R_1$ is preferably represented by the following general formulae (H1), (H2), (H3) or (H4):

Formula (H1)

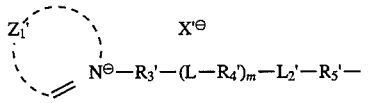

-continued

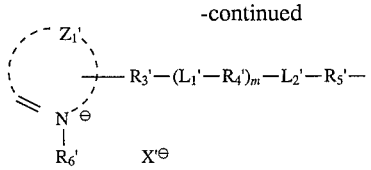

Formula (H2)

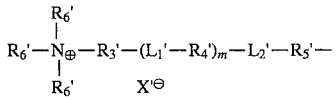

Formula (H3)

$R_6'-O-(L_3')_n-R_3'-(L_1'-R_4')_m-L_2'-R_5'-$ Formula (H4)

In these formulae, $L_1'$ and $L_2'$ may be the same or different and each represents —$CONR_7'$—, —$NR_7'CONR_8'$—, —$SO_2NR_7'$— or —$NR_7'SO_3NR_8'$. $R_7'$ and $R_8'$ each represent a hydrogen atom, an alkyl group having from 1 to 6 or an aryl group having from 6 to 10. They are preferably hydrogen atoms. m is 0 or 1.

$R_3'$, $R_4'$ and $R_5'$ each represents a divalent aliphatic or aromatic group, preferably an alkylene group or an arylene group or a divalent group to be formed by the group(s) and —O—, —CO—, —S—, —SO—, —$SO_2$— and/or —$NR_9'$— (where $R_9'$ has the same meaning as $R_7$ in formulae (2), (3) and (4)) .

More preferably, $R_3'$ is an alkylene group having from 1 to 10 carbon atoms or a divalent group to be formed by the group and —S—, —SO— and/or —$SO_2$—; and $R_4'$ and $R_5'$ each are an arylene group having from 6 to 20 carbon atoms. Especially preferably, $R_5$ is a phenylene group.

$R_3'$, $R_4'$ and $R_5'$ may be substituted. As preferred substituents for them, those mentioned for $R_1'$ are referred to.

In formulae (H1) and (H2), $Z_1'$ represents an atomic group necessary for forming a nitrogen-containing heterocyclic aromatic ring. As preferred examples of the nitrogen-containing heterocyclic aromatic group to be formed by $Z_1'$ and nitrogen atom(s), there may be mentioned a pyridine ring, a pyrimidine ring, a pyridazine ring, a pyrazine ring, an imidazole ring, a pyrazole ring, a pyrrole ring, an oxazole ring, a thiazole ring, benzo-condensed rings of them, and a puteridine ring, a naphthyridine ring, etc.

In formulae (H2), (H3) and (H4), X'—represents a counter anion or, when the molecule forms an internal salt, it represents a counter anion moiety.

In formulae (H2), (H3) and (H4), $R_6$ represents an aliphatic group or an aromatic group. Preferably, $R_6'$ is an alkyl group having from 1 to 20 carbon atoms, or an aryl group having from 6 to 20 carbon atoms.

Three $R_6$'s in formula (H3) may be the same or different or they may be bonded to each other to form a ring.

$Z_1'$ and $Z_6'$ may be substituted. As preferred substituents for $Z_1$ and $Z_6$, the substituents for $R_1$ may be used.

In formula (H4), $L_3'$ represents —$CH_2CH_2O$—, —$CH_2CH(CH_3)O$— or —$CH_2CH(OH)CH_2O$—, and n has the same meaning as that in formula (H1).

In formula (4), $G_{41}$ is preferably —CO— or —$SO_2$— and is most preferably —CO—.

$A_{41}$ and $A_{42}$ are preferably hydrogen atoms.

The alkyl group of $R_{42}$ in formula (4) is preferably an alkyl group having from 1 to 4 carbon atoms; and the aryl group thereof is preferably a monocyclic or bicyclic aryl group (for example, comprising benzene ring(s)).

Where $G_{41}$ is —CO—, $R_{42}$ is preferably a hydrogen atom, an alkyl group (e.g., methyl, methoxymethyl, phenoxymethyl, trifluoromethyl, 3-hydroxypropyl, 3-methanesulfonamidopropyl, phenylsulfonylmethyl), an aralkyl group (e.g., o-hydroxybenzyl), or an aryl group (e.g., phenyl, 3,5-dichlorophenyl, o-methanesulfonamidophenyl, 4-methanesulfonylphenyl, 2-hydroxymethylphenyl). Especially preferably, $R_{42}$ is a hydrogen atom.

$R_{42}$ may be substituted. As substituents for $R_{42}$, those mentioned for $R_{41}$ may be used.

$R_{42}$ may also be a group that cleaves the $G_{41}$—$R_{42}$ moiety from the remaining molecule to cause cyclization for forming a cyclic structure containing the atoms of the $G_{41}$—$R_{42}$ moiety. As examples of the group $R_{42}$, those described in JP-A-63-29751 may be used.

$R_{41}$ or $R_{42}$ in formula (4) may contain therein a ballast group or polymer which is generally found in ordinary passive photographic additives such as couplers. The ballast group has 8 or more carbon atoms and is relatively inactive to photographic properties. For instance, it may be selected from an alkyl group, an alkoxy group, a phenyl group, an alkylphenyl group, a phenoxy group and an alkylphenoxy group. As examples of the polymer, those described in JP-A-1-100530 are referred to.

$R_{41}$ or $R_{42}$ in formula (4) may contain therein a group of reinforcing the adsorption to the surfaces of silver halide grains. As examples of the adsorbing group, there may be mentioned thiourea groups, heterocyclic thioamido groups, mercapto-heterocyclic groups and triazole groups, such as those described in U.S. Pat. Nos. 4,385,108 and 4,459,347, JP-A-59-195233, JP-A-59-200231, JP-A-59-201045, JP-A-59-201046, JP-A-59-201047, JP-A-59-201048, JP-A-59-201049, JP-A-61-170733, JP-A-61-270744, JP-A-62-948, JP-A-63-234244, JP-A-63-234245 and JP-A-63-234246.

The compounds of formula (4) for use in the present invention may be produced by known methods, for example, by the methods described in JP-A-61-213847 and JP-A-62-260153, U.S. Pat. No. 4,684,604, Japanese Patent Application No. 63-803, U.S. Pat. Nos. 3,379,529, 3,620,746, 4,377,634 and 4,332,878, JP-A-49-129536, JP-A-56-153336 and JP-A-56-153342, and U.S. Pat. Nos. 4,988,604 and 4,994,365.

Specific examples of the compounds for use in the present invention are mentioned below, which, however, are not limitative.

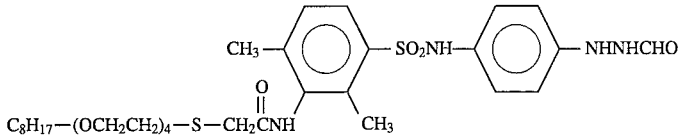

Compound 4-1

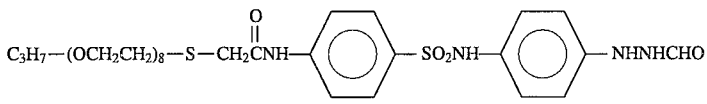

Compound 4-2

-continued
Compound 4-3
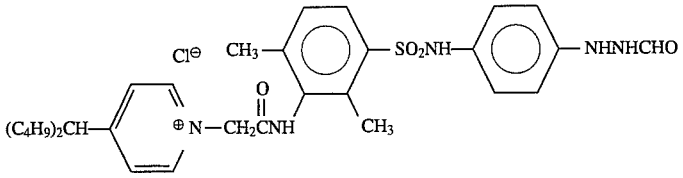
Compound 4-4
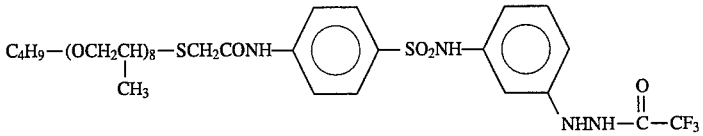
Compound 4-5
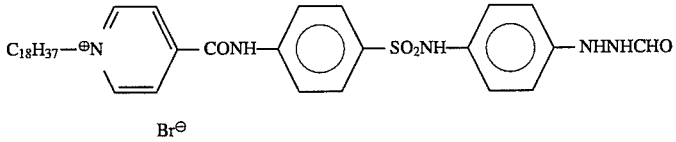
Compound 4-6
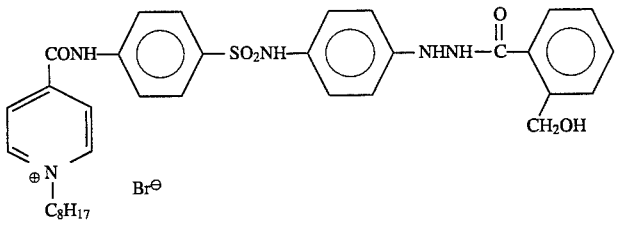
Compound 4-7
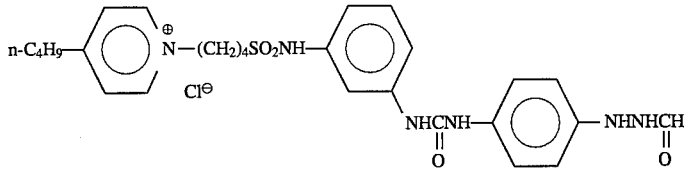
Compound 4-8
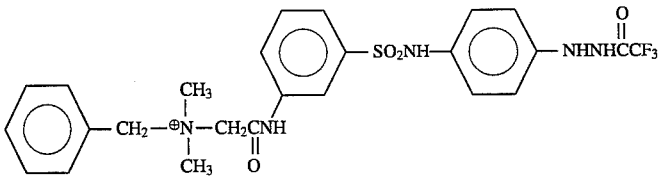
Compound 4-9
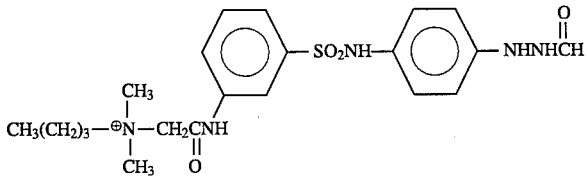
Compound 4-10
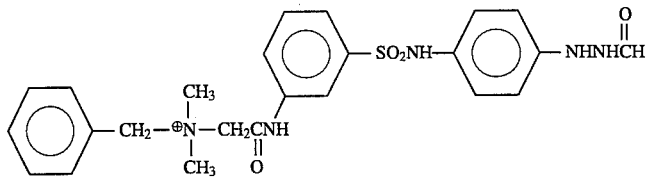
Compound 4-11
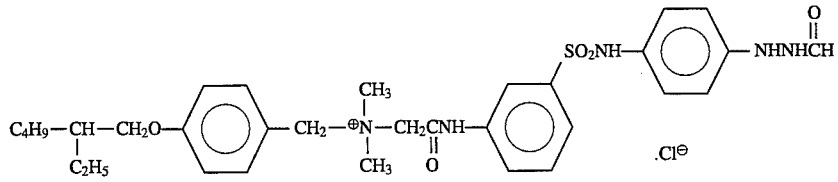

-continued

Compound 4-12

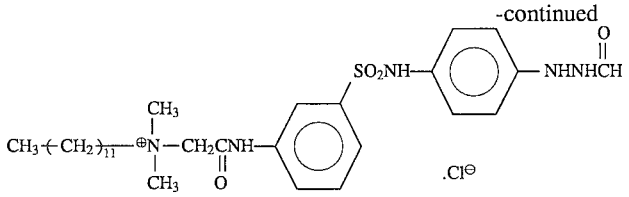

Compound 4-13

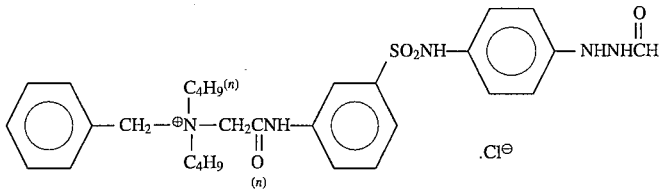

Compound 4-14

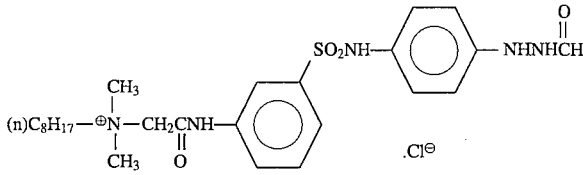

Compound 4-15

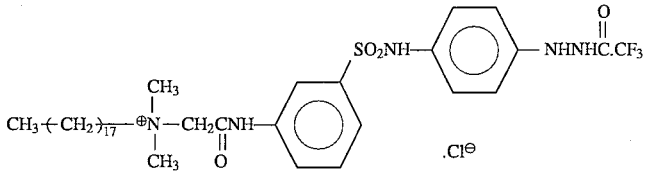

Compound 4-16

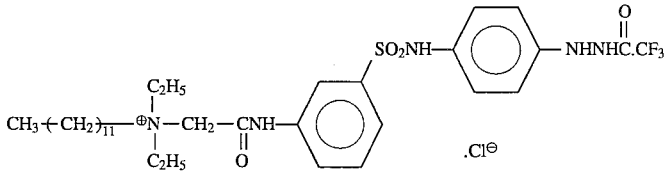

Compound 4-17

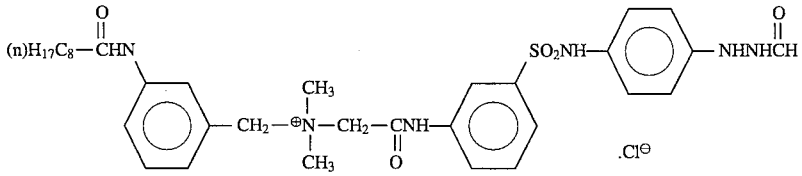

$R_{51}-NHNH-G_{51}-R_{52}$ (5)

where $R_{51}$ represents an aliphatic group, an aromatic group or a heterocyclic group, which may be substituted;

$G_{51}$ represents —CO—, $SO_2$—, —SO—, —COCO—, a thiocarbonyl group, an iminomethylene group, or —P(O)($R_{53}$)—;

$R_{52}$ represents a substituted alkyl group, in which the carbon atom substituted by $G_{51}$ is substituted by at least one electron-withdrawing group; and $R_{53}$ represents a hydrogen atom, an aliphatic group, an aromatic group, an alkoxy group, an aryloxy group or an amino group.

The compounds of formula (5) will be explained in more detail.

In formula (5), the aliphatic group of $R_{51}$ is a linear, branched or cyclic alkyl, alkenyl or alkynyl group preferably having from 3 to 60 carbon atoms.

The aromatic group of $R_{51}$ is a monocyclic or bicyclic aryl group preferably having from 6 to 60 carbon atoms, including, for example, a phenyl group and a naphthyl group.

The heterocyclic group of $R_{51}$ is a 3-membered to 10-membered, saturated or unsaturated heterocyclic group having at least one hetero atom of N, O and S, and this may be monocyclic or may form a condensed ring along with other aromatic or heterocyclic ring(s). The hetero ring is preferably a 5-membered or 6-membered aromatic hetero ring, including, for example, a pyridyl group, an imidazolyl group, a quinolinyl group, a benzimidazolyl group, a pyrimidyl group, a pyrazolyl group, an isoquinolinyl group, a thiazolyl group and a benzothiazolyl group.

$R_{51}$ is preferably an aromatic group, a nitrogen-containing heterocyclic group or a group of the following general formula (b):

$$X_b\left(\underset{R_b^1}{\underset{|}{C}}=\underset{R_b^2}{\underset{|}{C}}\right)_r\left(\underset{R_b^3}{\underset{|}{C}}=\underset{R_b^4}{\underset{|}{C}}\right)_s \quad (b)$$

where $X_b$ represents an aromatic group or a nitrogen-containing heterocyclic group; $R_b^1$ to $R_b^4$ each represents a hydrogen atom, a halogen atom or an alkyl group;

$X_b$ and $R_b^1$ to $R_b^4$ may optionally be substituted, if possible; and r and s each represent 0 or 1.

$R_b^1$ is more preferably an aromatic group and is especially, preferably an aryl group.

$R_b^1$ may optionally be substituted. As examples of the substituents for $R_b^1$, there may be mentioned an alkyl group, an aralkyl group, an alkenyl group, an alkynyl group, an alkoxy group, an aryl group, a substituted amino group, an aryloxy group, a sulfamoyl group, a carbamoyl group, an alkylthio group, an arylthio group, a sulfonyl group, a sulfinyl group, a hydroxyl group, a halogen atom, a cyano group, a sulfo group, a carboxyl group, an alkyloxycarbonyl group, an aryloxycarbonyl group, an acyl group, an alkoxycarbonyl group, an acyloxy group, a carbonamido group, a sulfonamido group, a nitro group, an alkylthio group, an arylthio group, and a group of the following general formula (c):

$$R_C^1—L_c—Y_c—N(R_c^2)— \quad (c)$$

where $Y_c$ represents —CO—, —$SO_2$—, —P(O)($R_C^3$)— (where $R_C^3$ is an alkoxy group or an aryloxy group), or —OP(O)($R_C^3$)—; L represents a single bond, —O—, —S— or —$NR_C^4$— (where $R_C^4$ is a hydrogen atom, an alkyl group or an aryl group); $R_C^1$ and $R_C^2$ each represent a hydrogen atom, an aliphatic group, an aromatic group or a heterocyclic group, and these may be the same or different and may be bonded to each other to form a ring.

$R_C^1$ may contain one or more groups of formula (c).

In formula (c), the aliphatic group of $R_C^1$ is a linear, branched or cyclic alkyl, alkenyl or alkynyl group.

The aromatic group of $R_C^1$ is a monocyclic or bicyclic aryl group, including, for example, a phenyl group and a naphthyl group.

The heterocyclic group of $R_C^1$ is a 3-membered to 10-membered, saturated or unsaturated heterocyclic group having at least one hetero atom of N, O and S, and this may be monocyclic or may form a condensed ring with other aromatic or heterocyclic ring(s). The hetero ring is preferably a 5-membered or 6-membered aromatic hetero ring, including, for example, a pyridyl group, an imidazolyl group, a quinolinyl group, a benzimidazolyl group, a pyrimidyl group, a pyrazolyl group, an isoquinolinyl group, a thiazolyl group and a benzothiazolyl group.

$R_C^1$ may be substituted. As examples of the substituents for $R_C^1$, there may be mentioned an alkyl group, an aralkyl group, an alkenyl group, an alkynyl group, an alkoxy group, an aryl group, a substituted amino group, an acylamino group, a sulfonylamino group, an ureido group, an urethane group, an aryloxy group, a sulfamoyl group, a carbamoyl group, an alkylthio group, an arylthio group, a sulfonyl group, a sulfinyl group, a hydroxyl group, a halogen atom, a cyano group, a sulfo group, a carboxyl group, an alkyloxycarbonyl group, an aryloxycarbonyl group, an acyl group, an alkoxycarbonyl group, an acyloxy group, a carbonamido group, a sulfonamido group, a nitro group, an alkylthio group and an arylthio group. These substituents may further be substituted.

If possible, these groups may be bonded to each other to form a ring.

The aliphatic group of $R_C^2$ in formula (c) is a linear, branched or cyclic alkyl, alkenyl or alkynyl group.

The aromatic group or $R_C^2$ is a monocyclic or bicyclic aryl group, including, for example, a phenyl group.

$R_C^2$ may be substituted. As examples of the substituents for $R_C^2$, those mentioned for $R_C^1$ in formula (c) may be used.

If possible, $R_C^1$ and $R_C^2$ may be bonded to each other to form a ring.

$R_C^2$ is more preferably a hydrogen atom.

$Y_c$ in formula (c) is especially preferably —CO— or —$SO_2$—; and $L_c$ is preferably a single bond or —$NR_C^4$—.

The aliphatic group of ▪in formula (c) is a linear, branched or cyclic alkyl, alkenyl or alkynyl group.

The aromatic group or ▪is a monocyclic or bicyclic aryl group, including, for example, a phenyl group.

▪may be substituted. As examples of the substituents for ▪, those mentioned for ▪in formula (c) are referred to.

▪is more preferably a hydrogen atom.

$G_{51}$ in formula (5) is most preferably —CO—.

$R_{52}$ in formula (5) is a substituted alkyl group, in which the carbon atom substituted by G is substituted by at least one electron-withdrawing group. Preferably, it is a substituted alkyl group substituted by two electron-withdrawing groups, especially preferably by three electron-withdrawing groups.

The electron-withdrawing group which substitutes the carbon atom substituted by $G_{51}$ in $R_{52}$ is preferably one having a δp value of 0.2 or more and a δm value of 0.3 or more. It includes, for example, a halogen atom, a cyano group, a nitro group, a nitroso group, a polyhaloalkyl group, a polyhaloaryl group, an alkyl or arylcarbonyl group, a formyl group, an alkyl or aryloxycarbonyl group, an alkylcarbonyloxy group, a carbamoyl group, an alkyl or arylsulfinyl group, an alkyl or arylsulfonyl group, an alkyl or arylsulfonyloxy group, a sulfamoyl group, a phosphino group, a phosphinoxide group, a phosphonate group, a phosphonic acid amido group, an arylazo group, an amidino group, an ammonio group, a sulfonio group and an electron-lacking heterocyclic group.

$R_{52}$ in formula (5) is especially, preferably a trifluoromethyl group.

$R_{51}$ or $R_{52}$ in formula (5) may contain therein a ballast group or polymer which is generally found in ordinary passive photographic additives, such as, couplers. The ballast group has 8 or more carbon atoms and is relatively inactive to photographic properties. For instance, it may be selected from an alkyl group, an alkoxy group, a phenyl group, an alkylphenyl group, a phenoxy group and an alkylphenoxy group. As examples of the polymer, those described in JP-A-1-100530 are referred to.

$R_{51}$ or $R_{52}$ in formula (5) may contain therein a group of reinforcing the adsorption to the surfaces of silver halide grains. As examples of the adsorbing group, there may be mentioned thiourea groups, heterocyclic thioamido groups, mercapto-heterocyclic groups and triazole groups, such as those described in U.S. Pat. Nos. 4,385,108 and 4,459,347, JP-A-59-195233, JP-A-59-200231, JP-A-59-201045, JP-A-59-201046, JP-A-59201047, JP-A-59-201048, JP-A-59-201049, JP-A-61-170733, JP-A-61-270744, JP-A-62-948, JP-A-63-234244, JP-A-63-234245 and JP-A-63-234246.

Specific non-limiting examples of the compounds of formula (5) for use in the present invention are mentioned below, as follows:

5-1
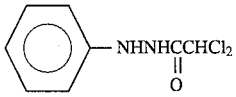
5-2
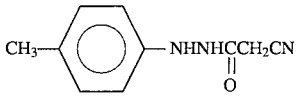
5-3
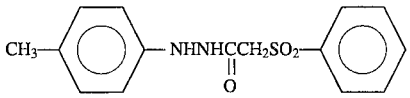
5-4
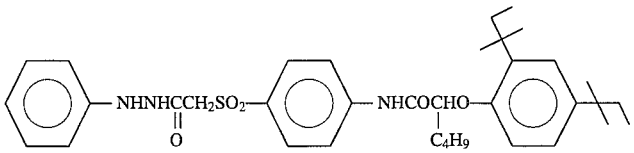
5-5
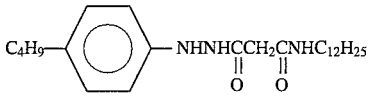
5-6
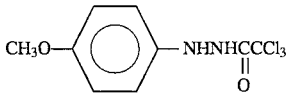
5-7
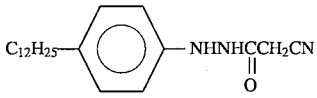
5-8
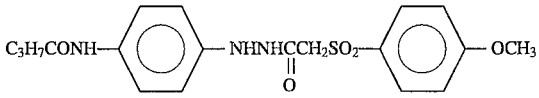
5-9
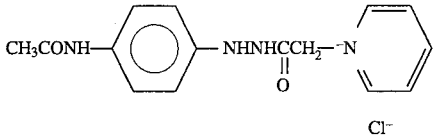
5-10
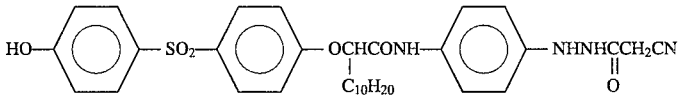
5-11
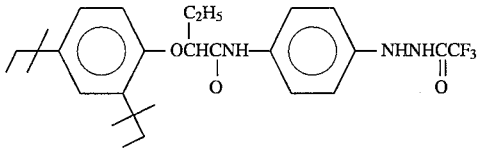
5-12
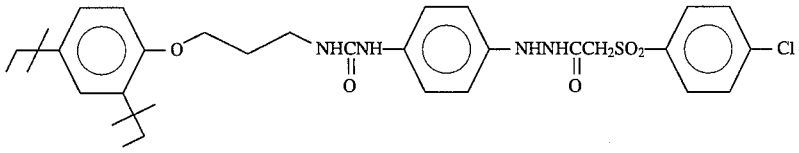
5-13
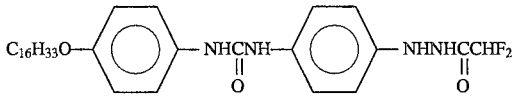

-continued
5-14
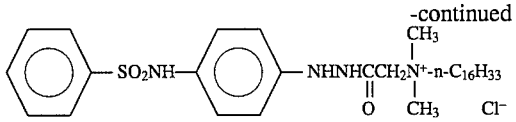
5-15
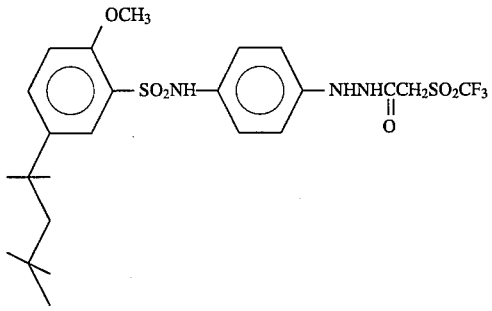
5-16
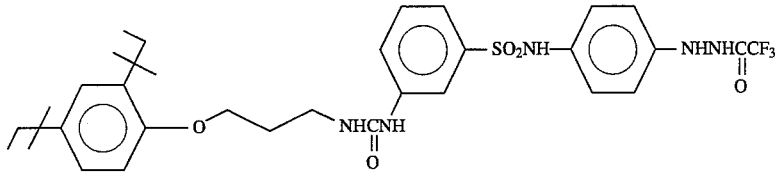
5-17
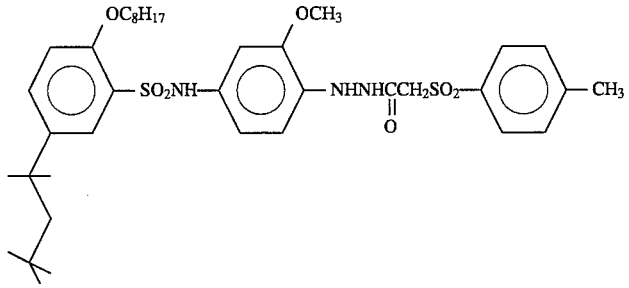
5-18
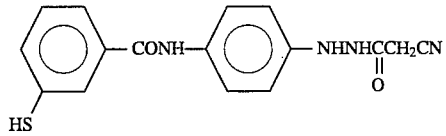
5-19
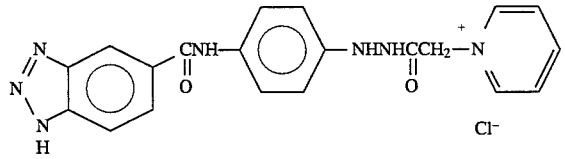
5-20
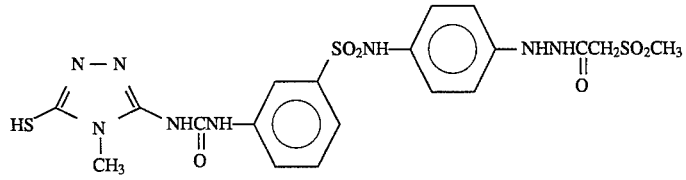
5-21
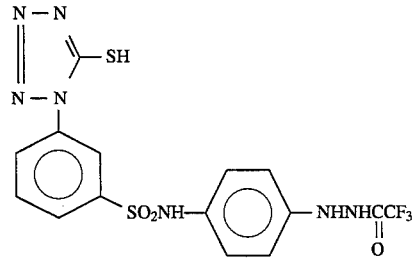

-continued
5-22
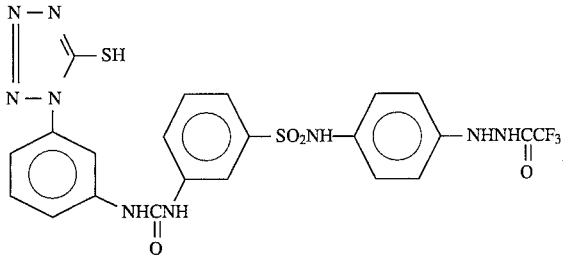
5-23
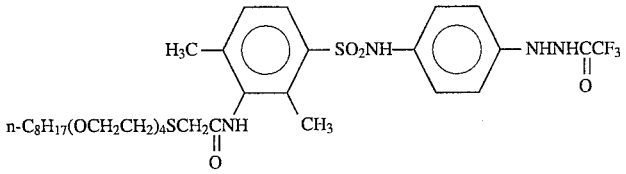
5-24
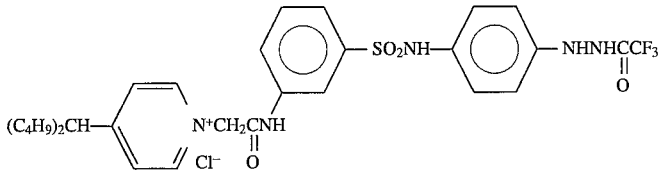
5-25
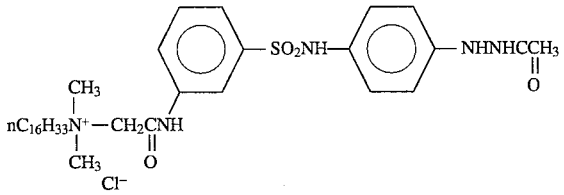
5-26
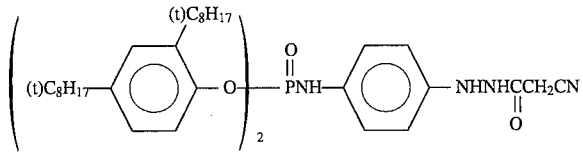
5-27
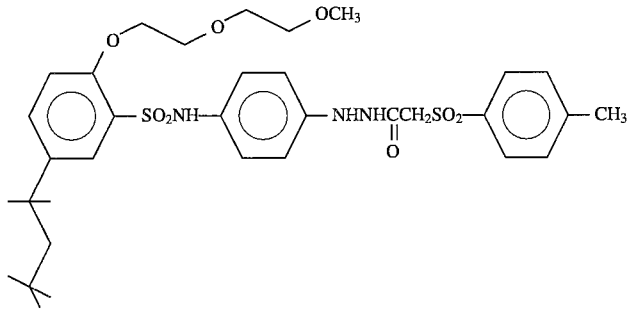
5-28
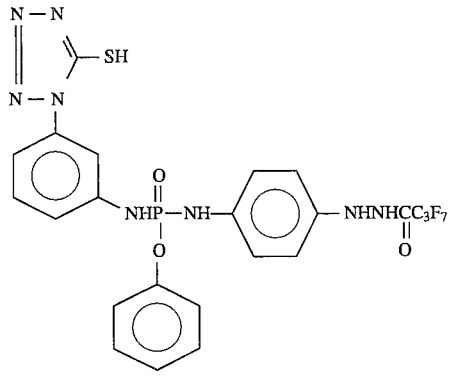

-continued
5-29
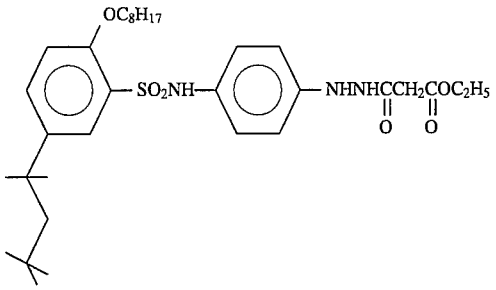
5-30
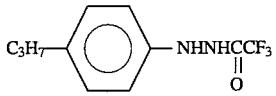
5-31
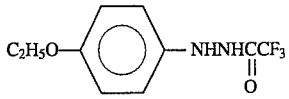
5-32
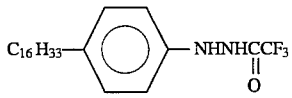
5-33
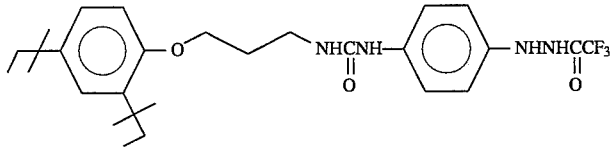
5-34
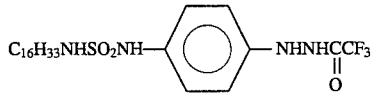
5-35
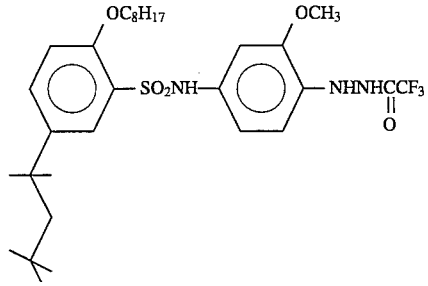
5-36
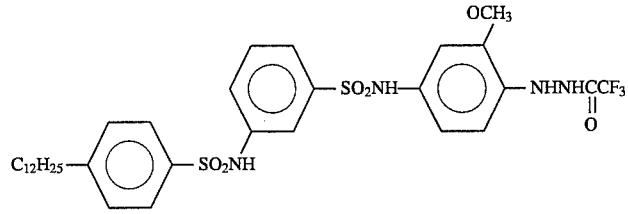
5-37
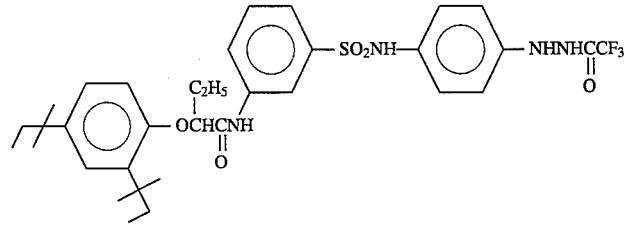

-continued 5-38

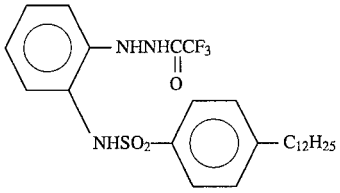

5-39

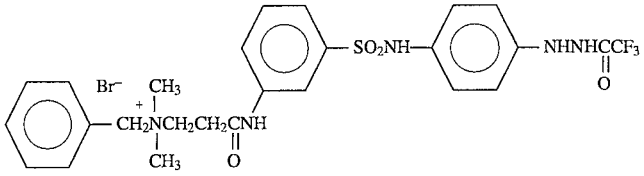

5-40

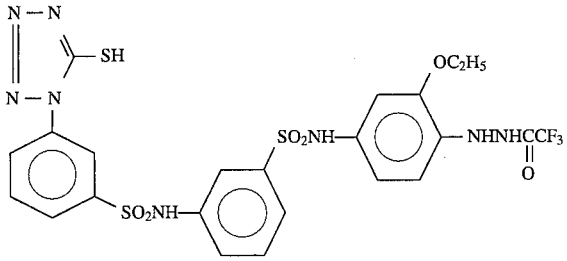

5-41

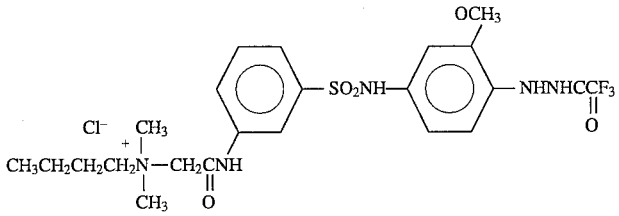

5-42

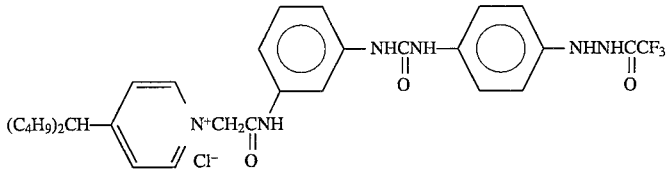

The hydrazine derivatives for use in the present invention may be produced by reacting the corresponding hydrazine with the corresponding carboxylic acid in the presence of a condensing agent such as dicyclohexylcarbodiimide or the like or with the corresponding acid halide such as a sulfonyl chloride or acyl chloride or the corresponding acid anhydride or active ester. Where EWG is $R_3SO_2$—, the corresponding haloacetylhydrazide derivative may be reacted with $R_3SO_2H$ in the presence of a base.

An example of producing one of the hydrazine derivatives is set forth below, as follows:

Synthesis Example 1: Synthesis of Compound (4-16)

Triethylamine (15.3 ml) was added to a mixture solution comprising starting compound (A) (63.2 g) mentioned below and tetrahydrofuran (200 ml), the resulting mixture solution was cooled to 5° C., trifluoroacetic anhydride (16.9 ml) was added thereto, and the solution was stirred overnight at room temperature. The reaction solution was poured into aqueous 0.1—N HCl solution and extracted with ethyl acetate, and the organic layer-was washed with a saturated saline solution. This was dried with anhydrous magnesium sulfate, the ethyl acetate was removed by distillation, and the residue was isolated and purified by silica gel chromatography to obtain the product (52.1 g). The structure of the compound obtained was identified by its NMR spectrum and IR spectrum.

The structure of the starting compound (A) is as follows:

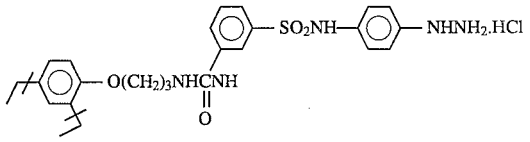

Next, compounds of formula (6) will be explained in detail, as follows:

$$R_{6a}-\underset{A_{61}}{N}-\underset{A_{62}}{N}-G_{61}-R_{6b} \qquad (6)$$

where $A_{61}$ and $A_{62}$ are both hydrogen atoms, or one of them is a hydrogen atom and the other is a sulfinic acid group or an acyl group;

$R_{6a}$ represents an aliphatic group, an aromatic group or a heterocyclic group;

$R_{6b}$ represents a hydrogen atom, an alkyl group, an aryl group, an alkoxy group, an aryloxy group or an amino group;

$G_{61}$ represents a carbonyl group, a sulfonyl group, a sulfoxy group, a phosphoryl group or an iminomethylene group; and at least one of $R_{6a}$ and $R_{6b}$ has an adsorption-accelerating group to silver halides.

In formula (6), the aliphatic group of $R_{6a}$ is a linear, branched or cyclic alkyl, alkenyl or alkynyl group.

The aromatic group of $R_{6a}$ is a monocyclic or bicyclic aryl group, including, for example, a phenyl group and a naphthyl group.

The heterocyclic group of $R_{6a}$ is a 3-membered to 10-membered, saturated or unsaturated heterocyclic group having at least one hetero atom of N, O and S, and this may be monocyclic or may form a condensed ring with other aromatic or heterocyclic ring(s). The hetero ring is preferably a 5-membered or 6-membered aromatic hetero ring, including, for example, a pyridyl group, an imidazolyl group, a quinolinyl group, a benzimidazolyl group, a pyrimidyl group, a pyrazolyl group, an isoquinolinyl group, a thiazolyl group and a benzothiazolyl group.

$R_{62}$ may be substituted. As examples of the substituents for $R_{62}$, mentioned are an alkyl group, an aralkyl group, an alkoxy group, an aryl group, a substituted amino group, an acylamino group, a sulfonylamino group, an ureido group, an urethane group, an aryloxy group, a sulfamoyl group, a carbamoyl group, an aryl group, an alkylthio group, an arylthio group, a sulfonyl group, a sulfinyl group, a hydroxyl group, a halogen atom, a cyano group, a sulfo group and a carboxyl group.

If possible, these groups may be bonded to each other to form a ring.

When $G_{61}$ is a carbonyl group, $R_{6b}$ is preferably a hydrogen atom, an alkyl group (e.g., methyl, trifluoromethyl, 3-hydroxypropyl, 3-methanesulfonamidopropyl), an aralkyl group (e.g., o-hydroxybenzyl), or an aryl group (e.g., phenyl, 3,5-dichlorophenyl, o-methanesulfonamidophenyl, 4-methanesulfonylphenyl). It is especially preferably a hydrogen atom.

When $G_{61}$ is a sulfonyl group, $R_{6b}$ is preferably an alkyl group (e.g., methyl), an aralkyl group (e.g., o-hydroxyphenylmethyl), an aryl group (e.g., phenyl), or a substituted amino group (e.g., dimethylamino).

When $G_{61}$ is a sulfoxy group, $R_{6b}$ is preferably a cyanobenzyl group or a methylthiobenzyl group. When $G_1$ is a phosphoryl group, $R_{6b}$ is preferably a methoxy group, an ethoxy group, a butoxy group, a phenoxy group or a phenyl group and is especially preferably a phenoxy group.

When $G_{61}$ is an N-substituted or unsubstituted iminomethylene group, $R_{6b}$ is preferably a methyl group, an ethyl group, or a substituted or unsubstituted phenyl group.

As examples of the substituents for $R_{6b}$, those for $R_{6a}$ mentioned above as well as an acyl group, an acyloxy group, an alkyl or aryloxycarbonyl group, an alkenyl group, an alkynyl group and a nitro group are referred to.

These substituents may further be substituted. If possible, these groups may be bonded to each other to form a ring.

The adsorption-accelerating group for silver halides, which may substitute $R_{6a}$ and $R_{6b}$, may be represented by $X_{61}$—$(L_{61})q$—.

$X_{61}$ represents an adsorption-accelerating group for silver halides; $L_{61}$ represents a divalent linking group; q represents 0 or 1.

As preferred examples of the adsorption-accelerating group for silver halide, which is represented by $X_{61}$, there may be mentioned a thioamido group, a mercapto group, a disulfido bond-having group, or a 5-membered or 6-membered nitrogen-containing heterocyclic group.

The thioamido adsorption-accelerating group of $X_{61}$ is a divalent group of —CS-amino-, which may be either a part of a cyclic structure or an acyclic thioamido group. The usable thioamido adsorption-accelerating group may be selected from those described in U.S. Pat. Nos. 4,030,925, 4,031,127, 4,080,207, 4,245,037, 4,255,511, 4,266,013 and 4,276,364, and *Research Disclosure*, Vol. 151, No. 15162 (November, 1976) and ibid., Vol. 176, No. 17626 (December, 1978).

As specific examples of the acyclic thioamido groups, there may be mentioned a thioureido group, a thiourethane group, and a dithiocarbamate group. As those of the cyclic thioamido group, there may be mentioned a 4-thiazoline-2-thione group, a 4-imidazoline- 2-thione group, a 2-thiohydantoin group, a rhodanine group, a thiobarbituric acid group, a tetrazoline-5-thione group, a 1,2,4-triazoline-3-thione group, a 1,3,4-thiadiazoline-2-thione group, a 1,3,4-oxadiazoline- 2-thione group, a benzimidazoline-2-thione group, a benzoxazoline-2-thione group and a benzothiazoline- 2-thione group. These group may further be substituted.

The mercapto group of $X_{61}$ includes an aliphatic mercapto group, an aromatic mercapto group and a heterocyclic mercapto group. The heterocyclic mercapto group, in which the atom adjacent to the carbon atom bonded to the —SH group is a nitrogen atom, has the same meaning as the corresponding cyclic thioamido group which is a tautomer of the mercapto group. Specific examples of the group have been mentioned hereinabove.

The 5-membered or 6-membered nitrogen-containing heterocyclic group of $X_{61}$ comprises a combination of nitrogen, oxygen and sulfur atoms along with carbon atoms. As preferred examples of the group, there may be mentioned are groups derived from benzotriazoles, triazoles, tetrazoles, indazoles, benzimidazoles, imidazoles, benzothiazoles, thiazoles, benzoxazoles, oxazoles, thiadiazoles, oxadiazoles and triazines. The groups may further be substituted.

As the substituents for the groups, those for $R_{6a}$ mentioned above are referred to.

$X_{61}$ is preferably a cyclic thioamido group (or a mercapto-substituted nitrogen-containing heterocyclic group, such as 2-mercaptothiazole group, 3-mercapto-1,2,4-triazole group, 5-mercaptotetrazole group, 2-mercapto- 1,3,4-oxadiazole group, 2-mercaptobenzoxazole group), or a nitrogen-containing heterocyclic group (e.g., benzotirazole group, benzimidazole group, indazole group).

$R_{6a}$ or $R_{6b}$ in formula (6) may be substituted by two or more same or different $X_{61}$—$(L_{61})q$ groups.

The divalent linking group of $L_{61}$ is an atom or an atomic group containing at least one of C, N, S and O. For instance, it is an alkylene group, an alkenylene group, an alkynylene group, an arylene group, —O—, —S—, —NH—, —N=, —CO— or —$SO_2$—, which may optionally be substituted, or a combination of them.

The divalent linking group may further be substituted.

As examples of the substituents for the group, those for Ra mentioned above Bay be employed.

$A_{61}$ and $A_{62}$ each represents a hydrogen atom, an alkylsulfonyl or arylsulfonyl group having 1 to 20 carbon atoms (preferably a phenylsulfonyl group or a substituted phenylsulfonyl group in which the sum of the Hammett's substituent constant(s) of the substituent(s) is —0.5 or more), an acyl group having 20 or less carbon atoms (preferably a benzoyl group, or a substituted benzoyl group in which the sum of the Hammett's substituent constant(s) of the substituent(s) is –0.5 or more, or a linear, branched or cyclic unsubstituted or substituted aliphatic acyl group), or a sulfinic acid residue. As examples of the substituents for the group, there may be mentioned a halogen atom, an ether group, a sulfonamido group, a carbonamido group, a hydroxyl group, a carboxyl group and a sulfonic acid group. As the sulfinic acid residue of $A_{61}$ and $A_{62}$, those described in U.S. Pat. No. 4,478,928 may be used.

$A_{61}$ and $A_{62}$ are preferably hydrogen atoms.

$G_{61}$ in formula (6) is most preferably a carbonyl group.

Of the compounds of formula (6), preferred are those of the following general formula (6-a):

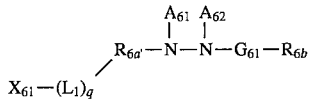

(6-a)

where $R_{6a}'$ is a group to be derived from $R_{6a}$ in formula (6) by removing one hydrogen atom therefrom, and at least one of $R_{6a}'$, $R_{6b}$ and $L_{61}$ has a group capable of being dissociated into an anion having pKa of 6 or more, or an amino group.

The group capable of being dissociated into an anion having pKa of 6 or more is preferably one that may be dissociated into an anion having pKa of from 8 to 13. The group need not be specifically defined provided, except that it should not become almost dissociated in a neutral or weakly acidic medium, but should be sufficiently dissociated in an alkaline aqueous solution, such as, a developer (preferably having pH of from 10.5 to 12.3).

For instance, the group may include a hydroxyl group, a group of —$SO_2$—NH—, a hydroxyimino group, an active methylene group, and an active methine group (e.g., —$CH_2COO$—, —$CH_2CO$—, —CH(CN)—COO—).

The amino group may be a primary, secondary or tertiary one. It is preferably one capable of being conjugated with an acid having pKa of 6.0 or more.

$A_{61}$, $A_{62}$, $G_{61}$, $R_{6b}$, $L_{61}$, $X_{61}$ and q have the same meanings as those in formula (6).

Of the compounds of formula (6), especially preferred are those of the following general formula (6-b):

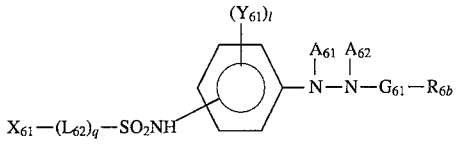

(6-b)

where $L_{62}$ has the same meaning as $L_1$ in formulae (6), and (6-a); $Y_{61}$ has the same meaning as the substituents for $R_{61}$ in formula (6); q represents 0 or 1; and l represents 0, 1 or 2, and when l is 2, the plural $Y_{61}$'s may be the same or different.

$A_{61}$, $A_{62}$, $G_{61}$, $R_{6b}$, $L_{61}$ and $X_{61}$ have the same meanings as those in formulae (6) and (6-a).

More preferably, the moiety $X_{61}$—$(L_{62})$q—$SO_2$NH is positioned in the p-position to the hydrazino group in the formula.

The compounds of formula (6) may be produced by known methods, for example, in accordance with the methods described in JP-A-56-67843 and JP-A-60-179734, Japanese Patent Application Nos. 60-78182, 60-111936 and 61-115036.

Specific, non-limiting examples of the compounds of formula (6) are mentioned below.

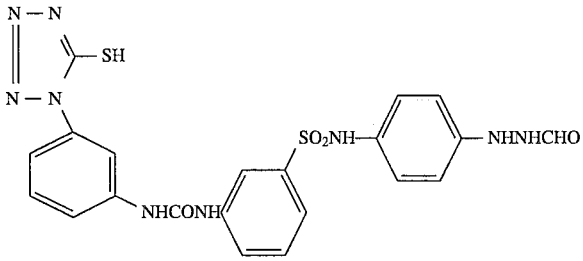

Compound 6-1

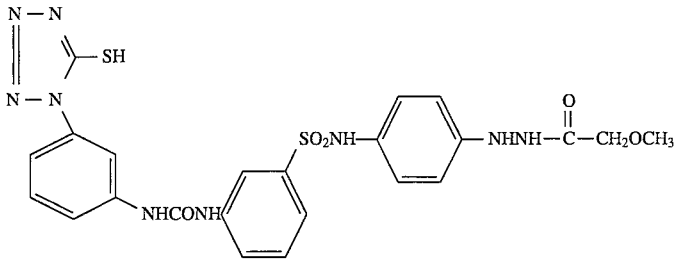

Compound 6-2

-continued

Compound 6-3

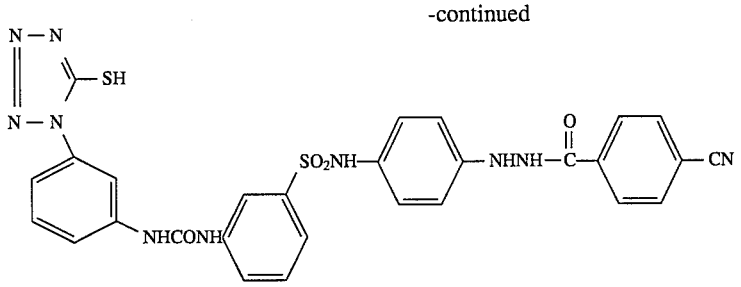

Compound 6-4

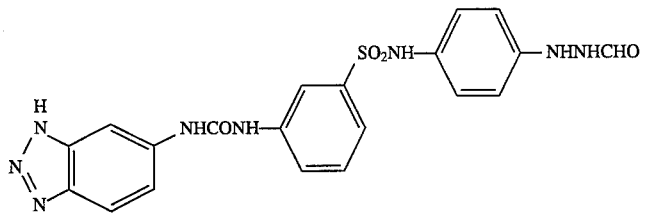

Compound 6-5

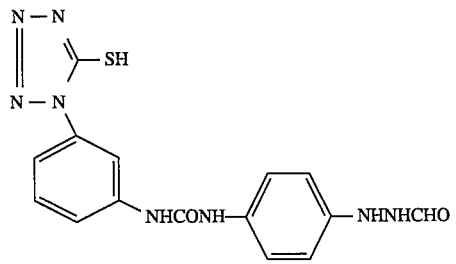

Compound 6-6

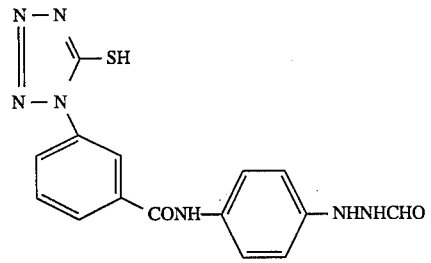

Compound 6-7

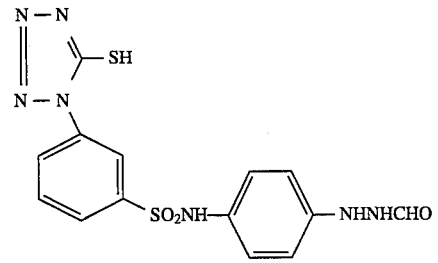

The hydrazine compound to be added to the photographic material of the present invention is preferably from $1\times10^{-6}$ mol to $5\times10^{-2}$ mol, especially preferably from $1\times10^{-5}$ mol to $2\times10^{-2}$ mol, per mol of silver halide.

The hydrazine compound may be dissolved in a suitable water-miscible organic solvent, such as alcohols (e.g., methanol, ethanol, propanol, fluorinated alcohols), ketones (e.g., acetone, methyl ethyl ketone), dimethylformamide, dimethylsulfoxide or methyl cellosolve, prior to the addition thereof to the photographic material.

If desired, the hydrazine compound may also be formed into an emulsified dispersion by means of a well-known mechanical emulsification and dispersion method using an assistant solvent, for example, oils, such as, dibutyl phthalate, tricresyl phosphate, glyceryl triacetate or diethyl phthalate, or ethyl acetate or cyclohexane. In addition, a powder of the hydrazine compound may be dispersed in water using a ball mill or colloid mill or by means of ultrasonic waves. The dispersion may be added to the photographic material of the present invention.

The photographic material of the present invention may contain an amine derivative, an onium salt, a disulfide derivative or a hydroxymethyl derivative as a nucleation accelerator.

As examples of usable amine derivatives, there may be mentioned the compounds described in JP-A-60-140340, JP-A-62-50829, JP-A-62-222241, JP-A-62-250439, JP-A-62280733, JP-A-63-124045, JP-A-63-133145 and JP-A-63-286840. As the amine derivative, especially preferred are the compounds having a group which adsorbs silver halide grains, as described in JP-A-63-124045, JP-A-63-133145 and JP-A-63-286840, as well as compounds having 20 or more carbon atoms as a whole, as described in JP-A-62-222241.

As the onium salt, preferred are ammonium salts and phosphonium salts. Preferred examples of ammonium salts are described in JP-A-62-250439 and JP-A-62-280733. Preferred examples of phosphonium salts are described in JP-A-61-167939 and JP-A-62-280733.

As examples of usable disulfide derivatives, there may be mentioned the compounds described in JP-A-61198147.

As examples of the usable hydroxymethyl derivative, there may be mentioned the compounds described in U.S. Pat. Nos. 4,693,956 and 4,777,118, EP 231,850 and JP-A-62-50829. More preferred are diarylmethanol derivatives.

Specific non-limiting examples of the nucleation accelerator for use in the present invention are mentioned below.

A-1)

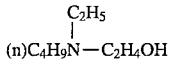

A-2)

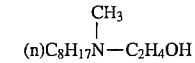

A-3)

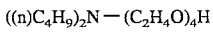

A-4)

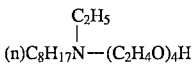

A-5)

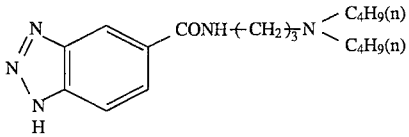

A-6)

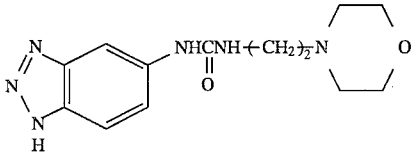

A-7)

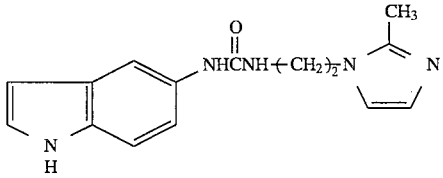

A-8)

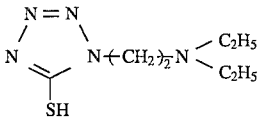

A-9)

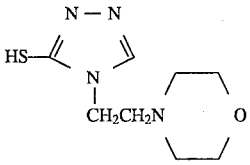

-continued

A-10)

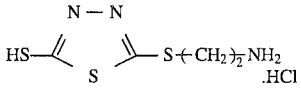

A-11)

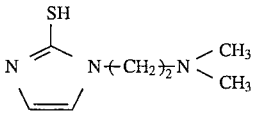

A-12)

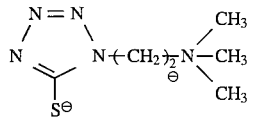

A-13)

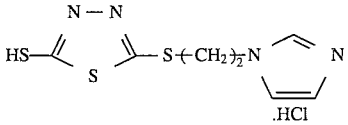

A-14)

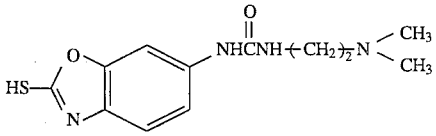

A-15)

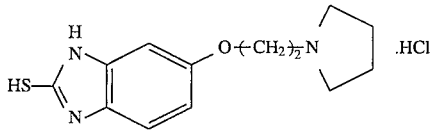

A-16)

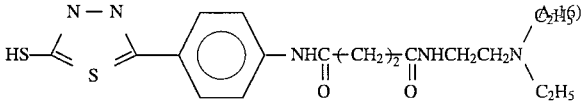

A-17)

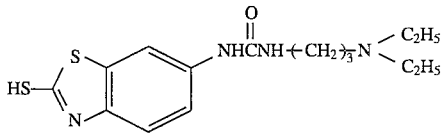

A-18)

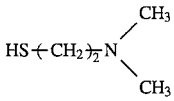

A-19)

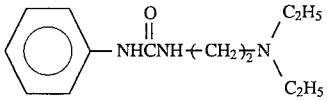

A-20)

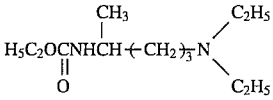

A-21)

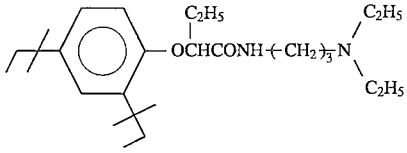

-continued

A-22)

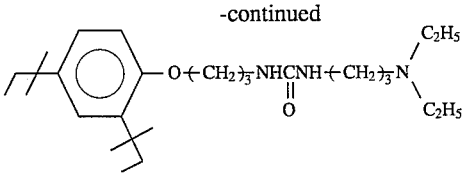

A-23)

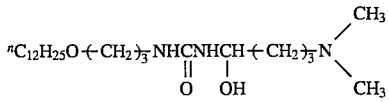

A-24)

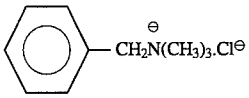

A-25)

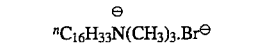

A-26)

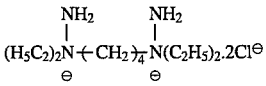

A-27)

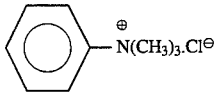

A-28)

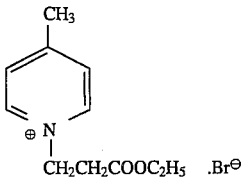

A-29)

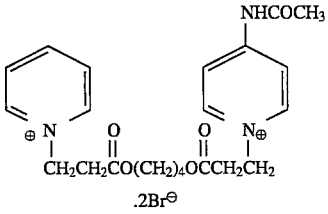

A-30)

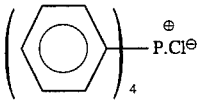

A-31)

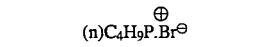

A-32)

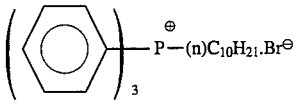

A-33)

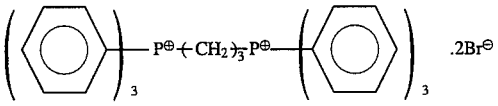

A-34)

A-35)

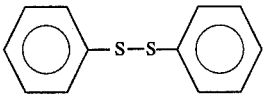

A-36)

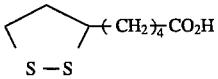

-continued

A-37)

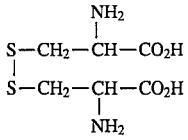

A-38)

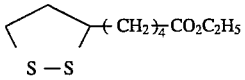

A-39)

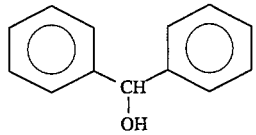

A-40)

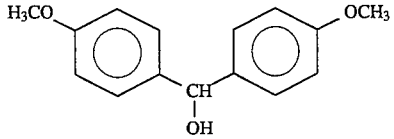

A-41)

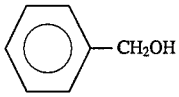

A-42)

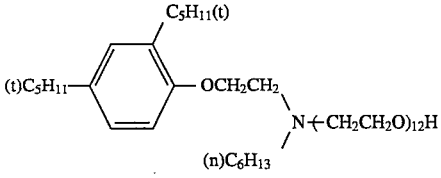

A-43)

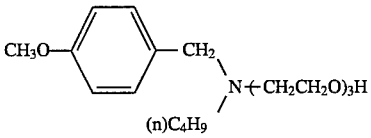

A-44)

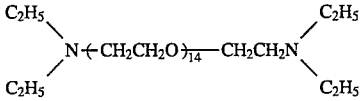

A-45)

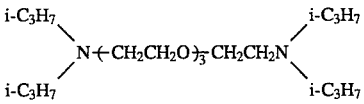

A-46)

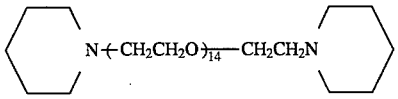

A-47)

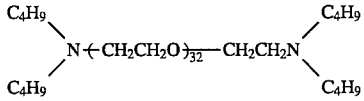

The optimum amount of the nucleation accelerator to be added to the photographic material of the present invention varies, depending upon the kind of the compound. In general, it is desirably added in an amount of from $1.0\times10^{-2}$ mol to $1.0\times10^{2}$ mol, preferably from $1.0\times10^{-1}$ mol to $1.0\times10$ mol, per mol of the hydrazine compound in the photographic material.

The compound of the nucleation accelerator is dissolved in a suitable solvent (e.g., water, alcohols such as methanol and ethanol, acetone, dimethylformamide, methyl cellosolve) and the solution is added to the coating liquid for preparing the photographic material of the present invention.

The photographic material of the present invention may contain a redox compound capable of releasing a development inhibitor therefrom by its oxidation, in the silver halide emulsion layers or in other hydrophilic colloid layers.

The redox group in the redox compounds is preferably a group derived from hydroquinones, catechols, naphthohydroquinones aminophenols, pyrazolidones, hydrazines, hydroxylamines and reductones. More preferably, it is a group derived from hydrazines. Also preferred for use in the present invention are redox compounds that release a development inhibitor, at least a part of which inhibitor dissolves in a developer to be reacted with the components of the developer whereby the inhibitor released from the redox compound is reduced.

Hydrazines which may be used in the present invention as redox compounds capable of releasing a development inhibitor by oxidation are preferably those represented by the following general formula (R-1), (R-2) or (R-3), of which compounds of formula (R-1) are especially preferred:

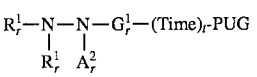

(R-1)

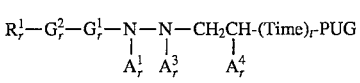

(R-2)

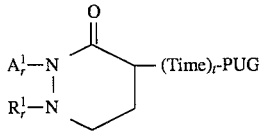

(R-3)

In these formulae, $R_r^1$ represents an aliphatic group or an aromatic group. $G_r^1$ represents —CO—, —CO—CO—, —CS—, —C(=N—$G_r^2$—$R_r^2$)—, —SO—, —$SO_2$— or —P(O) ($G_r^2$ —$R_r^2$)-. $G_r^2$ represents a mere chemical bond or represents —O—, —S— or —$NR_r^2$— and $R_r^2$ represents a hydrogen atom or $R_r^1$.

$A_r^1$ and $A_r^2$ each independently represents a hydrogen atom, an alkylsulfonyl group, an arylsulfonyl group or an acyl group, which may optionally be substituted. In formula (R-1), at least one of $A_r^1$ and $A_r^2$ must be a hydrogen atom. $A_r^3$ has the same meaning as $A_r^1$ or represents —$CH_2$—C($A_r^4$)H—(Time)$_t$—PUG.

$A_4$ represents a nitro group, a cyano group, a carboxyl group, a sulfo group or —$G_r^1$—$G_r^2$—$R_r^1$.

Time represents a divalent linking group; and t represents 0 or 1. PUG represents a residue of a development inhibitor.

Formulae (R-1), (R-2) and (R-3) will be explained in more detail hereunder.

In formulae (R-1), (R-2) and (R-3), the aliphatic group to be represented by $R_r^1$ is preferably a group having from 1 to 30 carbon atoms. It is especially preferred that $R_r^1$ be a linear, branched or cyclic alkyl group having from 1 to 20 carbon atoms. The alkyl group may optionally be substituted.

In formulae (R-1), (R-2) and (R-3), the aromatic group to be represented by $R_r^1$ is preferably a monocyclic or dicyclic aryl or unsaturated heterocyclic group. The unsaturated heterocyclic group may optionally be condensed with one or more aryl groups to form a heteroaryl group.

For instance, the aryl group may be composed of benzene ring, naphthalene ring, pyridine ring, quinoline ring and/or isoquinoline ring, and it is especially preferred that it contain one or more benzene rings.

It is especially preferred that $R_r^1$ be an aryl group.

The aryl group or unsaturated heterocyclic group to be represented by $R_r^1$ may optionally be substituted. As typical substituents, there may be mentioned, for example, an alkyl group, an aralkyl group, an alkenyl group, an alkynyl group, an alkoxy group, an aryl group, a substituted amino group, an ureido group, an urethane group, an aryloxy group, a sulfamoyl group, a carbamoyl group, an alkylthio group, an arylthio group, a sulfonyl group, a sulfinyl group, a hydroxyl group, a halogen atom, a cyano group, a sulfo group, an aryloxycarbonyl group, an acyl group, an alkoxycarbonyl group, an acyloxy group, a carbonamido group, a sulfonamido group, a carboxyl group, and a phosphoric acid amido group. Above all, preferred are linear, branched or cyclic alkyl groups (preferably having from 1 to 20 carbon atoms), an aralkyl group (preferably having from 7 to 30 carbon atoms), an alkoxy group (preferably having from 1 or 30 carbon atoms), a substituted amino group (preferably an amino group as substituted by one or more alkyl groups having from 1 to 30 carbon atoms), an acylamino group (preferably having from 2 to 40 carbon atoms), a sulfonamido group (preferably having from 1 to 40 carbon atoms), an ureido group (preferably having from 1 to 40 carbon atoms), and a phosphoric acid amido group (preferably having from 1 to 40 carbon atoms).

$G_r^1$ in formulae (R-1) (R-2) and (R-3) is preferably —CO— or —$SO_2$—, and most preferably, it is —CO—.

$A_r^1$ and $A_r^2$ are preferably hydrogen atoms; and $A_r^3$ is preferably a hydrogen atom or —$CH_2$—C($A_r^4$)H—(Time)$_t$—PUG.

In formulae (R-1), (R-2) and (R-3), Time represents a divalent linking group, which may have a timing-adjusting function.

The divalent linking group to be represented by Time means a group releasing PUG from the moiety Time-PUG to be released from the oxidation product of the redox nucleus, by a one step or multi-step reaction.

As examples of the divalent linking group of Time, there may be mentioned p-nitro-phenoxy derivatives releasing PUG by an intramolecular ring-closure reaction, as described in U.S. Pat. No. 4,248,962 (JP-A-54-145135); compounds releasing PUG by ring-cleavage reaction followed by intramolecular ring-closure reaction as described in U.S. Pat. No. 4,310,612 (JP-A-55-53330) and U.S. Pat. No. 4,358,252; succinic acid monoesters or analogues thereof releasing PUG by intramolecular ring-closure reaction of the carboxyl group along with formation of an acid anhydride, as described in U.S. Pat. Nos. 4,330,617, 4,446,216 and 4,483,919 and JP-A-59-121328; compounds releasing PUG by electron transfer of the aryloxy or heterocyclicoxy group via the conjugated double bond to form a quinomonomethane or an analogue thereof, as described in U.S. Pat. Nos. 4,409,232, 4,421,845, RESEARCH DISCLOSURE Item No. 2,228 (December, 1981), U.S. Pat. No. 4,416,977, (JP-A-57-135944), and JP-A-58-209736 and JP-A-58-209738; compounds releasing PUG by electron transfer of the enamine structure moiety of the nitrogen-containing hetero ring from the gamma-position of the enamine, as described in U.S. Pat. No. 4,420,554, (JP-A-57-136640), JP-A-57-135945, JP-A-57-188023, JP-A-58-98728 and JP-A-58209737; compounds releasing PUG by intramolecular ring-closure reaction of the hydroxyl group as formed by electron transfer of the carbonyl group as conjugated with the nitrogen atom of the nitrogen-containing hetero ring, as described in JP-A-57-56837; compounds releasing PUG with formation of aldehydes, as described in U.S. Pat. No. 4,146,396 (JP-A-52-90932), JP-A-59-93442, JP-A-59-75475, JP-A-60-249148 and JP-A-60-249149; compounds releasing PUG with decarbonylation of the carboxyl group, as descried in JP-A-51-146828, JP-A-57-179842 and JP-A-59-104641; compounds having —O—COOCR$_a$"R$_b$"-PUG (where R$_a$" and R$_b$" each independently represents a monovalent group) and releasing PUG by decarbonylation followed by formation of aldehydes; compounds releasing PUG with formation of isocyanates, as described in JP-A-60-7429; and compounds releasing PUG by coupling reaction with the oxidation product of a color developing agent, as described in U.S. Pat. No. 4,438,193.

Examples of divalent linking groups of Time are also described in JP-A-61-236549, JP-A-1-269936 and JP-A-3-67246.

PUG represents a group having a development-inhibiting activity as (Time)$_t$-PUG or as PUG. PUG is preferably a development inhibitor such that it may dissolve into a developer to react with the components of the developer so that it is converted into a compound having a lowered development-inhibiting activity.

The development inhibitor to be represented by PUG or (Time)$_t$-PUG may be a known development inhibitor containing hetero atoms, and it is bonded to the formula via the hetero atom. Examples of such a development inhibitor are described, for example, in C. M. E. Mees and T. H. James, *The Theory of Photographic Processes,* 3rd Ed. (published by Macmillan Co., 1966), pages 344 to 346.

The development inhibitor of PUG may optionally be substituted. As examples of the substituents, those mentioned as substituents of the group R$_r^1$ are referred to. The substituents may further be substituted.

Preferred substituents are a nitro group, a sulfo group, a carboxyl group, a sulfamoyl group, a phosphono group, a phosphinyl group and a sulfonamido group.

In formulae (R-1), (R-2) and (R-3), R$_r^1$ or -(Time)$_t$-PUG may have a ballast group which is generally used in passive photographic additives, such as, couplers, or may also have a group for accelerating adsorption of the compound of formula (R-1), (R-2) or (R-3) to silver halides, if desired.

The ballast group usable for this purpose is an organic group which may give a sufficient molecular weight to the compound of formula (R-1), (R-2) or (R-3) so that the compound could not substantially diffuse to the other layers or to processing solutions, and it is composed of one or more of an alkyl group, an aryl group, a heterocyclic group, an ether group, a thioether group, an amido group, an ureido group, an urethane group and a sulfonamido group. Preferably, the ballast group is a substituted benzene ring-having ballast group, especially a branched alkyl group-substituted benzene ring-containing ballast group.

As the group having a function of accelerating adsorption of the compound of formula (R-1), (R-2) or (R-3) to silver halides, there may be mentioned, for example, cyclic thioamido groups, such as 4-thiaozline-2-thione, 4-imidaozline-2-thione, 2-thiohydantoin, rhodanine, thiobarbituric acid, tetrazoline-5-thione, 1,2,4-triazoline-3-thione, 1,3,4-oxazoline-2-thione, benzimidazoline-2-thione, benzoxazoline-2-thione, benzothiazoline- 2-thione, thiotriazine and 1,3-imidaozline-2-thione, linear thioamido groups, aliphatic mercapto groups, aromatic mercapto groups, heterocyclic mercapto groups (when a nitrogen atom is adjacent to the carbon atom bonded to —SH, the groups have the same meaning as the cyclic thioamido groups which are tautomers of the groups, and specific examples of the groups are the same as those mentioned above); disulfido bond-having groups, 5-membered or 6-membered nitrogen-containing heterocyclic groups composed of a combination of nitrogen, oxygen, sulfur and carbon atoms, such as benzotriazoles, triazoles, tetrazoles, indazoles, benzimidazoles, imidazoles, benzothiazoles, thiazoles, thiazolines, benzoxazolines, oxazoles, oxazolines, thiadiazoles, oxathiazoles, triazines, azaindenes, as well as heterocyclic quaternary salts, such as, benzimidazoliums.

These groups may further be substituted by pertinent substituent(s), if desired.

As examples of the substituents, those mentioned above for the group R$_1$ may be used.

Specific, non-limiting examples of the compounds of the above-mentioned formulae which are employable in the present invention are set forth in the following formulae:

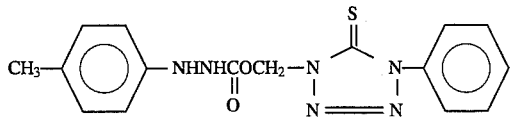

B-1

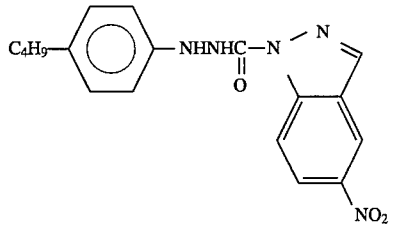

B-2

-continued
B-3
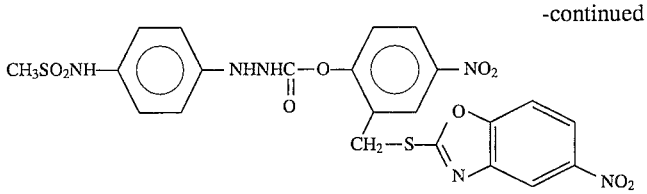
B-4
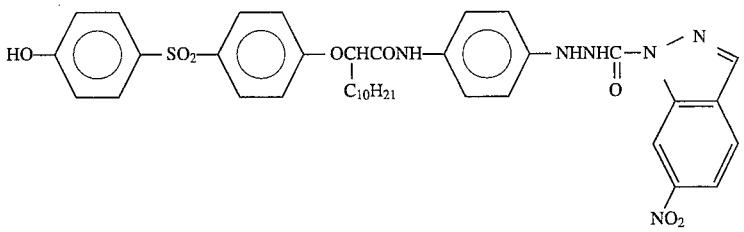
B-5
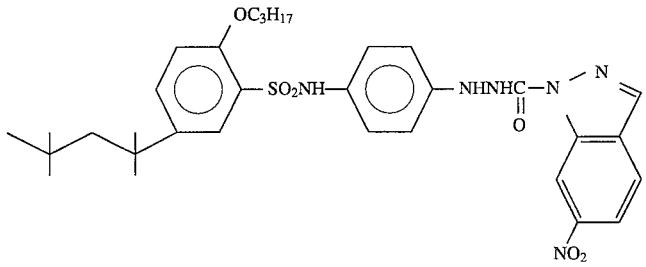
B-6
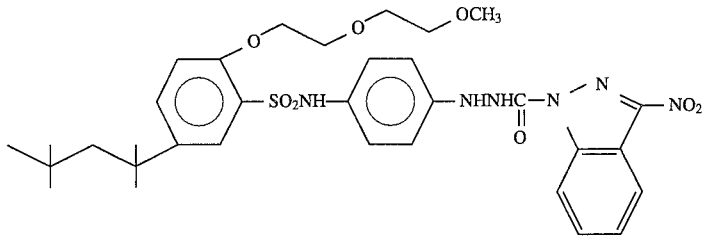
B-7
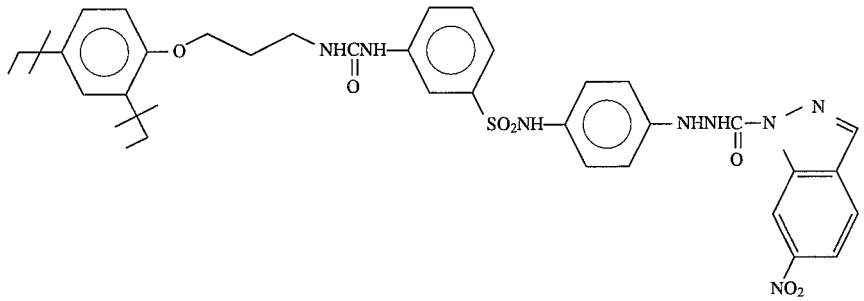
B-8
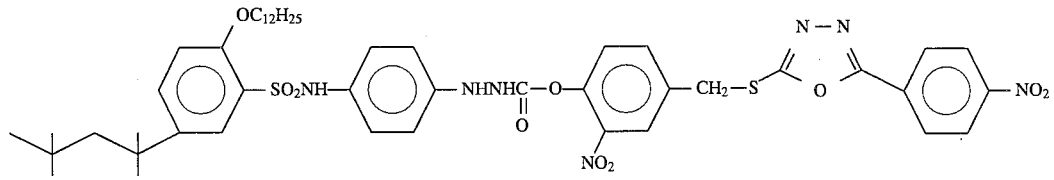
B-9
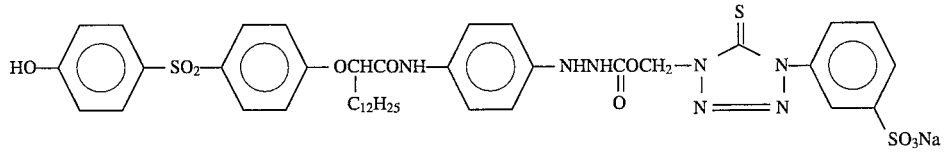

-continued
B-10
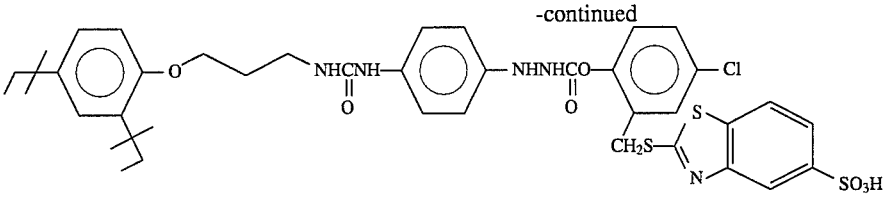
B-11
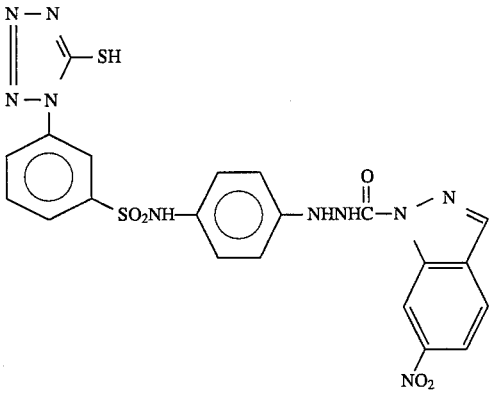
B-12
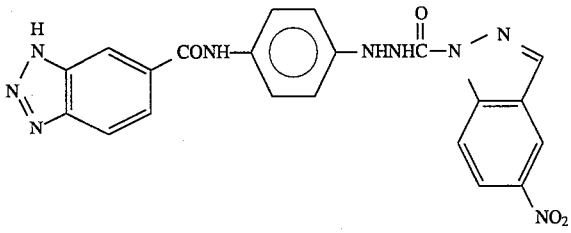
B-13
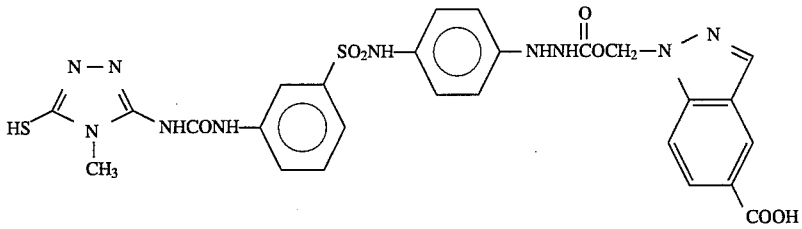
B-14
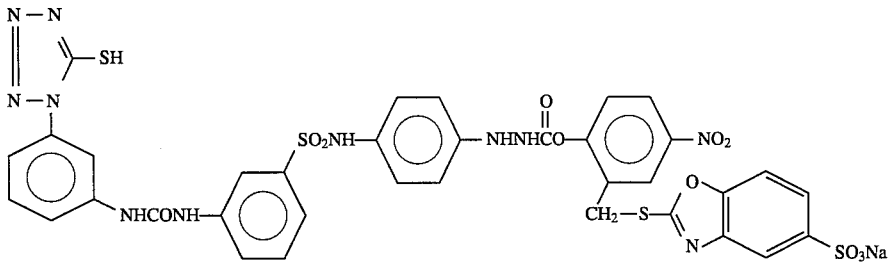

-continued
B-15
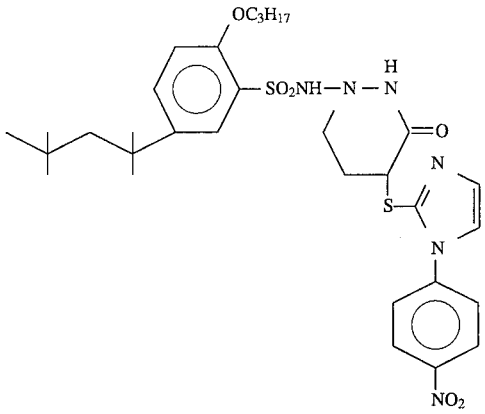
B-16
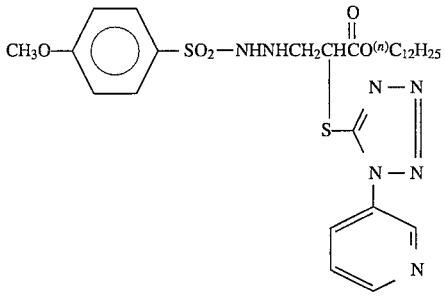
B-17
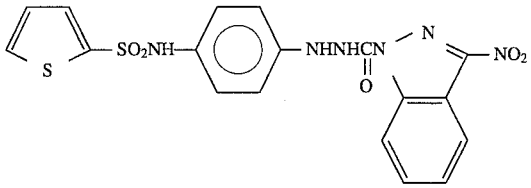
B-18
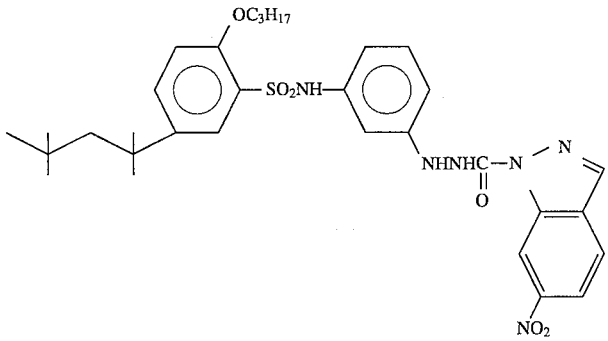
B-19
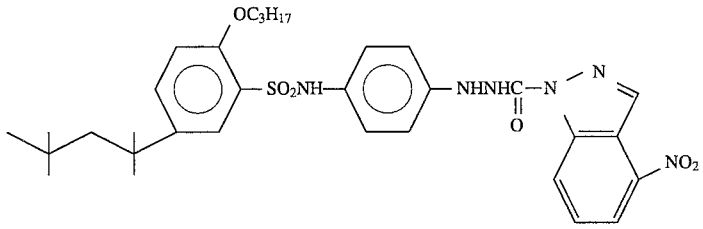

-continued

B-20

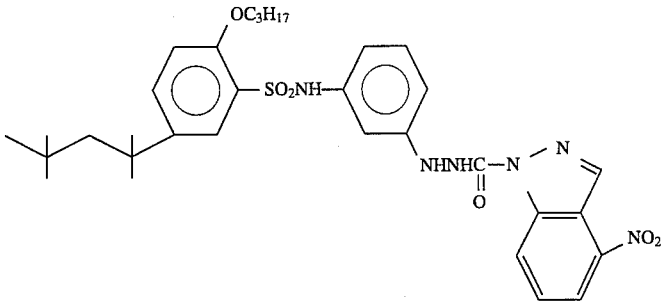

Comparative Compound (a):

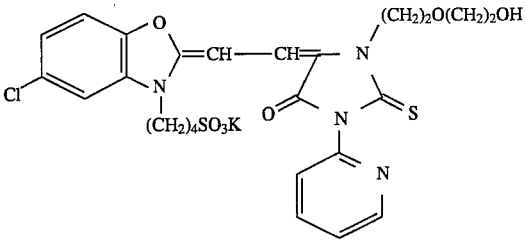

Comparative Compound (b):

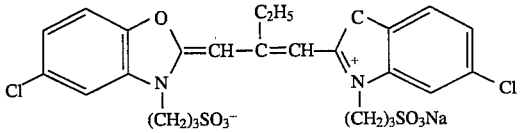

Compound (c):

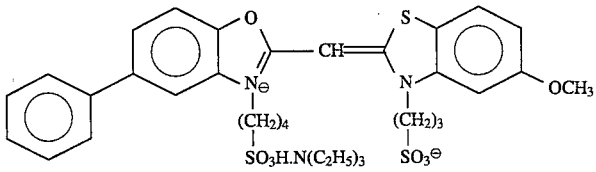

Compound (d):

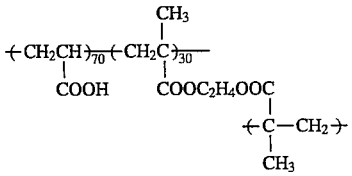

Amine Compound:

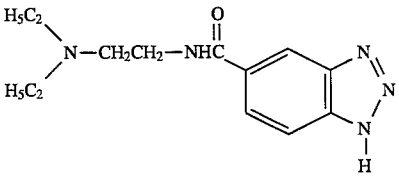

As redox compounds, usable in the present invention, in addition to those mentioned above, there may be mentioned the compounds described in JP-A-2-301743 (especially, Compounds 1 to 50), Compounds 1 to 75 of the general formulae (R-1), (R-2) and (R-3) described in JP-A-3-174143, and the compounds described in European Patent Laid-Open No. 495,477.

Methods of preparing the redox compounds usable in the present invention are described, for example, in JP-A-61-213847, JP-A-62-260153, U.S. Pat. Nos. 4,684,604, 3,379,529, 3,620,746, 4,377,634, 4,332,878, and JP-A-49129536, JP-A-56-153336, JP-A-56-153342 and JP-A-1-269936.

The content of redox compound(s) to be used in the photographic material of the present invention may be from $1\times10^{-8}$ to $5\times10^{-2}$ mol, and more preferably from $1\times10^{-5}$ to $1\times10^{-2}$ mol per mol of silver halide in the material.

The redox compound may be incorporated in the photographic material of the present invention, by being dissolved in a suitable water-miscible organic solvent, for example, alcohols (e.g., methanol, ethanol, propanol, fluorinated alcohols), ketones (e.g., acetone, methyl ethyl ketone), dimethylformamide, dimethylsulfoxide, or methyl cellosolve.

The compound may also be mechanically formed into an emulsified dispersion by means of a well known emulsifying and dispersing method which uses an oil such as dibutyl phthalate, tricresyl phosphate, glyceryl triacetate or diethyl phthalate and an auxiliary solvent such as ethyl acetate or cyclohexanone. As still another means, powder of the redox compound may be dispersed in water by the use of a ball mill or colloid mill or by the action of ultrasonic waves, by means well-known for forming solid dispersions.

The layer which contains a redox compound of the present invention may contain silver halide emulsion grains and/or a hydroxy derivative. Said layer may be another hydrophilic colloid layer.

As an example of including a hydrazine derivative in the photographic emulsion layer, and including a redox compound in a different hydrophilic colloid layer, the photographic material of European Patent Laid-Open No. 395,069 may be referred to as an example.

The layer containing the redox compound may be either above or below the photographic emulsion layer containing a hydrazine nucleating agent. The layer containing the redox compound may further contain light-sensitive or non-light-sensitive silver halide emulsion grains. There may be provided, between the layer containing the redox compound and the photographic emulsion layer containing a hydrazine nucleating agent, an interlayer containing a gelatin or synthetic polymer (e.g., polyvinyl acetate, polyvinyl alcohol).

As a binder or protective colloid in photographic emulsions constituting the photographic materials of the present invention, gelatin is advantageously used. Additionally, any other hydrophilic colloids may also be used. For instance, there may be used proteins, such as, gelatin derivatives, graft polymers of gelatin and other polymers, albumin and casein; cellulose derivatives, such as, hydroxyethyl cellulose, carboxymethyl cellulose, and cellulose sulfates; saccharide derivatives such as sodium alginate and starch derivatives; as well as other various synthetic hydrophilic homopolymers or copolymers such as polyvinyl alcohol, polyacrylic acid, polymethacrylic acid, polyacrylamide, polyvinylimidazole and polyvinyl butyral.

In order to obtain ultra-hard photographic images with high sensitivity, using the silver halide photographic material of the present invention, it is unnecessary to use a conventional, infectious developer or a high alkali developer having a pH value of about 13 as described in U.S. Pat. No. 2,419,975, but all stable developers are generally useful.

Precisely, the silver halide photographic material of the present invention can be processed with a developer containing, as a preservative, sulfite ions in an amount of 0.15 mol/liter or more and having a pH value of from 9.6 to 11.0 to give a sufficiently ultra-hard negative image.

The developing agent to be used in the developer which is used in processing the photographic material of the present invention need not be specifically defined, but the developer desirably contains dihydroxybenzenes in order to easily form hard images having a good dot quality. As an example, a combination of dihydroxybenzenes and 1-phenyl-3-pyrazolidones, or a combination of dihydroxybenzenes and p-aminophenols may also be employed.

As examples of dihydroxybenzene developing agents usable for processing the photographic materials of the present invention, there may be mentioned hydroquinone, chlorohydroquinone, bromohydroquinone, isopropylhydroquinone, methylhydroquinone, 2,3-dichlorohydroquinone, 2,5-dichlorohydroquinone, 2,3-dibromohydroquinone, and 2,5-dimethylhydroquinone. Especially preferred is hydroquinone.

1-Phenyl-3-pyrazolidone and derivatives thereof may also be used as developing agents in the present invention. Examples thereof include 1-phenyl-3-pyrazolidone, 1-phenyl-4,4-dimethyl-4-pyrazolidone, 1-phenyl- 4-methyl-4-hydroxymethyl-3-pyrazolidone, 1-phenyl- 4,4-dihydroxymethyl-3-pyrazolidone, 1-phenyl-5-methyl-3-pyrazolidone, 1-p-aminophenyl-4,4-dimethyl-3-pyrazolidone, and 1-p-tolyl-4,4-dimethyl-3-pyrazolidone.

As examples of p-aminophenol developing agents also usable in the present invention, there may be mentioned N-methyl-p-aminophenol, p-aminophenol, N-(β-hydroxyethyl)-p-aminophenol, N-(4-hydroxyphenyl)glycine, 2-methyl-p-aminophenol, and p-benzylaminophenol. Above all, preferred is N-methyl-p-aminophenol.

The amount of the developing agent to be used in the developer for use in the present invention is generally, preferably from 0.05 mol/liter to 0.8 mol/liter. Where a combination of dihydroxybenzenes and 1-phenyl-3-pyrazolidones or p-aminophenols is employed, it is preferred that the content of the former in the developer be from 0.05 mol/liter to 0.5 mol/liter, and that of the latter therein be 0.06 mol/liter or less.

The developer for use in the present invention can contain, as a preservative, a sulfite such as sodium sulfite, potassium sulfite, lithium sulfite, ammonium sulfite, sodium bisulfite, potassium metabisulfite or formaldehyde-sodium bisulfite. The content of such a sulfite is preferably 0.15 mol/liter or more, and it is especially preferred to use 0.3 mol/liter or more. The upper limit of the sulfite content is desirably up to about 2.5 mol/liter.

The developer may contain an alkali agent for the purpose of properly adjusting the pH value thereof. As such an alkali agent, usable is a pH adjusting agent or a pH buffer, such as sodium hydroxide, potassium hydroxide, sodium carbonate, potassium carbonate, sodium tertiary phosphate, or potassium tertiary phosphate. The pH value of the developer is accordingly adjusted to fall between 9.6 and 11.0.

The developer may further contain additives other than the above-mentioned components. Such additives include, for example, a development inhibitor such as boric acid, borax, sodium bromide, potassium bromide or potassium iodide; an organic solvent such as ethylene glycol, diethylene glycol, triethylene glycol, dimethylformamide, methyl cellosolve, hexylene glycol, ethanol or methanol; an antifoggant or black pepper inhibitor such as indazole compounds (e.g., 1-phenyl-5-mercaptotetrazole, 5-nitroindazole) or benzotriazole compounds (e.g., 5-methylbenzotriazole); and optionally a color toning agent, a surfactant, a defoaming agent, a water softener, a hardening agent, and amino compounds described in JP-A-56-106244.

The developer for use in the present invention can contain, as a silver stain inhibitor, compounds described in JP-A-56-24347. As a dissolution aid to be added to the developer, compounds described in JP-A-61-267759 can be used. Additionally, as a pH buffer to be added to the developer, compounds described in JP-A-60-93433 and JP-A-62-186259 can also be used.

As a fixing agent to be used in processing the developed photographic materials of the present invention, any and every conventional one can be used. For instance, thiosulfates and thiocyanates and other organic sulfur compounds which are known effective as a fixing agent can be used. The fixer to be used in the present invention can contain, as a hardening agent, a water-soluble aluminium compound (e.g., aluminium sulfate, alum). The amount of the water-soluble aluminium salt to be in the fixer may be generally from 0.4 to 2.0 g(Al)/liter. Additionally, the fixer may also contain, as an oxidizing agent, a ferric compound, such as an ethylenediaminetetraacetate/ferric complex.

The development temperature is selected from the range between 18° C. and 50° C., and more preferably between 25° C. and 43° C.

While all possible additives which may be added to the photographic material of the present invention used not be specifically defined, the following additives are examples of additives preferably used in the present invention:

| Additive | Examples |
|---|---|
| 1) Nucleation accelerator | Compounds of formulae (I), (II), (III), (IV), (V) and (V) of Japanese Patent Application No. 4-237366; Compounds of formulae (II-m) to (II-p) and Compounds II-1 to II-22 described in JP-A-2-103536, from page 9, right top column, line 13 to page 16, left top column, line 10; Compounds described in JP-A-1-179939 |
| 2) Surfactant; Antistatic agent | Compounds described in JP-A-2-12236, page 9, from right top column, line 7 to right bottom column, line 7; Compounds described in JP-A-2-18542, from page 2, left bottom column, line 13 to page 4, right bottom column, line 18 |
| 3) Antifoggant, Stabilizer | Compounds described in JP-A-2-103536, from page 17, right bottom column, line 19 to page 18, right top column, line 4, and page 18, right bottom column, lines 1 to 5; Thiosulfinic acid compound described in JP-A-1-237538 |
| 4) Polymer latex | Compounds described in JP-A-2-103536, page 18, left bottom column, lines 12 to 20 |
| 5) Acid group-having compound | Compounds described in JP-A-2-103536, from page 8, right bottom column, line 5 to page 19, left top column, line 1; Compounds described in JP-A-2-55349, from page 8, right bottom column, line 13 to page 11, left top column, line 8 |
| 6) Mat agent; Lubricant; Plasticizer | Compounds described in JP-A-2-103536, page 19, from left top column, line 15 to right top column, line 15 |
| 7) Hardening agent | Compounds described in JP-A-2-103536, page 18, right top column, lines 5 to 17 |
| 8) Dye | Compounds described in JP-A-2-103536, page 17, right bottom column, lines 1 to 18; Compounds described in JP-A-2-39042, from page 4, right top column, line 1 to page 6, right top column, line 5; Solid dyes described in JP-A-2-294638 and JP-A-5-11382. |
| 9) Binder | Compounds described in JP-A-2-18542, page 3, right bottom column, lines 1 to 20 |
| 10) "Black pepper" inhibiting agent | Compounds described in U.S. Pat. No. 4,956,257 Compounds described in JP-A-1-118832 |
| 11) Monomethine compound | Compounds of formula (II) (especially, Compounds II-1 to II-26) described in JP-A-2-287532 |
| 12) Dihydroxy-benzene compound | Compounds described in JP-A-3-39948, from page 11, left top column to page 12, left bottom column; Compounds described in EP 452,772A |

The present invention will now be explained in more detail by means of the following examples, which, however, are not intended to restrict the scope of the present invention.

EXAMPLE 1

Various emulsions were prepared in the manner mentioned below.

Preparation of Emulsion (A):

An aqueous 0.13M silver nitrate solution and an aqueous halide solution containing $1.5\times10^{-7}$ mol per mol of silver of $K_2Rh(H_2O)Cl_5$ and $2\times10^{-7}$ mol per mol of silver of $K_3IrCl_6$ and containing 0.04M of potassium bromide and 0.09M of sodium chloride were added to an aqueous gelatin solution containing sodium chloride and 1,3-dimethyl-2-imidazolidinethione, with stirring at 38° C. over a period of 12 minutes, by a double jet method, to form silver chlorobromide grains having a mean grain size of 0.14 μm and a silver chloride content of 70 mol % by nucleation. Subsequently, an aqueous 0.87M silver nitrate solution and an aqueous halide solution containing 0.26M of potassium bromide and 0.65M of sodium chloride were added thereto by the same double jet method over a period of 20 minutes.

In the same manner as above, Emulsions (B) to (D) were prepared, as shown in Table 1below.

Next, $1\times10^{-3}$ mol of KI solution was added to each emulsion for halogen-conversion, and the resulting emulsion was washed with water by conventional flocculation. 40 g of gelatin per mol of silver was added thereto, and the resulting emulsion was adjusted to have pH of 6.5 and pAg of 7.5. The emulsion was then adjusted to a temperature of 60° C. To the emulsion was added the sensitizing dye of the present invention, which is shown in Table 2 below, or the following comparative compound (x). In addition, 7 mg per mol of silver of sodium benzenethiosulfonate, 2 mg of benzenesulfinic acid, 8 mg of chloroauric acid, 200 mg of potassium thiocyanate and 5 mg of sodium thiosulfate were added to the emulsion, which was then heated at 60° C. for 45 minutes for chemical sensitization. As a stabilizer, 150 mg of 4-hydroxy-6-methyl- 1,3,3a,7-tetrazaindene was added thereto. In addition, 100 mg of proxel was added thereto as an antiseptic. The grains thus formed were cubic silver iodochlorobromide grains having a mean grain size of 0.25 μm and a silver chloride content of 69.9 mol %. The emulsions thus formed had a grain size fluctuation coefficient of 10%.

Preparation of Emulsion (E):

An aqueous 0.13M silver nitrate solution and an aqueous halide solution containing $1.5\times10^{-7}$ mol per mol of silver of $K_2Rh(H_2O)Cl_5$ and $2\times10^{-7}$ mol per mol of silver of $K_3IrCl_6$ and containing 0.09M of potassium bromide and 0.04M of sodium chloride were added to an aqueous gelatin solution containing sodium chloride and 1,3-dimethyl-2-imidazolidinethione, with stirring at 38° C. over a period of 12 minutes, by a double jet method, to form silver chlorobromide grains having a mean grain size of 0.14 μm and a silver chloride content of 30 mol % by nucleation. Subsequently, an aqueous 0.87M of silver nitrate solution and an aqueous halide solution containing 0.61M of potassium bromide and 0.30M of sodium chloride were added thereto by the same double jet method over a period of 20 minutes.

Next, $1\times10^{-3}$ mol of KI solution was added to the silver halide emulsion for halogen-conversion, and the resulting emulsion was washed with water by conventional flocculation. 40 g per mol of silver of gelatin was added thereto, the resulting emulsion was adjusted to have pH of 6.5 and pAg of 7.5. The emulsion was then adjusted at a temperature of 60° C. To the emulsion was added the sensitizing dye of the present invention, which is shown in Table 2 below, or the following comparative compound (x). In addition, 7 mg per mol of silver of sodium benzenethiosulfonate, 2 mg of benzenesulfinic acid, 8 mg of chloroauric acid, 200 mg of potassium thiocyanate and 5 mg of sodium thiosulfate were added to the emulsion, which was then heated at 60° C. for 45 minutes for chemical sensitization. As a stabilizer, 150 mg of 4-hydroxy-6-methyl- 1,3,3a,7-tetrazaindene was added thereto. In addition, 100 mg of proxel was added thereto as an antiseptic. The grains thus formed were cubic silver iodochlorobromide grains having a mean grain size of 0.25 μm and a silver chloride content of 29.9 mol %. The emulsion had a grain size fluctuation coefficient of 10%.

Comparative Compound (x):

-continued

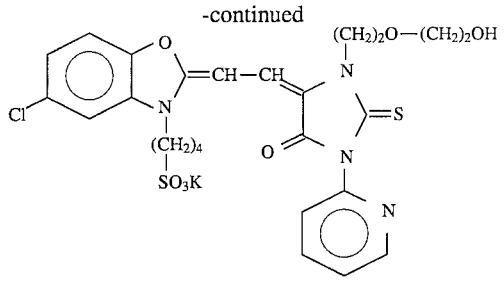

Preparation of Coated Photographic Material Samples:

To each emulsion prepared above, there were added $3\times10^{-4}$ mol per mol of silver of the following mercapto compound (a), $4\times10^{-4}$ mol per mol of silver of the following mercapto compound (b), $4\times10^{-4}$ mol per mol of silver of the following triazine compound (c), $2\times10^{-3}$ mol per mol of silver of 5-chloro-8-hydroxyquinoline, $3\times10^{-4}$ mol per mol of silver of the following compound (d) and $5\times10^{-3}$ mol per mol of silver of the hydrazine derivative as indicated in Table 2. In addition, 30 mg/m$^2$ of N-oleyl-N-methyltaurin was added thereto. Further, 200 mg/m$^2$ of the following water-soluble latex (e), 200 mg/m$^2$ of a dispersion of polyethyl acrylate, the following nucleation accelerators (1) to (6) in an amount stated therein and 200 mg/m$^2$ of latex copolymer comprising methyl acrylate, sodium 2-acrylamido- 2-methylpropanesulfonate and 2-acetoacetoxyethyl methacrylate (88/5/7, by weight), and, as a hardening agent, 200 mg/m$^2$ of 1,3-divinylsulfonyl-2-propanol were added to each emulsion. The pH of each emulsions was adjusted at 6.0. Each of them was then coated on a subbed polyethylene terephthalate film in an amount of 3.0 g/m$^2$ as silver.

The above mentioned formulae are as follows:

Mercapto compound (a)

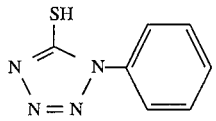

Mercapto compound (b)

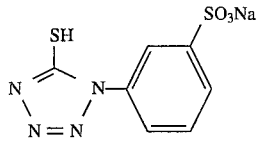

Triazine compound (c)

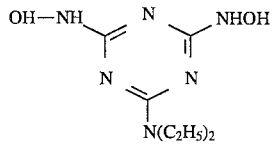

Compound (d)

-continued
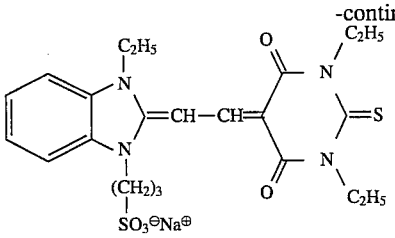
Water-soluble latex (e)
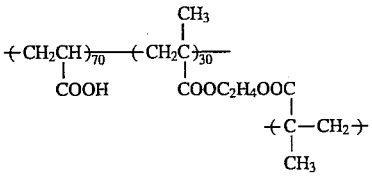
Nucleation Accelerator (1):
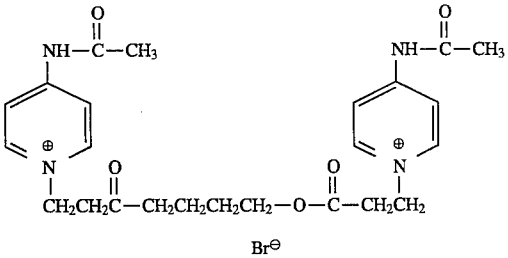
10 mg/m²
Nucleation Accelerator (2):
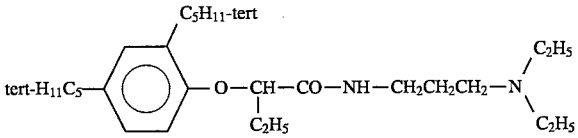
10 mg/m²
Nucleation Accelerator (3):
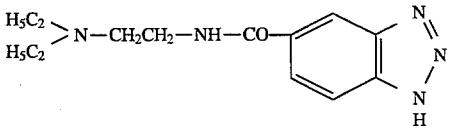
10 mg/m²
Nucleation Accelerator (4):
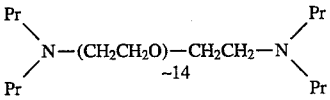
10 mg/m²
Nucleation Accelerator (5):
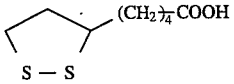
10 mg/m²
Nucleation Accelerator (6):
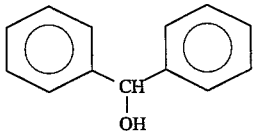
10 mg/m²

Over the emulsion layer thus coated, there was coated a protective layer comprising 1.0 g/m$^2$ of gelatin, 40 mg/m$^2$ of amorphous $SiO_2$ mat agent having a mean grain size of about 3.5 μm, 0.1 g/m$^2$ of methanol silica, 100 mg/m$^2$ of polyacrylamide, 200 mg/m$^2$ of hydroquinone, 20 mg/m$^2$ of silicone oil, and, as coating aids, 5 mg/m$^2$ of the following fluorine-containing surfactant (f) and 100 mg/m$^2$ of sodium dodecylbenzenesulfonate.

F-containing Surfactant (f):

$$C_8F_{17}SO_2\underset{\underset{C_3H_7}{|}}{N}CH_2COOK \qquad (f)$$

Thus, coated photographic material samples as shown in Table 2 were prepared.

The samples each had the following backing layer and backing layer-protecting layer.

| Composition of Backing Layer: | |
|---|---|
| Gelatin | 3 g/m$^2$ |
| Polyethyl Acrylate Latex | 2 g/m$^2$ |
| Surfactant (Sodium P-dodecylbenzenesulfonate) | 40 mg/m$^2$ |
| Gelatin Hardening Agent | |
| $CH_2{=}CHSO_2CH_2CONH{-}$ / $(CH_2)_2$ / $CH_2{=}CHSO_2CH_2CONH{-}$ | 110 mg/m$^2$ |
| $SnO_2$/Sb (90/10, by weight; mean grain size 0.20 μm) | 200 mg/m$^2$ |
| Dye Mixture of (a), (b) and (c) | |
| (a) 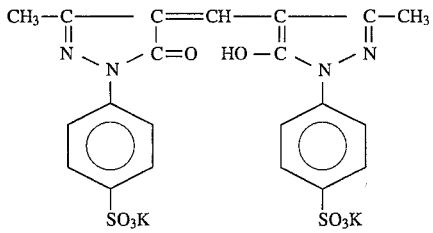 | 50 mg/m$^2$ |
| (b) 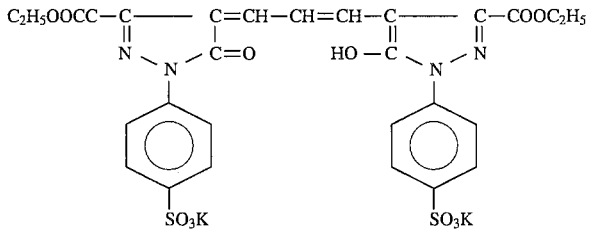 | 100 mg/m$^2$ |
| (c) 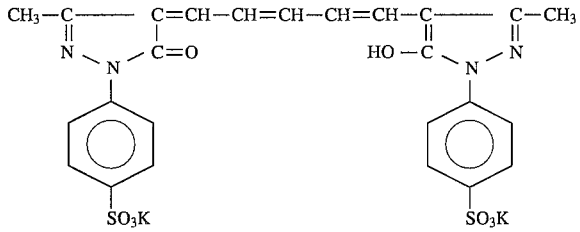 | 50 mg/m$^2$ |
| **Composition of Backing Layer-protecting Layer:** | |
| Gelatin | 0.8 mg/m$^2$ |
| Fine Polymethyl Methacrylate Grains (mean grain size 4.5 μm) | 30 mg/m$^2$ |
| Sodium Dihexyl-α-sulfosuccinate | 15 mg/m$^2$ |
| Sodium P-Dodecylbenzenesulfonate | 15 mg/m$^2$ |
| Sodium Acetate | 40 mg/m$^2$ |

TABLE 1

| Emulsion | Halide Composition | $K_2Rh(H_2O)Cl_5$ Position in Grains | $K_2Rh(H_2O)Cl_5$ Amount Added (mol/mol of Ag) | $K_3IrCl_6$ Position in Grains | $K_3IrCl_6$ Amount Added (mol/mol of Ag) |
|---|---|---|---|---|---|
| A | $AgBr_{30}Cl_{69.9}I_{0.1}$ | core | $1.5 \times 10^{-7}$ | core | $2 \times 10^{-7}$ |
| B | $AgBr_{30}Cl_{69.9}I_{0.1}$ | core | $1.5 \times 10^{-7}$ | shell | $2 \times 10^{-7}$ |
| C | $AgBr_{30}Cl_{69.9}I_{0.1}$ | core/shell | $1.5 \times 10^{-7}$ | core/shell | $2 \times 10^{-7}$ |
| D | $AgBr_{30}Cl_{69.9}I_{0.1}$ | — | — | — | — |
| E | $AgBr_{70}Cl_{29.9}I_{0.1}$ | core | $1.5 \times 10^{-7}$ | core | $2 \times 10^{-7}$ |

Each of the photographic material samples, thus prepared, was exposed to a tungsten light through an optical step wedge and processed with an automatic developing machine FG-680A Model (manufactured by Fuji Photo Film Co.) at 38° C. for 30 seconds, using the developers mentioned below and a fixer of GR-F1 (produced by Fuji Photo Film Co.). The photographic properties of the thus processed samples were measured and are shown in Table 2 below.

The sensitivity as referred to herein indicates a relative value of the reciprocal of an exposure amount of giving a density of 1.5 by 30 second development at 38° C., based on sample No. 1 as developed with Developer 1 to have a standard sensitivity of being 100.

The "γ" value as referred to herein is defined by the following formula:

$$\gamma=(3.0-0.3)/[\log(\text{exposure amount of giving density } 3.0)-\log(\text{exposure amount of giving density } 0.3)]$$

Regarding formation of "black peppers", the background part of each sample as developed at 38° C. for 30 seconds was observed with a microscope, whereupon the observed part was evaluated by a "5-rank" evaluation. Precisely, "5" is the best and "1" is the worst. "5" and "4" indicate practical samples; "3" indicates an inferior sample which is practicable with difficulty; and "2" and "1" indicate impractical samples.

Developer 1:

| Replenisher: | |
|---|---|
| Sodium 1,2-Dihydroxybenzene-3,5-disulfonate | 0.5 g |
| Diethylenetriamine-pentaacetic Acid | 2.0 g |
| Sodium Carbonate | 5.0 g |
| Boric Acid | 10.0 g |
| Potassium Sulfite | 85.0 g |
| Sodium Bromide | 6.0 g |
| Diethylene Glycol | 40.0 g |
| 5-Methylbenzotriazole | 0.2 g |
| Hydroquinone | 30.0 g |
| 4-Hydroxymethyl-4-methyl-1-phenyl-3-pyrazolidone | 1.6 g |
| 2,3,5,6,7,8-Hexahydro-2-thioxo-4-(1H)-quinazolinone | 0.09 g |
| Sodium 2-Mercaptobenzimidazole-5-sulfonate | 0.3 g |
| Potassium Hydroxide to make | pH 10.7 |
| Water to make | 1 liter |

-continued

| Starter: | |
|---|---|
| Acetic Acid (90%) | 366 g |
| Water to make | 1 liter |

10 ml of the starter was added to one liter of the replenisher to make Developer 1.

Developer 2:

| Concentrated Developer: | |
|---|---|
| Sodium Metabisulfite | 145 g |
| Potassium Hydroxide (45%) | 178 g |
| Pentasodium Diethylenetriamine-pentaacetate | 15 g |
| Sodium Bromide | 12 g |
| Hydroquinone | 65 g |
| 1-Phenyl-4-hydroxymethyl-4-methyl-3-pyrazolidone | 2.9 g |
| Benzotriazole | 0.4 g |
| 1-Phenyl-5-mercaptotetrazole | 0.05 g |
| Sodium Hydroxide (50%) | 46 g |
| Boric Acid | 6.9 g |
| Diethylene Glycol | 120 g |
| Potassium Carbonate (47%) | 120 g |
| Water to make | 1 liter |

One part by weight of the concentrated developer was diluted with 2 parts by weight of water to make Developer 2 having pH of 10.5.

Developer 3:

Each of the exposed samples (having a black density of 100%) was developed with Developer 1 in an amount corresponding to 30 sheets of 20×24 inches size, without replenishing the fresh replenisher thereto.

The fatigued Developer 1, after the running operation, is Developer 3.

Developer 4:

Developer 1 was left at 38° C. for one month. The aged Developer 1 after the storage is Developer 4.

TABLE 2

| Sample No. | Emulsion | Dye | Hydrazine Derivative | Developer 1 Sensitivity | Developer 1 γ | Developer 2 Sensitivity | Developer 2 γ | Developer 3 Sensitivity | Developer 3 γ | Developer 4 "Black peppers" | Remarks |
|---|---|---|---|---|---|---|---|---|---|---|---|
| 1 | A | 1-Q | Compound 4-1 | 100 | 19 | 102 | 19 | 96 | 18 | 5 | Sample of the Invention |
| 2 | A | 1-S | Compound 4-1 | 98 | 18 | 100 | 19 | 95 | 17 | 4 | Sample of the Invention |
| 3 | A | 2-B | Compound 4-1 | 102 | 19 | 103 | 20 | 97 | 18 | 4 | Sample of the Invention |
| 4 | A | 3-16 | Compound 4-1 | 102 | 19 | 101 | 20 | 98 | 18 | 4 | Sample of the Invention |
| 5 | A | 1-Q | Compound 4-3 | 102 | 18 | 104 | 18 | 98 | 16 | 5 | Sample of the Invention |
| 6 | A | 1-Q | Compound 4-10 | 102 | 18 | 103 | 18 | 98 | 16 | 5 | Sample of the Invention |
| 7 | A | 1-Q | Compound 5-39 | 98 | 17 | 98 | 18 | 97 | 17 | 4 | Sample of the Invention |
| 8 | A | 1-B | Compound 6-1 | 103 | 17 | 102 | 18 | 97 | 17 | 4 | Sample of the Invention |
| 9 | A | 3-16 | Compound 4-1 | 98 | 18 | 98 | 18 | 95 | 17 | 4 | Sample of the Invention |
| 10 | C | 3-16 | Compound 4-1 | 96 | 19 | 98 | 18 | 93 | 18 | 4 | Sample of the Invention |
| 11 | D | 3-16 | Compound 4-1 | 140 | 15 | 120 | 12 | 105 | 12 | 2 | Comparative Sample |
| 12 | E | 3-16 | Compound 4-1 | 120 | 18 | 102 | 14 | 90 | 13 | 2 | Comparative Sample |
| 13 | A | comparative dye | Compound 4-1 | 105 | 17 | 87 | 17 | 80 | 13 | 1 | Comparative Sample |

EXAMPLE 2

Emulsions were prepared in the manner as mentioned below.

Preparation of Emulsion (A):

An aqueous 0.13M silver nitrate solution and an aqueous halide solution containing 0.09M of sodium chloride were added to an aqueous gelatin solution containing sodium chloride and 1,3-dimethyl-2-imidazolidimethione, with stirring at 38° C. over a period of 12 minutes, by a double jet method, to form silver chlorobromide core grains having a mean grain size of 0.14 μm and silver chloride content of 70 mol %. Subsequently, an aqueous 0.87M silver nitrate solution and an aqueous halide solution containing 0.26M of sodium bromide were added by the same double jet method over a period of 20 minutes to form silver halide grains having core/shell structure.

In the same manner as above, silver halide grains containing various different metals in core/shell were formed by changing the metal complex salts contained in the aqueous halide solution which are added to form core/shell grains.

For instance, in Emulsion B, $1\times10^{-7}$ mol per mol of silver of $K_2Rh(H_2O)Cl_5$ there was added in an aqueous halide solution when the core is formed, to form silver halide grains. The silver halide grains, thus formed, are shown in Table 4.

Next, $1\times10^{-3}$ mol of KI solution was added to each emulsion for halogen-conversion, and the resulting emulsion was washed with water by conventional flocculation. 40 g of gelatin per mol of silver was added thereto, and the resulting emulsion was adjusted to have pH of 6.5 and pAg of 7.5. The emulsion was then adjusted at a temperature of 60° C. To the emulsion was added the sensitizing dye of the present invention, which is shown in Table 4 below. In addition, 7 mg per mol of silver of sodium benzenethiosulfonate, 2 mg of benzenesulfinic acid, 8 mg of chloroauric acid, 200 mg of potassium thiocyanate and 5 mg of sodium thiosulfate were added to the emulsion, which was then heated at 60° C. for 45 minutes for chemical sensitization. As a stabilizer, 150 mg of 4-hydroxy-6-methyl-1,3,3a,7-tetrazaindene was added thereto. In addition, 100 mg of proxel was added thereto as an antiseptic. The grains thus formed were cubic silver iodochlorobromide grains having a mean grain size of 0.25 μm and a silver chloride content of 69.9 mol %. The emulsions thus formed had a grain size fluctuation coefficient of 10%.

TABLE 3

| Emulsion | Halogen Composition | Core Compound | Core Amount Added (mol/mol of Ag) | Shell Compound | Shell Amount Added (mol/mol of Ag) |
|---|---|---|---|---|---|
| A | $AgBr_{30}Cl_{69.9}I_{0.1}$ | — | — | — | — |
| B | $AgBr_{30}Cl_{69.9}I_{0.1}$ | $K_2Rh(H_2O)Cl_5$ | $1\times10^{-7}$ | — | — |
| C | $AgBr_{30}Cl_{69.9}I_{0.1}$ | $K_2RuCl_5(NO)$ | $1\times10^{-7}$ | — | — |
| D | $AgBr_{30}Cl_{69.9}I_{0.1}$ | $K_2ReBr_5(NS)$ | $1\times10^{-7}$ | — | — |
| E | $AgBr_{30}Cl_{29.9}I_{0.1}$ | $K_2OsCl_6$ | $1\times10^{-7}$ | — | — |
| F | $AgBr_{30}Cl_{69.9}I_{0.1}$ | $K_2RuCl_5(NO)$ | $1\times10^{-7}$ | $K_2RuCl_5(NO)$ | $1\times10^{-7}$ |

TABLE 3-continued

| Emulsion | Halogen Composition | Core Compound | Core Amount Added (mol/mol of Ag) | Shell Compound | Shell Amount Added (mol/mol of Ag) |
|---|---|---|---|---|---|
| G | $AgBr_{30}Cl_{69.9}I_{0.1}$ | $K_2ReBr_5(NS)$ | $1 \times 10^{-7}$ | $K_2ReBr_5(NS)$ | $1 \times 10^{-7}$ |
| H | $AgBr_{30}Cl_{69.9}I_{0.1}$ | $K_2OsCl_6$ | $1 \times 10^{-7}$ | $K_2OsCl_6$ | $1 \times 10^{-7}$ |
| I | $AgBr_{30}Cl_{69.9}I_{0.1}$ | $K_2RuCl_5(NO)$ | $1 \times 10^{-7}$ | — | — |
| | | $K_2IrCl_6$ | $2 \times 10^{-7}$ | — | — |
| J | $AgBr_{30}Cl_{69.9}I_{0.1}$ | $K_2ReBr_5(NS)$ | $1 \times 10^{-7}$ | — | — |
| | | $K_2IrCl_6$ | $2 \times 10^{-7}$ | — | — |
| K | $AgBr_{30}Cl_{69.9}I_{0.1}$ | $K_2OsCl_6$ | $1 \times 10^{-7}$ | — | — |
| | | $K_2IrCl_6$ | $2 \times 10^{-7}$ | — | — |
| L | $AgBr_{30}Cl_{69.9}I_{0.1}$ | $K_2RuCl_5(NO)$ | $1 \times 10^{-7}$ | $K_2RuCl_5(NO)$ | $1 \times 10^{-7}$ |
| | | $K_2IrCl_6$ | $2 \times 10^{-7}$ | $K_2IrCl_6$ | $2 \times 10^{-7}$ |
| M | $AgBr_{30}Cl_{69.9}I_{0.1}$ | $K_2ReBr_5(NS)$ | $1 \times 10^{-7}$ | $K_2ReBr_5(NS)$ | $1 \times 10^{-7}$ |
| | | $K_2IrCl_6$ | $2 \times 10^{-7}$ | $K_2IrCl_6$ | $2 \times 10^{-7}$ |
| N | $AgBr_{30}Cl_{69.9}I_{0.1}$ | $K_2OsCl_6$ | $1 \times 10^{-7}$ | $K_2OsCl_6$ | $1 \times 10^{-7}$ |
| | | $K_2IrCl_6$ | $2 \times 10^{-7}$ | $K_2IrCl_6$ | $2 \times 10^{-7}$ |
| O | $AgBr_{70}Cl_{69.9}I_{0.1}$ | $K_2RuCl_5(NO)$ | $1 \times 10^{-7}$ | — | — |

TABLE 4

| Sample No. | Emulsion | Dye | Hydrazine Derivative | Developer 1 Sensitivity | Developer 1 γ | Developer 2 Sensitivity | Developer 2 γ | Developer 3 Sensitivity | Developer 3 γ | Developer 4 "Black Peppers" |
|---|---|---|---|---|---|---|---|---|---|---|
| 1 | A | 3-16 | Compound 4-1 | 100 | 9 | 89 | 8 | 71 | 4 | 1 |
| 2 | B | 3-16 | Compound 4-1 | 79 | 17 | 76 | 17 | 68 | 15 | 3 |
| 3 | C | 3-16 | Compound 4-1 | 89 | 19 | 85 | 19 | 81 | 18 | 5 |
| 4 | D | 3-16 | Compound 4-1 | 85 | 18 | 84 | 19 | 79 | 17 | 4 |
| 5 | E | 3-16 | Compound 4-1 | 87 | 18 | 83 | 18 | 81 | 17 | 5 |
| 6 | F | 3-16 | Compound 4-1 | 90 | 18 | 87 | 18 | 81 | 17 | 4 |
| 7 | G | 3-16 | Compound 4-1 | 87 | 17 | 86 | 18 | 79 | 16 | 4 |
| 8 | H | 3-16 | Compound 4-1 | 89 | 17 | 85 | 17 | 81 | 16 | 5 |
| 9 | I | 3-16 | Compound 4-1 | 95 | 20 | 91 | 19 | 87 | 18 | 5 |
| 10 | J | 3-16 | Compound 4-1 | 92 | 19 | 90 | 19 | 85 | 17 | 5 |
| 11 | K | 3-16 | Compound 4-1 | 94 | 19 | 90 | 19 | 86 | 17 | 5 |
| 12 | L | 3-16 | Compound 4-1 | 96 | 19 | 93 | 18 | 88 | 17 | 4 |
| 13 | M | 3-16 | Compound 4-1 | 93 | 18 | 92 | 18 | 87 | 16 | 5 |
| 14 | N | 3-16 | Compound 4-1 | 95 | 18 | 93 | 18 | 88 | 17 | 4 |
| 15 | O | 3-16 | Compound 4-1 | 100 | 15 | 97 | 14 | 86 | 13 | 1 |
| 16 | I | 1-17 | Compound 4-1 | 93 | 19 | 91 | 19 | 88 | 18 | 5 |
| 17 | I | 1-19 | Compound 4-1 | 97 | 18 | 94 | 19 | 90 | 17 | 4 |
| 18 | I | 2-B | Compound 4-1 | 92 | 19 | 89 | 18 | 86 | 18 | 5 |
| 19 | I | 2-Q | Compound 4-1 | 90 | 19 | 87 | 18 | 84 | 18 | 5 |
| 20 | I | 3-H | Compound 4-1 | 91 | 19 | 88 | 18 | 85 | 18 | 5 |
| 21 | I | comparative dye | Compound 4-1 | 89 | 17 | 79 | 17 | 65 | 12 | 1 |
| 22 | I | 3-16 | Compound 4-1 | 95 | 20 | 92 | 19 | 90 | 18 | 5 |
| 23 | I | 3-16 | Compound 4-3 | 93 | 19 | 89 | 18 | 88 | 18 | 5 |
| 24 | I | 3-16 | Compound 5-39 | 92 | 19 | 90 | 19 | 87 | 18 | 4 |
| 25 | I | 3-16 | Compound 6-1 | 97 | 19 | 93 | 19 | 92 | 17 | 4 |

Preparation of Emulsion (O)

An aqueous 0.13M silver nitrate solution and an aqueous halide solution containing 0.09M of potassium bromide and 0.04M of sodium chloride were added to an aqueous gelatin solution containing sodium chloride and 1,3-dimethyl-2-imidazolidinethion, with stirring at 38° C. over a period of 12 minutes, by a double jet method, to form silver chlorobromide core grains having a mean grain size of 0.14 μm and silver chloride content of 30 mol %. Subsequently, an aqueous 0.87M silver nitrate solution and aqueous halide solution containing 0.61M potassium bromide and 0.30M sodium chloride were added by the same double jet method over a period of 20 minutes to form silver halide grains having core/shell structure.

On forming the core grains, $1\times10^{-7}$ mol per mol of silver of $K_2RuCl_5(NO)$ was added to the aqueous halide solution.

Next, $1\times10^{-3}$ mol of KI solution was added to each emulsion for halogen-conversion, and the resulting emulsion was washed with water by conventional flocculation. 40 g of gelatin per mol of silver was added thereto, and the resulting emulsion was adjusted to have pH of 6.5 and pAg of 7.5. The emulsion was then adjusted at a temperature of 60° C. To the emulsion was added the sensitizing dye of the present invention, which is shown in Table 5 below. In addition, 7 mg per mol of silver of sodium benzenethiosulfonate, 2 mg of benzenesulfinic acid, 8 mg of chloroauric acid, 200 mg of potassium thiocyanate and 5 mg of sodium thiosulfate were added to the emulsion, which was then heated at 60° C. for 45 minutes for chemical sensitization. As a stabilizer, 150 mg of 4-hydroxy-6-methyl-1,3,3a,7-tetrazaindene was added thereto. In addition, 100 mg of proxel was added thereto as an antiseptic. The grains thus formed were cubic silver iodochlorobromide grains having a mean grain size of 0.25 μm and a silver chloride content of 69.9 mol %. The emulsions thus formed had a grain size fluctuation coefficient of 10%.

Preparation of Coated PhotographicMaterial Samples:

Coated photographic material samples were prepared using the emulsions disclosed above in the same manner as of Example 1. The backing layer and backing protecting layer are also the same as in Example 1.

The samples, thus prepared, were evaluated, after being subjected to exposure and development treatment in the same manner as of Example 1. The results are shown in Table 6.

TABLE 5

| | | Core | | Shell | |
|---|---|---|---|---|---|
| Emulsion | AgX Composition | Compound | Amount (mol/mol of Ag) | Compound | Amount (mol/mol of Ag) |
| A | $AgBr_{30}Cl_{69.9}I_{0.1}$ | — | — | — | — |
| B | $AgBr_{30}Cl_{69.9}I_{0.1}$ | $K_2Rh(H_2O)Cl_5$ | $1 \times 10^{-7}$ | — | — |
| C | $AgBr_{30}Cl_{69.9}I_{0.1}$ | $K_2RuCl_5(NO)$ | $1 \times 10^{-7}$ | — | — |
| D | $AgBr_{30}Cl_{69.9}I_{0.1}$ | $K_3ReBr_5(NS)$ | $1 \times 10^{-7}$ | — | — |
| E | $AgBr_{70}Cl_{29.9}I_{0.1}$ | $K_2OsCl_6$ | $1 \times 10^{-7}$ | — | — |
| F | $AgBr_{30}Cl_{69.9}I_{0.1}$ | $K_2RuCl_5(NO)$ | $1 \times 10^{-7}$ | $K_2RuCl_5(NO)$ | $1 \times 10^{-7}$ |
| G | $AgBr_{30}Cl_{69.9}I_{0.1}$ | $K_2ReBr_5(NS)$ | $1 \times 10^{-7}$ | $K_2ReBr_5(NS)$ | $1 \times 10^{-7}$ |
| H | $AgBr_{30}Cl_{69.9}I_{0.1}$ | $K_2OsCl_6$ | $1 \times 10^{-7}$ | $K_2OsCl_6$ | $1 \times 10^{-7}$ |
| I | $AgBr_{30}Cl_{60.0}I_{0.1}$ | $K_2RuCl_5(NO)$ | $1 \times 10^{-7}$ | — | — |
| | | $K_2IrCl_6$ | $2 \times 10^{-7}$ | — | — |
| J | $AgBr_{30}Cl_{69.9}I_{0.1}$ | $K_2ReBr_5(NS)$ | $1 \times 10^{-7}$ | — | — |
| | | $K_2IrCl_6$ | $2 \times 10^{-7}$ | — | — |
| K | $AgBr_{30}Cl_{69.9}I_{0.1}$ | $K_2OsCl_6$ | $1 \times 10^{-7}$ | — | — |
| | | $K_2IrCl_6$ | $2 \times 10^{-7}$ | — | — |
| L | $AgBr_{30}Cl_{69.9}I_{0.1}$ | $K_2RuCl_5(NO)$ | $1 \times 10^{-7}$ | $K_2RuCl_5(NO)$ | $1 \times 10^{-7}$ |
| | | $K_2IrCl_6$ | $2 \times 10^{-7}$ | $K_2IrCl_6$ | $2 \times 10^{-7}$ |
| M | $AgBr_{30}Cl_{69.9}I_{0.1}$ | $K_2ReBr_5(NS)$ | $1 \times 10^{-7}$ | $K_2ReBr_5(NS)$ | $1 \times 10^{-7}$ |
| | | $K_2IrCl_6$ | $2 \times 10^{-7}$ | $K_2IrCl_6$ | $2 \times 10^{-7}$ |
| N | $AgBr_{30}Cl_{69.9}I_{0.1}$ | $K_2OsCl_6$ | $1 \times 10^{-7}$ | $K_2OsCl_6$ | $1 \times 10^{-7}$ |
| | | $K_2IrCl_6$ | $2 \times 10^{-7}$ | $K_2IrCl_6$ | $2 \times 10^{-7}$ |
| O | $AgBr_{70}Cl_{69.9}I_{0.1}$ | $K_2RuCl_5(NO)$ | $1 \times 10^{-7}$ | — | — |

TABLE 6

| Sample | | | Hydrazine | Developer 1 | | Developer 2 | | Developer 3 | | Developer 4 |
|---|---|---|---|---|---|---|---|---|---|---|
| No. | Emulsion | Dye | Derivative | Sensitivity | γ | Sensitivity | γ | Sensitivity | γ | "black peppers" |
| 1 | A | 3-16 | Compound 4-1 | 100 | 9 | 89 | 8 | 71 | 4 | 1 |
| 2 | B | 3-16 | Compound 4-1 | 79 | 17 | 76 | 17 | 68 | 15 | 3 |
| 3 | C | 3-16 | Compound 4-1 | 89 | 19 | 85 | 19 | 81 | 18 | 5 |
| 4 | D | 3-16 | Compound 4-1 | 85 | 18 | 84 | 19 | 79 | 17 | 4 |
| 5 | E | 3-16 | Compound 4-1 | 87 | 18 | 83 | 18 | 81 | 17 | 5 |
| 6 | F | 3-16 | Compound 4-1 | 90 | 18 | 87 | 18 | 81 | 17 | 4 |
| 7 | G | 3-16 | Compound 4-1 | 87 | 17 | 86 | 18 | 79 | 16 | 4 |
| 8 | H | 3-16 | Compound 4-1 | 89 | 17 | 85 | 17 | 81 | 16 | 5 |
| 9 | I | 3-16 | Compound 4-1 | 95 | 20 | 91 | 19 | 87 | 18 | 5 |
| 10 | J | 3-16 | Compound 4-1 | 92 | 19 | 90 | 19 | 85 | 17 | 5 |
| 11 | K | 3-16 | Compound 4-1 | 94 | 19 | 90 | 19 | 86 | 17 | 5 |
| 12 | L | 3-16 | Compound 4-1 | 96 | 19 | 93 | 18 | 88 | 17 | 4 |
| 13 | M | 3-16 | Compound 4-1 | 93 | 18 | 92 | 18 | 87 | 16 | 5 |
| 14 | N | 3-16 | Compound 4-1 | 95 | 18 | 93 | 18 | 88 | 17 | 4 |
| 15 | O | 3-16 | Compound 4-1 | 100 | 15 | 97 | 14 | 86 | 13 | 1 |
| 16 | I | 1-17 | Compound 4-1 | 93 | 19 | 91 | 19 | 88 | 18 | 5 |
| 17 | I | 1-19 | Compound 4-1 | 97 | 18 | 94 | 19 | 90 | 17 | 4 |
| 18 | I | 2-B | Compound 4-1 | 92 | 19 | 89 | 18 | 86 | 18 | 5 |
| 19 | I | 2-Q | Compound 4-1 | 90 | 19 | 87 | 18 | 84 | 18 | 5 |
| 20 | I | 3-H | Compound 4-1 | 91 | 19 | 88 | 18 | 85 | 18 | 5 |
| 21 | I | comparative dye | Compound 4-1 | 89 | 17 | 79 | 17 | 65 | 12 | 1 |
| 22 | I | 3-16 | Compound 4-1 | 95 | 20 | 92 | 19 | 90 | 18 | 5 |
| 23 | I | 3-16 | Compound 4-3 | 93 | 19 | 89 | 18 | 88 | 18 | 5 |
| 24 | I | 3-16 | Compound 5-39 | 92 | 19 | 90 | 19 | 87 | 18 | 4 |
| 25 | I | 3-16 | Compound 6-1 | 97 | 19 | 93 | 19 | 92 | 17 | 4 |

EXAMPLE 3

Preparation of Emulsions:

An aqueous 0.13M silver nitrate solution and an aqueous halide solution containing $1.5\times10^{-7}$ mol per mol of silver of $K_2Rh(H_2O)Cl_5$ and $2\times10^{-7}$ mol per mol of silver of $K_3IrCl_6$ and containing 0.04M of potassium bromide and 0.09M of sodium chloride were added to an aqueous gelatin solution containing sodium chloride and 1,3-dimethyl-2-imidazolidinethione, with stirring at 38° C. over a period of 12 minutes, by a double jet method, to form silver chlorobromide grains having a mean grain size of 0.14 μm and a silver chloride content of 70 mol % by nucleation. Subsequently, an aqueous 0.87M silver nitrate solution and an aqueous halide solution containing 0.26M of potassium bromide and 0.65M of sodium chloride were added thereto by the same double jet method over a period of 20 minutes.

Next, $1\times10^{-3}$ mol of KI solution was added to the emulsion for halogen-conversion, and the resulting emulsion was washed with water by conventional flocculation using isobutene/monosodium maleate copolymer as a flocculant. 40 g of gelatin per mol of silver was added thereto, and the resulting emulsion was adjusted to have a pH of 6.5 and pAg of 7.5. The emulsion was then adjusted at a temperature of 60° C. To the emulsion was added the sensitizing dye of the present invention, which is shown in Table 5 below, or the following comparative compound (a). In addition, 7 mg per mol of silver of sodium benzenethiosulfonate, 2 mg of benzenesulfinic acid, 8 mg of chloroauric acid, 200 mg of potassium thiocyanate and 5 mg of sodium thiosulfate were added to the emulsion, which was then heated at 60° C. for 45 minutes for chemical sensitization. As a stabilizer, 150 mg of 4-hydroxy-6-methyl-1,3,3a,7-tetrazaindene was added thereto. In addition, 100 mg of proxel was added thereto as an antiseptic. The grains thus formed were cubic silver iodochlorobromide grains having a mean grain size of 0.25 μm and a silver chloride content of 69.9 mol %. The emulsions thus formed had a grain size fluctuation coefficient of 10%.

Comparative Compound (a):

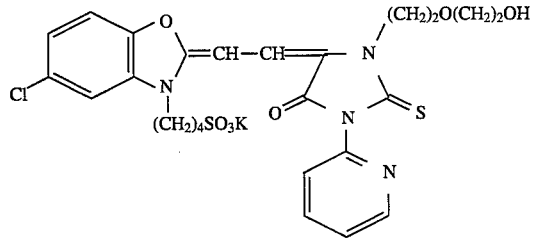

Preparation of Coated Photographic Material Samples:

To each emulsion prepared above, there were added $3.2\times10^{-3}$ mol per mol of silver of the above-mentioned mercapto compound (a), $4.7\times10^{-5}$ mol per mol of silver of the above-mentioned mercapto compound (b), $3.5\times10^{-4}$ mol per mol of silver of the above-mentioned compound (c), $2\times10^{-4}$ mol per mol of silver of 5-chloro-8-hydroxyquinoline, $3\times10^{-4}$ mol per mol of silver of the above-mentioned triazine compound (d), 50 mg/m$^2$ of hydroquinone and $1\times10^{-3}$ mol per mol of silver of the hydrazine derivative as indicated in Table 5 below. In addition, 10 mg/m$^2$ of sodium dodecylbenzenesulfonate, 10 mg/m$^2$ of the following compound (g), 300 mg/m$^2$ of the above-mentioned water-soluble latex, 34 mg/m$^2$ of the above-mentioned nucleation accelerator (1), 10 mg/m$^2$ of the above-mentioned nucleation accelerator (3), 300 mg/m$^2$ of polyethyl acrylate, 200 mg/m$^2$ of latex copolymer comprising methyl acrylate, sodium 2-acrylamido-2-methylpropanesulfonate and 2-acetoacetoxyethyl methacrylate (88/5/7, by weight), and, as hardening agents, 2% by weight, to gelatin, of the following compound (h) and 1% by weight, to gelatin, of bis-vinylsulfonylmethane were added to each emulsion. The pH of the emulsions was adjusted at 5.8. Each of them was coated on a polyethylene terephthalate film (150 μm) having a subbing layer (0.5 μm) of vinylidene chloride copolymer, in amounts of 3.2 g/m$^2$ as silver and 2.0 g/m$^2$ as gelatin.

Compound (g):

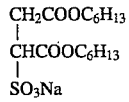

Compound (h): (3/1 mixture of compounds wherein n = 2, and n = 3, respectively)

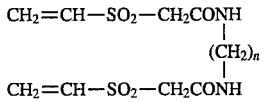

Over the emulsion layer thus coated, there was coated a protective layer comprising 1.0 g/m$^2$ of gelatin, 40 mg/m$^2$ of amorphous $SiO_2$ mat agent having a mean grain size of about 3.5 μm, 0.1 g/m$^2$ of methanol silica, 100 mg/m$^2$ of polyacrylamide, 150 mg/m$^2$ of hydroquinone, 20 mg/m$^2$ of silicone oil, and, as coating aids, 5 mg/m$^2$ of the above-mentioned fluorine-containing surfactant (f) and 100 mg/m$^2$ of sodium dodecylbenzenesulfonate.

Thus, there were prepared coated photographic material samples as shown in Table 5.

The backing layer and the backing layer-protecting layer coated over the samples were the same as those in Example 1.

The samples thus prepared were processed under the following three conditions, and the photographic properties of the thus-processed samples were determined.

(1) The samples each were exposed to a tungsten light through an optical step wedge and processed with an automatic developing machine FG-680A Model (manufactured by Fuji Photo Film Co., Ltd.) at 35° C. for 30 seconds, using the developer mentioned below and a fixer of GR-F1 (produced by Fuji Photo Film Co., Ltd.). The photographic properties (sensitivity, gradation γ) of the thus-processed samples were measured.

| Developer: | |
|---|---|
| Hydroquinone | 30.0 g |
| N-methyl-p-aminophenol | 0.3 g |
| Sodium Hydroxide | 10.0 g |
| Potassium Sulfite | 60.0 g |
| Diethylenetriamine-pentaacetic Acid | 1.0 g |
| Sodium Carbonate | 11.0 g |
| Potassium Bromide | 10.0 g |
| 5-Methylbenzotriazole | 0.4 g |
| 2-Mercaptobenzimidaozle-5-sulfonic Acid | 0.3 g |
| Sodium 3-(5-mercaptotetrazole)-benzenesulfonate | 0.2 g |
| Sodium Toluenesulfonate | 8.0 g |
| Water to make | 1 liter |
| pH | 10.0 |

The sensitivity as referred to herein indicates a relative value of the reciprocal of an exposure amount giving a density of 1.5.

The "γ" value is defined by the following formula:

$$\gamma=(3.0-0.3)/[\log D_{3.0}-\log D_{0.3}]$$

where $D_{3.0}$ and $D_{0.3}$ each means the exposure amount giving density of 3.0 and 0.3, respectively.

(2) As a specific condition for evaluating the inhibition of the stains in the processed photographic material samples, the above-mentioned development was conducted at 35° C. for 20 seconds and the associated fixation and rinsing were also shortened in the same ratio while the rinsing temperature was lowered to 5° C. The stains, if any, in the processed samples were measured and the samples were evaluated by the "5-rank" evaluation. Precisely, "5" indicates a level showing almost negligible stains when one processed sample was examined with the naked eye; "4" indicates a level showing a few stains when three processed samples were combined and examined; "3" indicates a level showing a few stains when one processed sample was examined, but this level still has an acceptable practical use; "2" indicates a level showing stains at a glance, which is not practically acceptable; and "1" indicates a level showing extreme stains, which is also not acceptable.

(3) In order to examine the variations in the photographic properties (sensitivity) of aged samples, each sample was stored for 3 days (residence time) (a) under 5 atms of $O_2$ (dry test) and (b) under 5 atoms of $O_2$ and 60%-RH (wet test). The thus-aged samples were developed under the above-mentioned condition (1) and the sensitivity of each sample was measured. The sensitivity was represented by a value relative to the sensitivity of a fresh sample being 100.

The results obtained are shown in Table 7 below.

TABLE 7

| Sample No. | Sensitiz-ing Dye | Hydrazine Derivative | Photographic Properties of Fresh Samples: Sensitivity | γ | Stains | Aging Resistance: sensitivity after dry aging test | sensitivity after wet aging test | Remarks |
|---|---|---|---|---|---|---|---|---|
| 1 | 3-22 | 4-11 | 100 | 23 | 5 | 100 | 95 | Sample of the Invention |
| 2 | 3-24 | 4-11 | 105 | 24 | 5 | 97 | 95 | Sample of the Invention |
| 3 | 3-29 | 4-11 | 102 | 23 | 5 | 100 | 93 | Sample of the Invention |
| 4 | 3-34 | 4-11 | 107 | 26 | 4 | 97 | 91 | Sample of the Invention |
| 5 | Comparative dye (a) | 4-11 | 132 | 28 | 5 | 89 | 76 | Comparative sample |
| 6 | 3-22 | 4-1 | 95 | 18 | 5 | 95 | 91 | Sample of the Invention |
| 7 | 3-22 | 4-10 | 115 | 28 | 5 | 100 | 98 | Sample of the Invention |
| 8 | 3-22 | 5-25 | 102 | 26 | 5 | 100 | 95 | Sample of the Invention |
| 9 | 3-22 | 5-22 ($1.3\times10^{-4}$ mol/mol of Ag) | 95 | 23 | 5 | 100 | 98 | Sample of the Invention |
| 10 | 3-22 | 6-1 ($3\times10^{-4}$ mol/mol of Ag) | 93 | 20 | 5 | 100 | 95 | Sample of the Invention |

EXAMPLE 4

Emulsions were prepared in the manner mentioned below.

Preparation of Emulsion (A):

An aqueous 0.13M silver nitrate solution and an aqueous halide solution containing $1.5\times10^{-7}$ mol per mol of silver of $K_2Rh(H_2O)Cl_5$ and $2\times10^{-7}$ mol per mol of silver of $K_3IrCl_6$ and containing 0.04M of potassium bromide and 0.09M of sodium chloride were added to an aqueous gelatin solution containing sodium chloride and 1,3-dimethyl-2-imidazolidinethione, with stirring at 38° C. over a period of 12 minutes, by a double jet method, to form silver chlorobromide grains having a mean grain size of 0.14 μm and a silver chloride content of 70 mol % by nucleation. Subsequently, an aqueous 0.87M silver nitrate solution and an aqueous halide solution containing 0.26M of potassium bromide and 0.65M of sodium chloride were added thereto by the same double jet method over a period of 20 minutes.

Next, $1\times10^{-3}$ mol of KI solution was added to the emulsion for halogen-conversion, and the resulting emulsion was washed with water by conventional flocculation. 40 g of gelatin per mol of silver was added thereto, and the resulting emulsion was adjusted to have a pH of 6.5 and pAg of 7.5. The emulsion was then adjusted to a temperature of 60° C. 8 mg per mol of silver of sodium benzenethiosulfonate, 8 mg per mol of silver of chloroauric acid and 5 mg per mol of silver of sodium thiosulfate were added to the emulsion, which was then heated at 60° C. for 45 minutes for chemical sensitization. As a stabilizer, 150 mg of 4-hydroxy-6-methyl-1,3,3a,7-tetrazaindene was added thereto. In addition, 100 mg of proxel was added thereto as an antiseptic. The grains thus formed were cubic silver iodochlorobromide grains having a mean grain size of 0.25 μm and a silver chloride content of 69.9 mol %. The emulsion thus formed had a grain size fluctuation coefficient of 10%.

Preparation of Emulsion (B):

An aqueous 0.13M silver nitrate solution and an aqueous halide solution containing $1.5\times10^{-7}$ mol per mol of silver of $K_2Rh(H_2O)Cl_5$ and $2\times10^{-7}$ mol per mol of silver of $K_3IrCl_6$ and containing 0.053M of potassium bromide and 0.077M of sodium chloride were added to an aqueous gelatin solution containing sodium chloride and 1,3-dimethyl-2-imidazolidinethione, with stirring at 38° C. over a period of 12 minutes, by a double jet method, to form silver chlorobromide grains having a mean grain size of 0.14 μm and a silver chloride content of 60 mol % by nucleation. Subsequently, an aqueous 0.87M silver nitrate solution and an aqueous halide solution containing 0.35M of potassium bromide and 0.53M of sodium chloride were added thereto by the same double jet method over a period of 20 minutes.

Next, $1\times10^{-3}$ mol of KI solution was added to the emulsion for halogen-conversion, and the resulting emulsion was washed with water by conventional flocculation. 40 g of gelatin per mol of silver was added thereto, and the resulting emulsion was adjusted to have pH of 6.5 and pAg of 7.5. The emulsion was then adjusted at a temperature of 60° C. 8 mg per mol of silver of sodium benzenethiosulfonate, 8 mg per mol of silver of chloroauric acid and 5 mg per mol of silver of sodium thiosulfate were added to the emulsion, which was then heated at 60° C. for 45 minutes for chemical sensitization. As a stabilizer, 150 mg of 4-hydroxy-6-methyl-1,3,3a,7-tetrazaindene was added thereto. In addition, 100 mg of proxel was added thereto as an antiseptic. The grains thus formed were cubic silver iodochlorobromide grains having a mean grain size of 0.25 μm and a silver chloride content of 59.9 mol %. The emulsion thus formed had a grain size fluctuation coefficient of 10%.

To Emulsions (A) and (B), the sensitizing dye of the present invention was added, as indicated in Table 6 below. In addition, there were added to the emulsions $2\times10^{-4}$ mol per mol of silver of 1-phenyl-5-mercaptotetrazole, $5\times10^{-5}$ mol per mol of silver of sodium ethylthiosulfonate, $5\times10^{-4}$ mol per mol of silver of the following short-wave cyanine dye (k), 200 mg/m$^2$ of the above-mentioned water-soluble latex (e), 20 mg/m$^2$ of the above-mentioned nucleation accelerator (3), 20 mg/m$^2$ of the following hydrazine compound, 200 mg/m$^2$ of polyethyl acrylate dispersion and, as a hardening agent, 200 mg/m$^2$ of 1,3-divinylsulfonyl-2-propanol:

Compound (k):

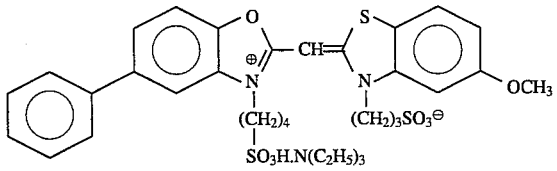

Hydrazine Compound:

-continued

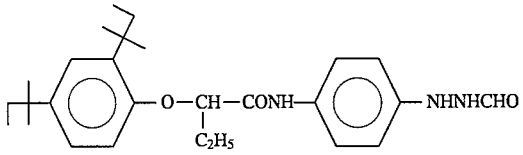

Preparation of Redox Compound-containing Emulsion:

An aqueous 1.0M silver nitrate solution and an aqueous halide solution containing $3\times10^{-7}$ mol per mol of silver of $(NH_4)_3Rh(H_2O)Cl_5$ and also containing 0.3M of potassium bromide and 0.74M of sodium chloride were added to an aqueous gelatin solution containing sodium chloride and 1,3-dimethyl-2-imidazolinethione, with stirring at 45° C. over a period of 30 minutes, by a double jet method, to form silver chlorobromide grains having a mean grain size of 0.28 μm and a silver chloride content of 70 mol % by nucleation. The emulsion was washed with water by conventional flocculation. 40 g of gelatin was added thereto, and the resulting emulsion was adjusted to have pH of 6.5 and pAg of 7.5. 5 mg per mol of silver of sodium thiosulfate and 8 mg per mol of silver of chloroauric acid were added to the emulsion, which was then heated at 60° C. for 60 minutes for chemical sensitization. As a stabilizer, 150 mg of 4-hydroxy-6-methyl-1,3,3a,7-tetrazaindene was added thereto. The grains thus formed were cubic silver chlorobromide grains having a mean grain size of 0.28 μm and a silver chloride content of 70 mol %. The emulsion thus formed had a grain size fluctuation coefficient of 10%.

The emulsion was divided into a plurality parts. To each part there were added $1\times10^{-3}$ mol per mol of silver of 5-[3-(4-sulfobutyl)-5-chloro-2-benzoxazolidyliene]-1-hydroxyethoxyethyl- 3-(2-pyridyl)-2-thiohydantoin as a sensitizing dye, and $2\times10^{-4}$ mol per mol of silver of 1-phenyl-5-mercaptotetrazole, 50 mg/m$^2$ of polyethyl acrylate dispersion and 40 mg/m$^2$ of 1,2-bis(vinylsulfonylacetamido)ethane. In addition, the redox compound, as indicated in Table 6 below, was added thereto.

The hydrazine derivative-containing emulsion layer was coated on a support as the lowermost layer (Ag 3.6 g/m$^2$, gelatin 2 g/m$^2$). Over that layer, there was coated the redox compound-containing emulsion layer (Ag: 0.4 g/m$^2$, content: 0.5 g/m$^2$) via an interlayer (gelatin 0.5 g/m$^2$). Finally, coated thereover was a protective layer comprising gelatin (1.0 g/m$^2$), amorphous $SiO_2$ mat agent having a mean grain size of about 3.5 μm (40 mg/m$^2$), methanol silica (0.1 g/m$^2$), polyacrylamide (100 mg/m$^2$), sodium ethylsulfonate (5 mg/m$^2$), hydroquinone (200 mg/m$^2$), silicone oil (20 mg/m$^2$) and, as coating aids, the above-mentioned fluorine-containing surfactant (f) (5 mg/m$^2$) and sodium dodecylbenzenesulfonate (100 mg/m$^2$). Thus, the photographic material samples of Table 8 below were prepared.

The samples each had the following backing layer and backing layer-protecting layer:

Composition of Backing Layer:

| | |
|---|---|
| Gelatin | 3 g/m$^2$ |
| Polyethyl Acrylate Latex | 2 g/m$^2$ |
| Surfactant (Sodium P-dodecylbenzenesulfonate) | 40 mg/m$^2$ |
| Gelatin Hardening Agent | |

-continued

| | |
|---|---|
| $CH_2{=}CHSO_2CH_2CONH$<br>$(CH_2)_2$<br>$CH_2{=}CHSO_2CH_2CONH$ | 110 mg/m$^2$ |

Dye Mixture of (a), (b) and (c):

(a)

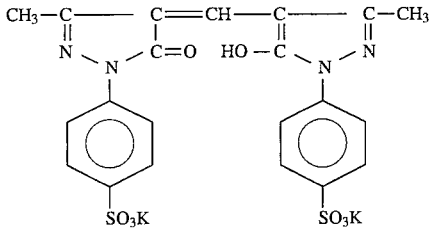

50 mg/m$^2$ (b)

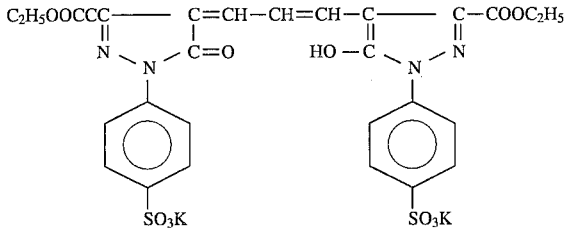

100 mg/m$^2$ (c)

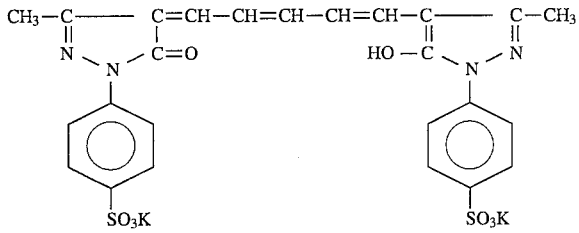

50 mg/m$^2$

Composition of Backing Layer-protecting Layer:

| | |
|---|---|
| Gelatin | 0.8 mg/m$^2$ |
| Fine Polymethyl Methacrylate Grains (mean grain size 4.5 μm) | 30 mg/m$^2$ |
| Sodium Dihexyl-α-sulfosuccinate | 15 mg/m$^2$ |
| Sodium P-dodecylbenzenesulfonate | 15 mg/m$^2$ |
| Sodium Acetate | 40 mg/m$^2$ |
| F-containing Surfactant ($C_8F_{17}SO_2N(C_3H_7)-CH_2COOK$) | 5 mg/m$^2$ |

TABLE 8

| | | Sensitizing Dye | | Redox Compound | | Photographic Properties | | | |
|---|---|---|---|---|---|---|---|---|---|
| Sample No. | Emulsion | Kind | Amount Added (mol/mol of Ag) | Kind | Amount Added (mol/mol of Ag) | Sensitivity | γ | "Black Peppers" | Image Quality |
| 1 | A ($AgCl_{69.9}Br_{30.1}$) | 3-55 | $1 \times 10^{-3}$ | B-19 | $3 \times 10^{-3}$ | 110 | 18.7 | 5 | 5 |
| 2 | A ($AgCl_{69.9}Br_{30.1}$) | 3-55 | $1.5 \times 10^{-3}$ | B-19 | $3 \times 10^{-3}$ | 105 | 18.2 | 5 | 5 |
| 3 | A ($AgCl_{69.9}Br_{30.1}$) | 3-68 | $1 \times 10^{-3}$ | B-19 | $3 \times 10^{-3}$ | 111 | 19.3 | 5 | 5 |
| 4 | A ($AgCl_{69.9}Br_{30.1}$) | 3-68 | $1.5 \times 10^{-3}$ | B-19 | $3 \times 10^{-3}$ | 107 | 18.5 | 4 | 5 |
| 5 | A ($AgCl_{69.9}Br_{30.1}$) | 3-71 | $1 \times 10^{-3}$ | B-19 | $3 \times 10^{-3}$ | 108 | 18.7 | 5 | 5 |
| 6 | A ($AgCl_{69.9}Br_{30.1}$) | 3-71 | $1.5 \times 10^{-3}$ | B-19 | $3 \times 10^{-3}$ | 105 | 17.9 | 5 | 5 |
| 7 | B ($AgCl_{59.9}Br_{40.1}$) | 3-55 | $1 \times 10^{-3}$ | B-19 | $3 \times 10^{-3}$ | 105 | 18.1 | 5 | 5 |
| 8 | B ($AgCl_{59.9}Br_{40.1}$) | 3-55 | $1.5 \times 10^{-3}$ | B-19 | $3 \times 10^{-3}$ | 103 | 17.8 | 5 | 4 |

As is understood from Table 8 above, the photographic material samples of the present invention all had good photographic properties and gave high-quality images, having few "black peppers".

The photographic properties and the images were tested by the following testing methods:

Test for Photographic Properties:

Samples were exposed to a tungsten light of 3200° K. through an optical wedge and then processed with the following Developer (1), using FG-660F Model automatic developing machine (manufactured by Fuji Photo Film Co., Ltd.), at 34° C. for 30 seconds, for determining and evaluating their photographic characteristics. Fixation of the developed samples was conducted by the use of a commercial fixer GR-F1.

The sensitivity as referred to herein indicates a relative value of the reciprocal of an exposure amount giving a density of 1.5 by 30 second development at 34° C., based on sample No. 1 being assigned a standard sensitivity of 100.

The "γ"value as referred to herein is defined by the following formula:

$$\gamma=(3.0-0.3)/[\log(\text{exposure amount giving density } 3.0)-\log(\text{exposure amount giving density } 0.3)]$$

Regarding formation of "black peppers" the background part of each sample as developed at 34° C. for 40 seconds was observed with a microscope, whereupon the observed part was evaluated by a "5-rank" evaluation. Precisely, "5" is the best and "1" is the worst "5" and "4" indicate practical samples; "3" indicates an inferior sample which is practicable with difficulty; and "2" and "1" indicate impractical samples. An intermediate between "4" and "3" was represented by "3.5".

Evaluation of Line Image Quality:

An original having photo-typeset 7-grade Ming-style letters and Gothic-type letters having a reflection density falling within the range of from 0.5 to 1.2 was photographed on each sample, using a camera (DSC351 Model, manufactured by Dai-Nippon Screen), and the exposed samples were developed under the same conditions as mentioned above (34° Cm, 30 seconds) The processed results were evaluated by a "5-rank" evaluation, in which "5" is the best and "1" is the worst. "5" and "4" indicate practical samples; "3" indicates an inferior sample which is practicable with difficulty; and "2" and "1" indicate impractical samples.

| Developer (1): | |
|---|---|
| Hydroquinone | 45.0 g |
| N-methyl-p-aminophenol ½ Sulfate | 0.8 g |
| Sodium Hydroxide | 18.0 g |
| Potassium Hydroxide | 55.0 g |
| 5-Sulfosalicylic Acid | 45.0 g |
| Boric Acid | 25.0 g |
| Potassium Sulfite | 110.0 g |
| Disodium Ethylenediaminetetraacetate | 1.0 g |
| Potassium Bromide | 6.0 g |
| 5-Methylbenzotriazole | 0.6 g |
| N-butyldiethanolamine | 15.0 g |
| Water to make | 1 liter |
| pH | 11.6 |

EXAMPLE 5

Photographic material samples were prepared in the same manner as in Example 1, except that the sensitizing dye and the hydrazine compound ($5\times10^{-3}$ mol/mol of Ag), indicated in Table 9 below, were added to Emulsion (A).

Each of the photographic material samples thus prepared was exposed to a tungsten light through an optical step wedge and processed with an automatic developing machine FG-680A Model (manufactured by Fuji Photo Film Co., Ltd.) at 35° C. for 30 seconds, using the following Developer (1) and a fixer of GR-F1 (produced by Fuji Photo Film Co., Ltd.). The photographic properties of the thus processed samples were measured and are shown in Table 9 below.

Developer (1): 10 ml of the following starter were added to one liter of the following replenisher to prepare Developer (1).

| Replenisher: | |
|---|---|
| Sodium 1,2-Dihydroxybenzene-3,5-disulfonate | 0.5 g |
| Diethylenetriamine-pentaacetic Acid | 2.0 g |
| Sodium Carbonate | 5.0 g |
| Boric Acid | 10.0 g |
| Potassium Sulfite | 85.0 g |
| Sodium Bromide | 6.0 g |
| Diethylene Glycol | 40.0 g |
| 5-Methylbenzotriazole | 0.2 g |
| Hydroquinone | 30.0 g |
| 4-Hydroxymethyl-4-methyl-1-phenyl-3-pyrazolidone | 1.6 g |
| 2,3,5,6,7,8-Hexahydro-2-thioxo-4-(1H)-quinazolinone | 0.09 g |
| Sodium 2-Mercaptobenzimidazole-5-sulfonate | 0.3 g |
| Potassium Hydroxide to make | pH 10.7 |
| Water to make | 1 liter |
| Starter: | |
| Acetic Acid (90%) | 366 g |
| Water to make | 1 liter |

Regarding stains, the background part of each sample, as developed at 35° C. for 30 seconds, was observed with the naked eye, whereupon the observed part was evaluated by the "5-rank" evaluation. Precisely, "5" is the best and "1" is the worst. "5" and "4" indicate practical samples; "3" indicates an inferior sample which is practicable with difficulty; and "2 and "1" indicate impractical samples.

For evaluating the safety of the material when exposed to safelight, each sample was exposed to a 50-W incandescent lamp via a red safelight filter No. 6 (manufactured by Fuji Photo Film Co., Ltd.) with a distance of 20 cm therebetween for 10 minutes and the developed. The safety was evaluated on the basis of the increase of the fog of sample due to the irradiation.

TABLE 9

| Sample No. | Emulsion | Dye | Amount of Dye Added | Hydrazine Derivative | Sensitivity | γ | Stains | Safety to Safelight (increase of fog) | Remarks |
|---|---|---|---|---|---|---|---|---|---|
| 1 | A | I-7 | $5 \times 10^{-4}$ mol/mol of Ag | 4-1 | 102 | 19 | 5 | +0.01 | Sample of the Invention |
| 2 | A | I-8 | $5 \times 10^{-4}$ mol/mol of Ag | 4-1 | 104 | 18 | 4 | +0.01 | Sample of the Invention |
| 3 | A | I-11 | $5 \times 10^{-4}$ mol/mol of Ag | 4-1 | 101 | 19 | 5 | ±0.00 | Sample of the Invention |
| 4 | A | II-1 | $5 \times 10^{-4}$ mol/mol of Ag | 4-1 | 98 | 18 | 4 | +0.01 | Sample of the Invention |
| 5 | A | II-2 | $5 \times 10^{-4}$ mol/mol of Ag | 4-1 | 97 | 19 | 4 | ±0.00 | Sample of the Invention |
| 6 | A | II-8 | $5 \times 10^{-4}$ mol/mol of Ag | 4-1 | 97 | 19 | 4 | ±0.00 | Sample of the Invention |
| 7 | A | I-7 | $5 \times 10^{-4}$ mol/mol of Ag | 4-3 | 100 | 17 | 5 | +0.01 | Sample of the Invention |
| 8 | A | I-7 | $5 \times 10^{-4}$ mol/mol of Ag | 4-10 | 98 | 19 | 5 | ±0.00 | Sample of the Invention |
| 9 | A | I-7 | $5 \times 10^{-4}$ mol/mol of Ag | 5-39 | 99 | 18 | 5 | ±0.00 | Sample of the Invention |
| 10 | A | I-7 | $5 \times 10^{-4}$ mol/mol of Ag | 6-1 | 102 | 18 | 5 | +0.00 | Sample of the Invention |

While the invention has been described in detail and with reference to specific embodiments thereof, it will be apparent to one skilled in the art that various changes and modifications can be made therein without departing from the spirit and scope thereof.

What is claimed is:

1. A silver halide photographic material having at least one silver halide emulsion layer on a support and containing a hydrazine derivative in the emulsion layer or in other hydrophilic colloid layer(s), in which the silver halide emulsion comprises silver halide grains containing:

(a) from $1\times10^{-8}$ to $1\times10^{-6}$ mol, per mol of silver, of an iridium compound, and (b) from $1\times10^{-8}$ to $1\times10^{-6}$ mol, per mol of silver, of a rhodium compound or from $1\times10^{-9}$ to $1\times10^{-5}$ mol, per mol of silver, of a rhenium compound, ruthenium compound or osmium compound, and having a silver chloride content of about 50 mol % or more, and having been color-sensitized with a sensitizing dye of the following general formula (1), (2) or (3):

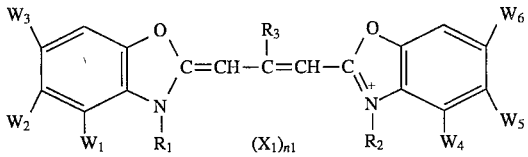

(1)

where $W_1$ and $W_4$ each represent a hydrogen atom;

$W_3$ and $W_6$ each represents a hydrogen atom, a methyl group or a methoxy group;

$W_2$ represents an optionally branched alkyl group having 6 or less carbon atoms as a whole, an alkoxy group having 5 or less carbon atoms as a,whole, a bromine atom, an iodine atom, or an aryl group having 9 or less carbon atoms as a whole; or $W_2$ may be bonded to $W_1$ or $W_3$ to form a benzene ring; or $W_2$ may also be a chlorine atom when $W_3$ is a methyl group or a methoxy group;

$W_5$ represents an optionally branched alkyl group having 6 or less carbon atoms as a whole, an alkoxy group having 5 or less carbon atoms as a whole, a halogen atom, a hydroxyl group, an aryl group having 9 or less carbon atoms as a whole, an aryloxy group having 9 or less carbon atoms as a whole, an arylthio group having 8 or less carbon atoms as a whole, an alkylthio group having 4 or less carbon atoms as a whole, or an acylamino group having 4 or less carbon atoms as a whole, and $W_5$ may be bonded to $W_4$ or $W_6$ to form a benzene ring;

$R_1$ and $R_2$ may be the same or different and each represents an alkyl or alkenyl group having 10 or less carbon atoms as a whole, and at least one of $R_1$ and $R_2$ has a sulfo group or a carboxyl group;

$R_3$ represents an alkyl group;

$X_1$ represents a pair ion necessary for neutralizing the charge of the molecule;

$n_1$ represents 0 or 1, and it is 0 when the molecule is an internal salt,

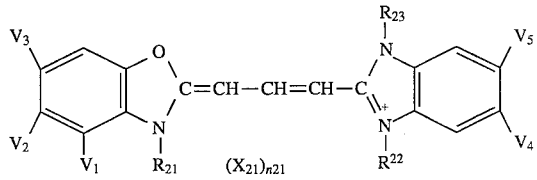

(2)

where $V_1$ represents a hydrogen atom;

$V_2$ represents a hydrogen atom, a halogen atom, a hydroxyl group, an optionally branched alkyl group, a lower alkoxy group, an aryl group having 9 or less carbon atoms as a whole, an aryloxy group having 9 or less carbon atoms as a whole, an arylthio group having 8 or less carbon atoms as a whole, a lower alkylthio group, or an acylamino group having 4 or less carbon atoms as a whole, and $V_2$ may be bonded to $V_1$ or $V_3$ to form a benzene ring;

$V_3$ represents a hydrogen atom, a methyl group or a methoxy group;

$V_4$ represents an electron-withdrawing group;

$V_5$ represents a hydrogen atom, a fluorine atom, a chlorine atom or a bromine atom;

$R_{21}$, $R_{22}$ and $R_{23}$ may be the same or different and each represents an alkyl or alkenyl group having 10 or less carbon atoms as a whole, and at least one of $R_{21}$, $R_{22}$ and $R_{23}$ has a sulfo group or a carboxyl group;

$X_{21}$ represents a counter ion necessary for neutralizing the charge of the molecule;

$n_{21}$ represents 0 or 1, and it is 0 when the molecule is an internal salt,

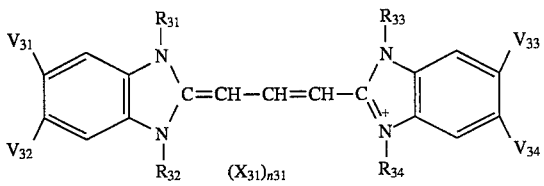

(3)

where $V_{31}$ and $V_{33}$ each represents a hydrogen atom or an electron-withdrawing group;

$V_{32}$ and $V_{34}$ each represents an electron-withdrawing group;

$R_{31}$, $R_{32}$, $R_{33}$ and $R_{34}$ may be the same or different and each represents an alkyl or alkenyl group having 10 or less carbon atoms as a whole, and at least one of $R_{31}$, $R_{32}$, $R_{33}$ and $R_{34}$ has a sulfo group or a carboxyl group;

$X_{31}$ represents a counter ion necessary for neutralizing the charge of the molecule;

$n_{31}$ represents 0 or 1, and it is 0 when the molecule is an internal salt.

2. The silver halide photographic material as claimed in claim 1, in which the hydrazine derivative is at least one compound of the following general formulae (4), (5) and (6):

$$R_{41}—NA_{41}—NA_{42}—G_{41}—R_{42} \quad (4)$$

where $R_{41}$ represents an aliphatic group or an aromatic group, which has, as a part of the substituents, a partial structure of $—O—(CH_2CH_2O)_n—$, $—O—(CH_2CH(CH_3)O)_n—$ or $—O—(CH_2CH(OH)CH_2O)_n—$ (where n is an integer of 3 or more) or has, as a part of the substituents, a quaternary ammonium ion;

$G_{41}$ represents —CO—, —COCO—, —CS—, $—C(=NG_{42}R_{42})—$, —SO—, $—SO_2—$ or $—P(O)(G_{42}R_{42})—$;

$G_{42}$ represents a chemical bond, —O—, —S— or $—N(R_2)—$;

$R_{42}$ represents an aliphatic group, an aromatic group or a hydrogen atom, and plural $R_{42}$'s, if any, may be the same or different; and one of $A_{41}$ and $A_{42}$ is a hydrogen atom and the other is a hydrogen atom, an acyl group, or an alkyl or arylsulfonyl group, $$R_{51}—NHNH—G_{51}—R_{52} \quad (5)$$

where $R_{51}$ represents an aliphatic group, an aromatic group or a heterocyclic group $G_{51}$ represents —CO—, $SO_2$—, —SO—, —COCO—, a thiocarbonyl group, an iminomethylene group, or $—P(O)(R_{53})—$;

$R_{52}$ represents a alkyl group, in which the carbon atom bonded to $G_{51}$ is substituted by at least one electron-withdrawing group; and $R_{53}$ represents a hydrogen atom, an aliphatic group, an aromatic group, an alkoxy group, an aryloxy group or an amino group, $$R_{6a}—NA_{61}—NA_{62}—G_{61}—R_{6b} \quad (6)$$

where $A_{61}$ and $A_{62}$ are both hydrogen atoms, or one of them is a hydrogen atom and the other is a sulfinic acid group or an acyl group;

$R_{6a}$ represents an aliphatic group, an aromatic group or a heterocyclic group;

$R_{6b}$ represents a hydrogen atom, an alkyl group, an aryl group, an alkoxy group, an aryloxy group or an amino group;

$G_{61}$ represents a carbonyl group, a sulfonyl group, a sulfoxy group, a phosphoryl group or an iminomethylene group; and at least one of $R_{6a}$ and $R_{6b}$ has a group which is adsorption-accelerating as to silver halides.

3. The silver halide photographic material as claimed in claim 1, in which the silver halide emulsion layer or other hydrophilic colloid layer(s) contain(s) at least one compound selected from amine derivatives, onium salts, disulfide derivatives and hydroxymethyl derivatives as a nucleation accelerator.

4. A method of forming a photographic image with the silver halide photographic material having at least one silver halide emulsion layer on a support and containing a hydrazine derivative in the emulsion layer or in other hydrophilic colloid layer(s), in which the silver halide emulsion comprises silver halide grains containing:

(a) from $1\times10^{-8}$ to $1\times10^{-6}$ mol, per mol of silver, of an iridium compound, and (b) from $1\times10^{-8}$ to $1\times10^{-6}$ mol, per mol of silver, of a rhodium compound or from $1\times10^{-9}$ to $1\times10^{-5}$ mol, per mol of silver, of a rhenium compound, ruthenium compound or osmium compound, and having a silver chloride content of about 50 mol % or more, and having been color-sensitized with a sensitizing dye of the following general formula (1), (2) or (3):

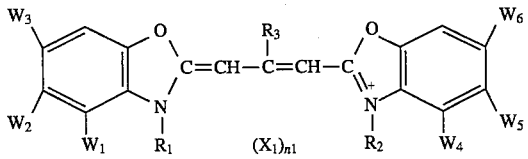

(1)

where $W_1$ and $W_4$ each represent a hydrogen atom;

$W_3$ and $W_6$ each represents a hydrogen atom, a methyl group or a methoxy group;

$W_2$ represents an optionally branched alkyl group having 6 or less carbon atoms as a whole, an alkoxy group having 5 or less carbon atoms as a whole, a bromine atom, an iodine atom, or an aryl group having 9 or less carbon atoms as a whole; or $W_2$ may be bonded to $W_1$ or $W_3$ to form a benzene ring; or $W_2$ may also be a chlorine atom when $W_3$ is a methyl group or a methoxy group;

$W_5$ represents an optionally branched alkyl group having 6 or less carbon atoms as a whole, an alkoxy group having 5 or less carbon atoms as a whole, a halogen atom, a hydroxyl group, an aryl group having 9 or less carbon atoms as a whole, an aryloxy group having 9 or less carbon atoms as a whole, an arylthio group having 8 or less carbon atoms as a whole, an alkylthio group having 4 or less carbon atoms as a whole, or an acylamino group having 4 or less carbon atoms as a whole, and $W_5$ may be bonded to $W_4$ or $W_6$ to form a benzene ring;

$R_1$ and $R_2$ may be the same or different and each represents an alkyl or alkenyl group having 10 or less carbon atoms as a whole, and at least one of $R_1$ and $R_2$ has a sulfo group or a carboxyl group;

$R_3$ represents an alkyl group;

$X_1$ represents a pair ion necessary for neutralizing the charge of the molecule;

$n_1$ represents 0 or 1, and it is 0 when the molecule is an internal salt,

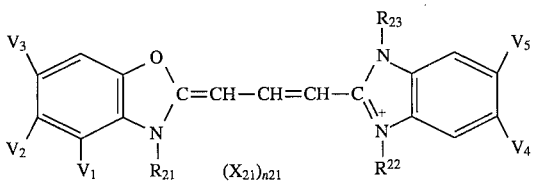

(2)

where $V_1$ represents a hydrogen atom;

$V_2$ represents a hydrogen atom, a halogen atom, a hydroxyl group, an optionally branched alkyl group, a lower alkoxy group, an aryl group having 9 or less carbon atoms as a whole, an aryloxy group having 9 or less carbon atoms as a whole, an arylthio group having 8 or less carbon atoms as a whole, a lower alkylthio group, or an acylamino group having 4 or less carbon atoms as a whole, and $V_2$ may be bonded to $V_1$ or $V_3$ to form a benzene ring;

$V_3$ represents a hydrogen atom, a methyl group or a methoxy group;

$V_4$ represents an electron-withdrawing group;

$V_5$ represents a hydrogen atom, a fluorine atom, a chlorine atom or a bromine atom;

$R_{21}$, $R_{22}$ and $R_{23}$ may be the same or different and each represents an alkyl or alkenyl group having 10 or less carbon atoms as a whole, and at least one of $R_{21}$, $R_{22}$ and $R_{23}$ has a sulfo group or a carboxyl group;

$X_{21}$ represents a counter ion necessary for neutralizing the charge of the molecule;

$n_{21}$ represents 0 or 1, and it is 0 when the molecule is an internal salt,

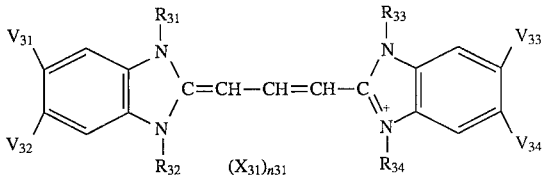

(3)

where $V_{31}$ and $V_{33}$ each represents a hydrogen atom or an electron-withdrawing group;

$V_{32}$ and $V_{34}$ each represents an electron-withdrawing group;

$R_{31}$, $R_{32}$, $R_{33}$ and $R_{34}$ may be the same or different and each represents an alkyl or alkenyl group having 10 or less carbon atoms as a whole, and at least one of $R_{31}$, $R_{32}$, $R_{33}$ and $R_{34}$ has a sulfo group or a carboxyl group;

$X_{31}$ represents a counter ion necessary for neutralizing the charge of the molecule;

$n_{31}$ represents 0 or 1, and it is 0 when the molecule is an internal salt;

which comprises imagewise exposing the silver halide material and developing thereof with a developer having pH of from about 9.6 to less than about 11.0.

* * * * *